US008695520B1

(12) United States Patent
Berte'

(10) Patent No.: US 8,695,520 B1
(45) Date of Patent: Apr. 15, 2014

(54) THIRD GENERATION IMPROVED SAILBOAT

(75) Inventor: Frank Joseph Berte', Westford, MA (US)

(73) Assignee: Innovative Marine Technology Inc., Westford, MA (US)

( * ) Notice: Subject to any disclaimer, the term of this patent is extended or adjusted under 35 U.S.C. 154(b) by 120 days.

(21) Appl. No.: 12/653,221

(22) Filed: Dec. 10, 2009

(51) Int. Cl.
*B63B 35/00* (2006.01)

(52) U.S. Cl.
USPC ..... 114/39.27

(58) Field of Classification Search
USPC ..... 114/39.21, 39.26–39.32, 343, 363, 114/144 R, 162, 163, 167
See application file for complete search history.

(56) References Cited

U.S. PATENT DOCUMENTS 3,141,435 A * 7/1964 Moffitt, Jr. ..... 114/39.26
4,316,424 A * 2/1982 McKenna ..... 114/39.27
4,326,475 A * 4/1982 Berte ..... 114/39.27
4,777,897 A * 10/1988 McKenna ..... 114/39.27
4,936,243 A * 6/1990 Shields ..... 114/363
5,134,950 A * 8/1992 Berte ..... 114/39.27
5,136,961 A * 8/1992 Follett ..... 114/274
5,894,807 A * 4/1999 Aiken ..... 114/39.11
6,959,659 B1 * 11/2005 Burrell ..... 114/39.27

* cited by examiner

*Primary Examiner* — Stephen Avila
*Assistant Examiner* — Andrew Polay
(74) *Attorney, Agent, or Firm* — Nields, Lemack & Frame, LLC

(57) ABSTRACT

The sailboat of the present invention's space frame base is supported by three hulls. Each hull is allowed to rotate freely about a vertical axis intersecting one vertex of the triangular base and weathervane in the direction sailboat of the present invention motion. The direction that sailboat of the present invention moves is only constrained by an independent dagger board/canard rudder structure, whose orientation can be controlled relative to the space frame, when locked at an angle, relative to the nominal configuration. There are two masts on the sailboat each with a twin sail set. Each of said mast assemblies', orientation relative to the apparent wind, is controlled by associated canard winglets. These two masts and the fore spar complete the foldable space frame. The mast assembly angle relative to said base deck plane is changeable to enhance lift on one of said bow, starboard, or port hulls.

10 Claims, 35 Drawing Sheets

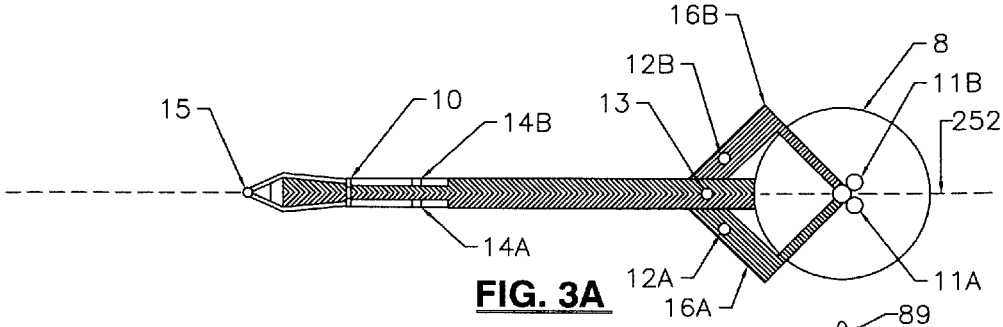
FIG. 3A
FIG. 3C
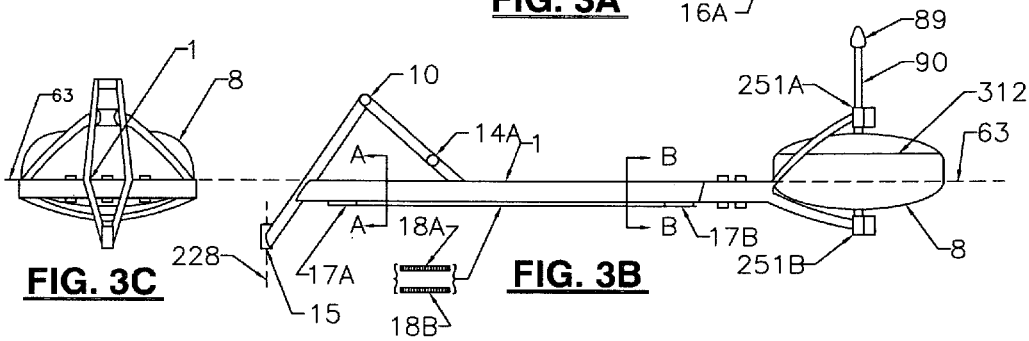
FIG. 3B
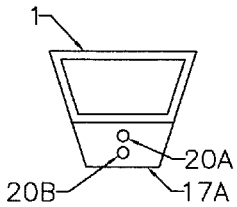
SECTION AA
FIG. 3D
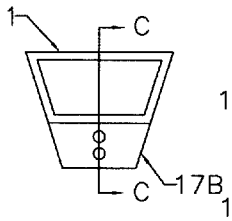
SECTION BB
FIG. 3E
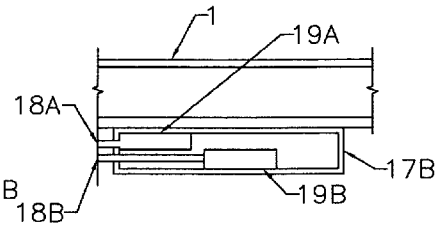
SECTION CC
FIG. 3F

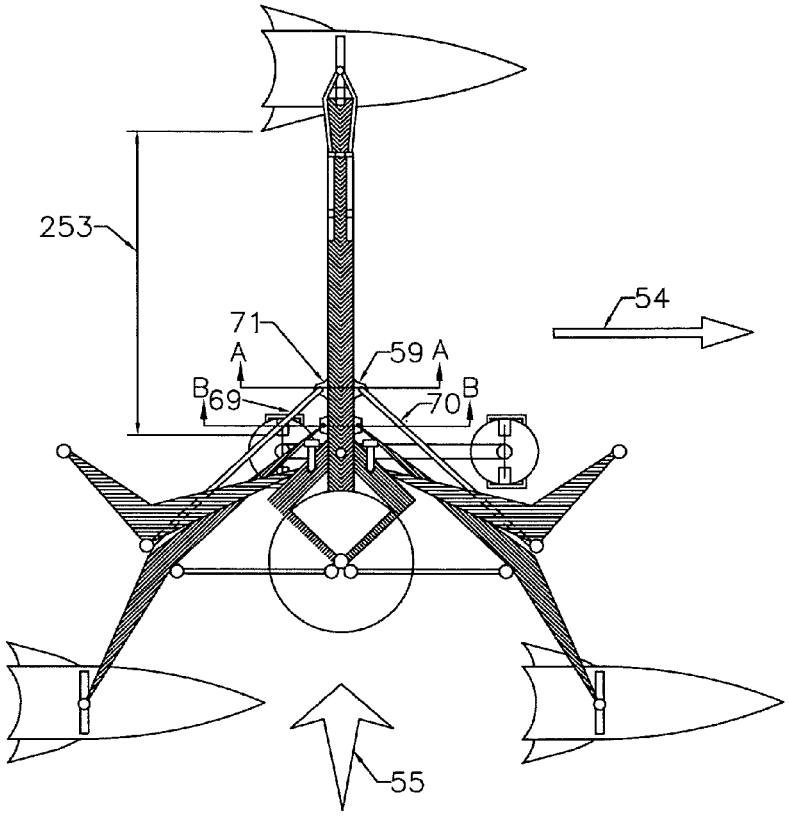
FIG. 9A
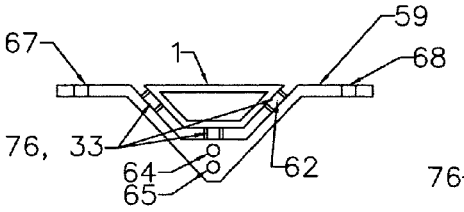
SECTION AA
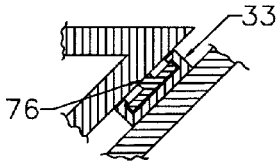
DETAIL 62
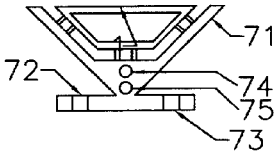
SECTION BB
FIG. 9C
FIG. 9B

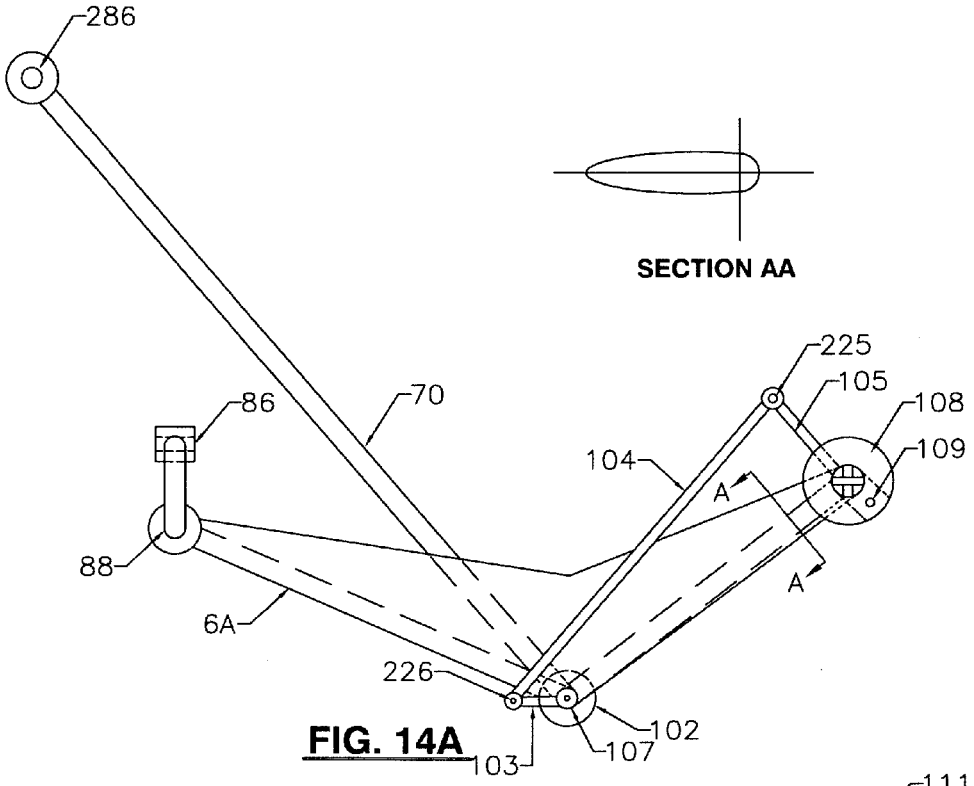
FIG. 14A
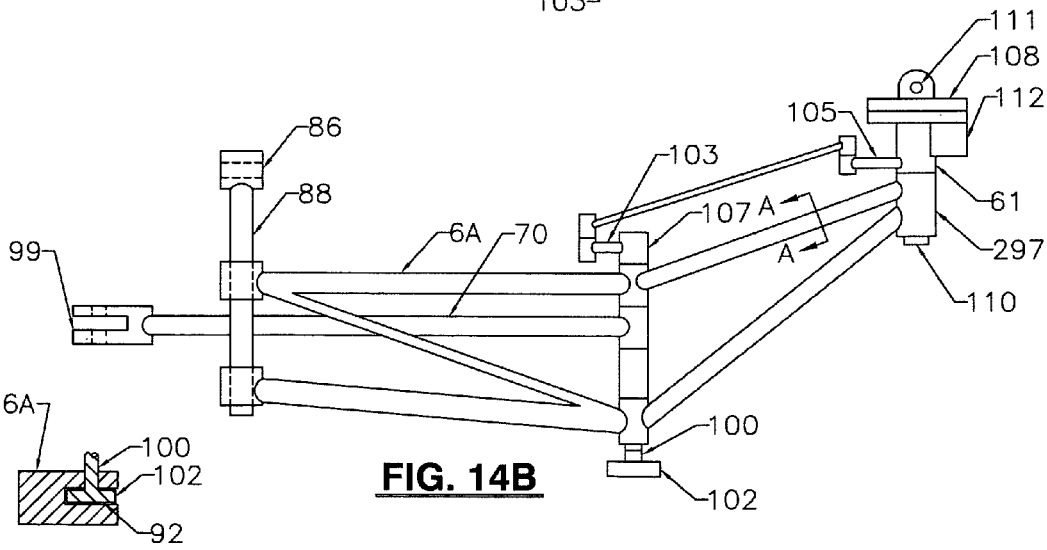
FIG. 14B
FIG. 14C

VIEW BB

VIEW AA

VIEW CC

VIEW CC

THIRD GENERATION IMPROVED SAILBOAT

TECHNICAL FIELD AND APPLICABILITY OF THE INVENTION

This invention relates to a new concept in sailboat configuration, adaptability to sea conditions, and controllability.

CROSS-REFERENCE TO RELATED APPLICATIONS

The First Generation Improved Sailboat (called the first prototype in the following discussion) was an implementation of a tetrahedral space frame design with three identical hulls, one at each of the three vertices of the triangular deck, and a conventional main/jib sail configuration, see U.S. Pat. No. 4,326,475. The Second Generation Improved Sailboat (called the second prototype in the following discussion) continued the evolution process of the concept by the incorporation of two identical sails/mast configurations which formed the two edges of the tetrahedral shape above the triangular deck, see U.S. Pat. No. 5,134,950. The Third Generation Improved Sailboat (the present invention, called alternately, the third prototype in the following discussion) incorporates design features which have been under consideration for, but never implemented in, the two earlier prototypes, as well as subsequent improvements based on extensive model building and testing.

STATEMENT REGARDING FEDERALLY SPONSORED RESEARCH OR DEVELOPMENT

The First Generation Improved, Sailboat of the present invention received the U.S. Pat. No. 4,326,475-awarded on Apr. 27, 1982. This patent application was supported by a National Science Foundation Grant to the Massachusetts Institute of Technology's Innovation Center. The MIT Innovation Center in turn used these funds to pursue the application for the first patent on this improved sailboat concept; this was the first prototype of this new generation.

REFERENCE TO A SEQUENCE LISTING

NOT APPLICABLE

BRIEF SUMMARY OF THE INVENTION

The present invention relates to sailboat in the form of multi hulled sailboat. The sailboat of the present invention is a culmination of more than thirty plus years of work. The latest stage in the evolution of this concept is embodied in the present invention which includes as one of the primary improvements, hulls which are unconstrained, with respect to rotation about their respective vertical axes. This allows the hulls to weathervane and line up exactly with the direction the sailboat of the present invention is moving (as opposed to convention mono and multi-hulled sailboats which always have the hull or hulls moving in a sideways fashion relative to the direction of motion). This is the case because the centerboard/dagger board and the rudder must have a finite angle of attack relative to the motion of the boat through the water in order to generate the side thrust required to prevent the sailboat of the present invention from moving to the leeward, and therefore allow the sailboat of the present invention to sail in directions not directly aligned with the direction of the wind, i.e. tacking. The sailboat of the present invention still requires a rudder and a dagger board, but their configuration and side thrust angles are completely independent of the hulls orientation, with respect to the direction of the hulls motion through the water. The separate—rudder/dagger board assembly is attached to the center of mass location in the triangular base deck plane of the tetrahedral space frame configuration. The rudder assembly is located on this structure in canard configuration (upstream) of the dagger board assembly when the craft is underway. Thus once the rudder/dagger board assembly is unlocked, so as to allow rotation relative to the space frame, a slight rotation in the rudder will rotate the whole rudder/dagger board assembly into the desired sailing direction. Once this new orientation has been achieved the rudder dagger board assembly is again locked in position relative to the space frame. The range of rotation of this rudder dagger board assembly is limited to +/− ninety degrees on either side of the nominal orientation associated with sailing in downwind run. This insures that the helmsperson has a clear view in the sailing direction dictated by the rudder/dagger board assembly orientation. This in turn will allows the sailboat of the present invention to make a quicker change in sailing direction (relative to a conventional multi-hulled sailboat) since the mass and resistance of the rudder/dagger board assembly is much smaller relative to the mass and resistance of the entire sailboat of the present invention, and furthermore there is no requirement for the whole space frame to rotate during tacking, or other sailing configuration, or course changes. Once orientation of the rudder/dagger board has been changed to direct the motion of the sailboat of the present invention in a new direction, the hulls will weathervane into the direction of motion dictated by the rudder/dagger board assembly's final orientation. If the rudder/dagger board assembly is not allowed to rotate relative to the space frame, when the rudder is turned, the sailboat of the present invention whole space frame will just turn in the desired direction. The helmsperson's chair is mounted on top of the shaft that holds the rudder/dagger board assembly, so that when this assembly rotates the helmsperson's chair and control console rotates with it, insuring that the helmsperson is always facing the direction in which the sailboat of the present invention is moving.

Each of the two individual sails in the second prototype has been replaced by a mast assembly in the present invention, each of these assemblies, incorporates a twin sail set. If these mast assemblies are left in the nominal configuration they will just weathervane freely in the wind and not generate any thrust, just aerodynamic drag forces on the sailboat of the present invention space frame. The rotation of these mast assemblies can be accomplished by two means. The first means is moving one of the sails in the twin sail set forward of its nominal location, and simultaneously, moving the second sail of the twin sail set backward relative to its initial nominal configuration. The thrust generated by these twin sail sets is controlled by the relative position of the sails in each sail set, whereby one sail is moved forward and one rearward relative to the axis of rotation of each sail set. This will allow the forward sail in the set to act as the jib and the rearward sail to act as the main sail. Once the change in the relative position of the sails is complete they will generate thrust and provide accelerating force on the space frame in the direction dictated by the orientation of the rudder/dagger board assembly. This direction of sail thrust can be in the fore or aft direction of the sailboat of the present invention travel. This feature will allow the sailboat of the present invention to be stopped from traveling in one direction and the direction of travel reversed, again using (the rudder/dagger board assembly orientation to control sailing direction—without the rotation of the space frame. The second means of rotating the mast assembly, is to utilize the canard winglet assembly of each mast assembly, which has a set of canard winglets (also called winglets), which are attached to the mast assembly and which when rotated relative to their nominal weather vane configuration, will rotate the mast assemblies due to the apparent wind thrust on the winglets. The net result of either or both the configuration changes of the twin sail set, and the winglets, is an unbalanced apparent wind load on these twin sail sets causing the mast assemblies to be forced to orient themselves at an angle to the apparent wind direction, and generate a propulsive thrust.

The sailboat of the present invention incorporates space frame and rudder and dagger board features which allow the sailboat of the present invention space frame to be changed into either the Atlantic Proa or the Pacific Proa configuration. Specifically, the bow hull can act as an effective downwind outrigger (Atlantic Proa) when the sailboat of the present invention is running downwind under one configuration of the space frame, and the bow hull can act as an effective upwind outrigger (Pacific Proa) when the sailboat of the present invention is sailing upwind on a close reach or tacking.

With respect to portability/deployment capabilities, the present invention is trailer-able in smaller realizations, and can be transported in the folded configuration on the trailer. The sailboat of the present invention is launched in this configuration and can also be moved into a boat slip in this configuration. The space frame configuration of the sailboat of the present invention has been designed to be stable throughout the folding and unfolding sequence while close to shore or far out to sea. This allows folding or deploying, capability so that the beam of the present invention can be reduced to enable mooring in a boat slip, or being put on or taken off a trailer, or deployed after being launched from a trailer or moving out from a boat slip. The rudder assembly (which includes the auxiliary electric propulsion in the rudder hull), and the dagger board assembly can both be lifted out of the water completely when beaching the sailboat of the present invention or when launching the sailboat of the present invention, or when the sailboat of the present invention is being carried by trailer, thereby reducing the draft.

When clear of the dock or launching ramp, the starboard and port hulls are extended and the effective beam increases to its fully deployed width, and the effective length at the water line increases to the fully deployed overall length. In this partially deployed configuration, the sailboat of the present invention is stable due both to its length and width dimensions as well as the fact that the masts and sails have yet to be deployed. The sailboat of the present invention can now maneuver under power to beyond the breakwater or the harbor area. Now the final deployment can commence and the masts and the fore spar are moved into the fully deployed space frame sailing configuration. Finally the sails are unfurled, and the sailboat of the present invention is ready to sail.

With respect to speed and stability technology, the three identical hulls of the present invention have been redesigned relative to the second prototype. These hulls also embody a configuration which eliminates the bow waves until the hulls are at planning speed. Because of the hull configuration and the short length, the hulls are planning at low speed. Stability is insured by the space frame effective beam, and effective length. The space frame configuration of the present invention insures a low displacement and a high sail area carrying ability relative to the second prototype. The present invention includes a new sail/mast configuration, which has doubled the effective sail area, without requiring an increase in mast height relative, also relative to the second prototype. The functional design of the present invention includes an independently articulating rudder/dagger board assembly for sailboat of the present invention with respect to directional control and space frame orientation control relative to the apparent wind.

The overriding objectives being to have a design with integrated and interdependent elements, including use of wind, wave, and solar sources to provide sufficient stored energy in the battery bank for auxiliary propulsion, power for the electromechanical servos, and electrical control the sailboat of the present invention, while still being simple to operate, having a large sail area to displacement ratio with the capability to be folded.

STATEMENT OF THE OBJECTIVES OF THE INVENTION

The object of the present invention is to provide evolutionary improvements over the first two prototypes with respect to use of wind, water and sun for control and operational functions, and the ability for a helmsperson to completely control the craft without the assistance of additional crew members.

A still further objective is to minimize the energy required to sail and to maneuver the sailboat of the present invention.

A still further objective is to utilize wind, wave and solar energy sources to power the operation and control functions of the sailboat of the present invention.

A still further objective is to insure that the space frame configuration of the sailboat of the present invention is stable throughout the folding and unfolding sequence while close to shore or far out to sea.

A still further objective is to reduce spilling of the wind out of the sails due to mast motion while the sailboat of the present invention is under way.

A still further objective is to insure that all sails can be rapidly deployed, and furled as required.

A still further objective is to be able to sail in wide range of wind velocity conditions without requiring reefing.

A still further objective is to insure that tacking maneuvers can be accomplished, without rotation of the space frame.

A still further objective is to insure that the hulls can weathervane independently of each other, and the rudder/dagger board assembly orientation, to reduce hull induced drag forces.

A still further objective is to insure that the twin sail sets can weathervane without any rotational constraint unless oriented relative to the apparent wind for thrust by the winglets, or by the relative positioning of the sails in each sail set.

A still further objective is to allow an increase in sail area carrying ability, over the first two prototypes without an increase in mast height.

A still further objective is to allow the deck area of the sailboat of the present invention to be free of any overhead sail boom motion.

A still further objective is to insure that the dagger board orientation is controlled by the control of the rudder assembly orientation, and in combination with the rudder assembly controls the direction of motion of the sailboat of the present invention, independent of the sailboat of the present invention space frame orientation.

A still further objective is to insure that the physical configuration of the sailboat of the present invention cabin induces low wind resistance related drag, independent of the sailing orientation of the space frame relative to the wind.

A still further objective is to provide horizontal area for solar cells on the roof of the cabin.

A still further objective is to insure that mechanical control limitations on the second prototype are reduced using balanced mast assembly configurations and electric servo control technology.

A still further objective is to eliminate the need for any cable stays between the space frame and sail structures, relative to the previous two prototype realizations.

A still further objective is to reduce the stresses in the space frame by concentrating the major loads in the strongest section of the sailboat of the present invention relative to the second prototype.

A still further objective is to insure that the power of the wind is utilized to make mast assembly orientation changes without requiring mechanisms (such as block and tackle) to offset wind loads.

A still further objective is to insure that the forward motion/momentum of the sailboat of the present invention through the water is utilized to assist in changing the orientation of the rudder/dagger board assembly relative to the space frame structure.

A still further objective is to insure that when the sailboat of the present is not under sail, the sailboat of the present invention automatically heads into the wind and limits drift rate.

A still further objective is to insure that in downwind sailing the space frame configuration can be adjusted to provide vertical lift on the bow hull while the sailboat of the present invention is in the nominal configuration.

A still further objective is to provide vertical lift on the starboard or port hull acting as the outrigger by adjustment of the space frame configuration.

A still further objective is to insure that the sailboat of the present invention can be configured, relative to the direction of travel, and while sailing, to allow a space frame/mast orientation to insure the efficient use of the wind for propulsion.

A still further objective is to insure that independent control of the twin sail sets and the sails in each sail set can allow fine tuning with respect to the resultant propulsive force of the wind on the sailboat of the present invention.

A still further objective is to insure that auxiliary electrical motor driven propeller that provides auxiliary thrust remains in the water and continues to provide thrust independent of sea wave conditions.

A still further objective is to insure that the hulls of the sailboat of the present invention are configured to eliminate bow wave drag and go directly to planning mode, and avoid displacement mode, as soon as the sailboat of the present invention starts to move.

A still further objective is to insure that the dagger board and rudder always remain in the water independent of wave action acting on the hulls.

A still further objective is to allow the mast assembly angle relative to the deck to be changed while under way, so that sail lift as well as thrust can be provided in all sailing configurations.

A still further objective is to allow the fully deployed beam of the sailboat of the present invention to be folded to enable mooring in a boat slip.

A still further objective is for one set of sails to be used under all wind velocities, and all sailing directions, relative to the apparent wind.

A still further objective is to allow the hulls to be mechanically oriented while at sea, with the sails furled, to reduce drifting, without the use of an external sea anchor.

A still further objective is control the range of angles that the hulls make with the surface of the water to adjust for wave conditions.

A still further objective is to have the capability for the rudder, and dagger board to be lifted out of the water completely when beaching the sailboat of the present invention or when launching the sailboat of the present invention reducing the maximum draft of the sailboat of the present invention to that of the hulls.

A still further objective is to allow the space frame to rotate 180 degrees for adjusting the configuration of the masts and sails relative to the apparent wind in both the Atlantic Proa and Pacific Proa range of sailing configurations.

A still further objective is to rotate the helmsperson's chair and control console so that they are always aligned with the rudder/dagger board assembly axis insuring that the helmsperson always faces the direction in which the sailboat of the present invention is moving.

A still further objective is have an option to rotate the cabin about its support shafts so that it is always aligned with the rudder/dagger board assembly axis insuring that the forward section of the cabin always faces the direction in which the sailboat of the present invention is moving, for larger realizations of the sailboat of the present invention.

A still further objective is to extract electrical energy from the motion of the hulls in response to waves to charge the battery bank for the electrical actuation and control of the mast assemblies and space frame orientation as well as for auxiliary propulsion power for the sailboat of the present invention.

A still further objective is to make the hulls adaptive components of the sailboat of the present invention for wave conditions, while under way or not under way.

A still further objective is to make the sailboat of the present invention resistant to broaching, while under sail or not under sail.

A still further objective is to make the sailboat of the present invention configuration have low aerodynamic drag forces on the space frame.

A still further objective is to allow directional control of the sailboat of the present invention using the independent rotation of the two mast assemblies.

A still further objective is to use the two mast assemblies to control the configuration of the sailboat of the present invention space frame to suit sailing conditions.

Other objectives are evident in the description that follows. The foregoing objectives are achieved generally in the sailboat of the present invention that includes a foldable space frame, weathervane hulls, sails which can oriented to the apparent wind or allowed to weathervane, a rudder/dagger board assembly that can be rotated relative the space frame for sailing configuration control.

The foregoing objectives are achieved, generally in the sailboat of the present invention that has a space frame. This space frame being characterized as approximately tetrahedral in shape, when the sailboat of the present invention is in the fully deployed configuration. The fully deployed configuration of the sailboat of the present invention, has a central structural element, three fully deployed hulls deposed at the vertices of a triangle, with two mast assemblies fully deployed and a deployed fore spar, which all complete the tetrahedral shape of the sailboat of the present invention. The hulls all have the capability to weathervane in the flow of the water past the sailboat of the present invention and also to incur no bow wave and to reach planing speed rapidly. The sailboat of the present invention also is fold-able for transit and berthing in a slip. The sailboat of the present invention has an articulated rudder/dagger board assembly, which controls the sailing orientation of the sailboat of the present invention independent of the space frame orientation, and the direction in which the helmsperson's chair faces. The sailboat of the present invention further having, two independent sail sets whose orientation to the apparent wind is controlled by the relative position of the sails with respect to their masts axis of rotation and by canard winglets on each mast.

BRIEF DESCRIPTION OF THE SEVERAL VIEWS OF THE DRAWING

The invention is hereafter described with reference to the accompanying drawings in which;

FIG. 3A is the top view of the central structural element of the sailboat of the present invention of FIG. 1;

FIG. 3B is the side view of the central structural element of the sailboat of the present invention of FIG. 1;

FIG. 3C is the front view of the central structural element of the sailboat of the present invention of FIG. 1;

FIG. 3D is a sectional view of the forward part of central structural element of the sailboat of the present invention of FIG. 1;

FIG. 3E is a sternward sectional view of the central structural element of the sailboat of the present invention of FIG. 1;

FIG. 3F is a sectional view of the central structural element, showing the location of the servo devices for folding or deploying the space frame of the sailboat of the present invention of FIG. 1;

FIG. 9 is a to view of the base deck plane and hulls with sectional views of the central structural element and fore and aft cars of the sailboat of the present invention of FIG. 1;

FIG. 14A is a top view of the starboard mast support arm of the sailboat of the present invention of FIG. 1;

FIG. 14B is a stern view of the starboard mast support arm of the sailboat of the present invention of FIG. 1;

FIG. 14C is a cross sectional view, of the starboard hull support arm with showing the connection to the mast support arm of the sailboat of the present invention of FIG. 1;

DETAILED DESCRIPTION OF THE INVENTION

The present invention is based on the third prototype of a sailboat of the present invention design evolution. Each of the two prior patented prototypes involved the use of a tetrahedral space frame, with three hulls at the vertices of a triangle. In the following description references will be made to the improvements over the second prototype, as well as to improvements relative to conventional prior art multi-hulled sailboat of the present invention. Because of the mechanical complexity of the design, the descriptions and improvements will be focused on the major elements of the present invention, and then this will be followed by description of the use, operation, as well as the improvements and innovations associated with the present invention in its entirety.

Figure 1:
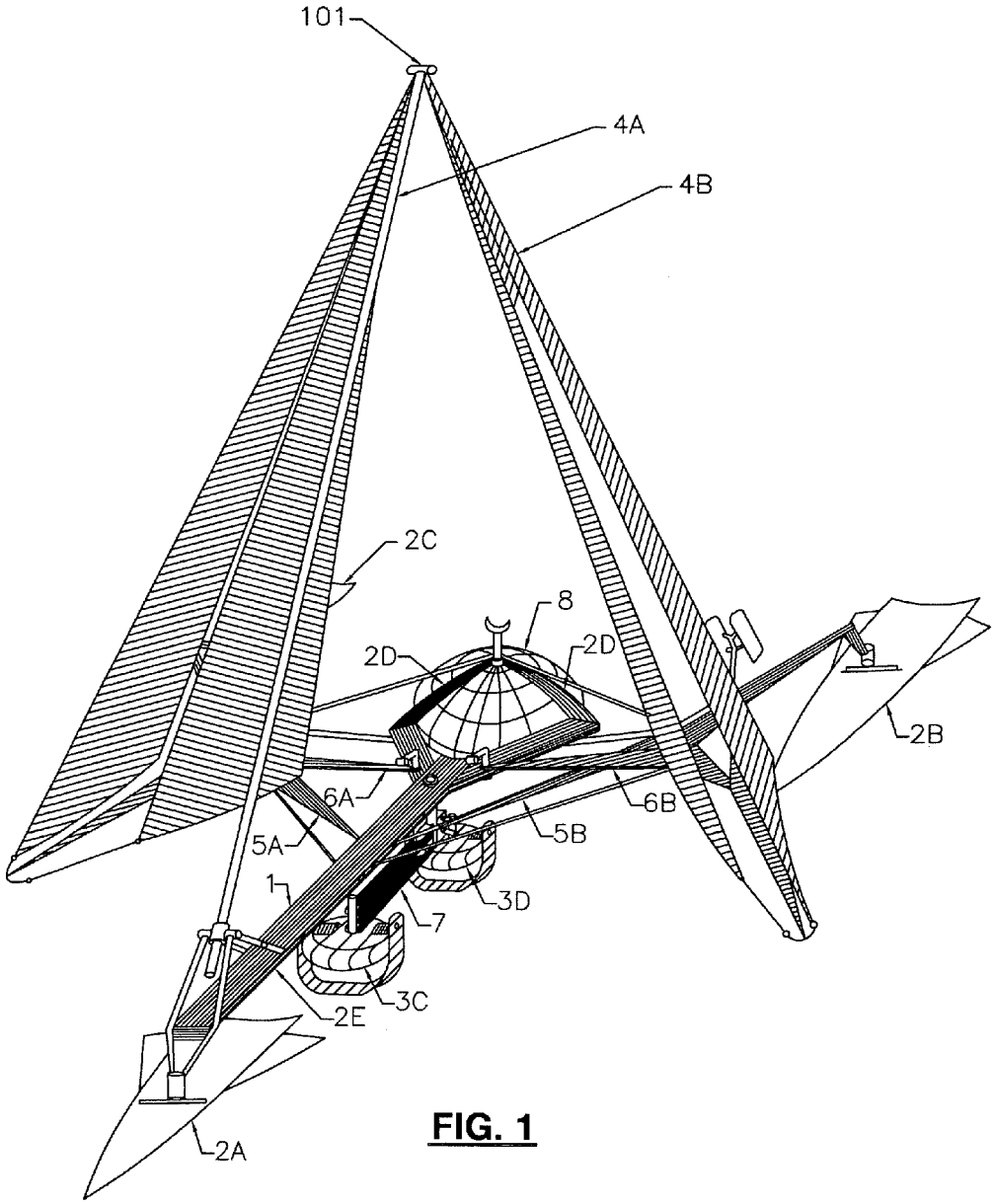
FIG. 1 is an isometric view of the sailboat of the present invention, sailing downwind.

Referring now to the drawings in greater detail, FIG. 1 illustrates the sailboat of the present invention 101 sailing downwind. The primary structural element of the sailboat of the present invention is the component called the central structural element 1, which extends from the "nominal" bow of the sailboat of the present invention 2E to the opposite end, near the cabin 8, at the "nominal" stern of the sailboat of the present invention, where there is located the cabin structural support assembly 2D. The use of the term "nominal" pertains to one of the multiple sailing orientations that the space frame of the present invention can assume. The top surface of the central structural element 1 also serves as the deck area for the sailboat of the present invention. The sailboat of the present invention has three hulls which support it, the bow hull 2A, the port hull 2B, and starboard hull 2C. These hulls, to be described, may be fabricated from aluminum, or other suitable hull material wherein these hulls are completely filled with a floatation medium such as Styrofoam, which prevents sinking of the hull, should the outer shell of the hull be breached. In the following discussion for purposes of explanation in the mechanical details section the hulls (bow, starboard and port) are sometimes designated by their relative position in the nominal configuration of the present invention to explain maneuvers, otherwise the term hull is generic and all hulls share the same physical characteristics. The bow hull is attached to the horn, the starboard hull is on the right side of the central structural element and the port hull is on the left side of the central structural element, when these are viewed from the cabin. In some sailing configurations of the present invention the functions of these respective hulls can be changed as indicated during the discussion of the operation of the present invention. In the following discussion the hulls associated with the rudder and dagger board are specifically noted with the prefix "rudder" or "dagger board". The top of the space frame is comprised of the fore spar 4A, port mast assembly 4B, and the starboard mast assembly 4C, where the bottom is comprised of the central structural element 1, the port hull support arm 5B, the starboard hull support arm 5A, the port mast support arm 6B, and the starboard mast support arm 6A. The rudder hull and the dagger board hulls 3C and 3D respectively, are all part of the rudder/dagger board assembly 7. Further details of these components and those not numbered for sake of clarity will be described in detail in the following figures.

Figure 2:
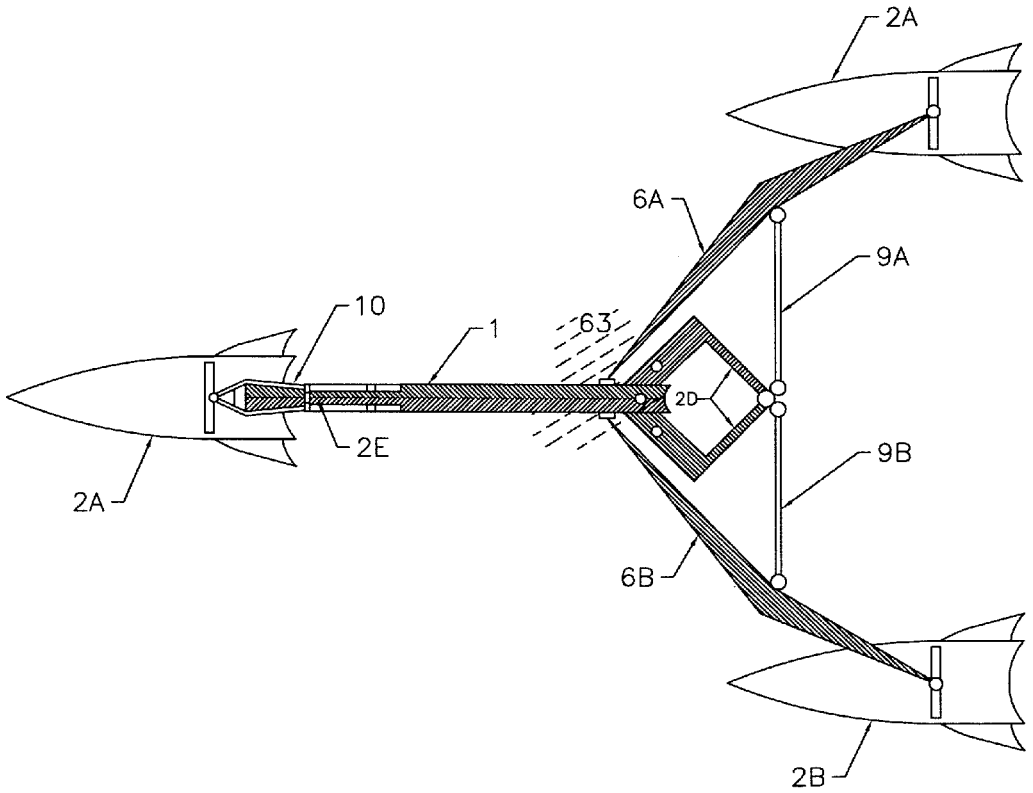
FIG. 2 is a top view of the hull locations relative to the central structural element of the sailboat of the present invention of FIG. 1.

FIG. 2, illustrates the top view of the base deck plane 63, which includes the central structural element 1, the horn 10 at the nominal bow of the sailboat of the present invention 2E, and the cabin structural assembly 2D that supports the cabin 8 (not shown), and also the starboard and port hull support arm pivot links 9A and 9B, these links, in turn, provide support for the starboard hull support arm 6A, and the port hull support arm 6B, of the sailboat of the present invention of FIG. 1.

Figure 5:
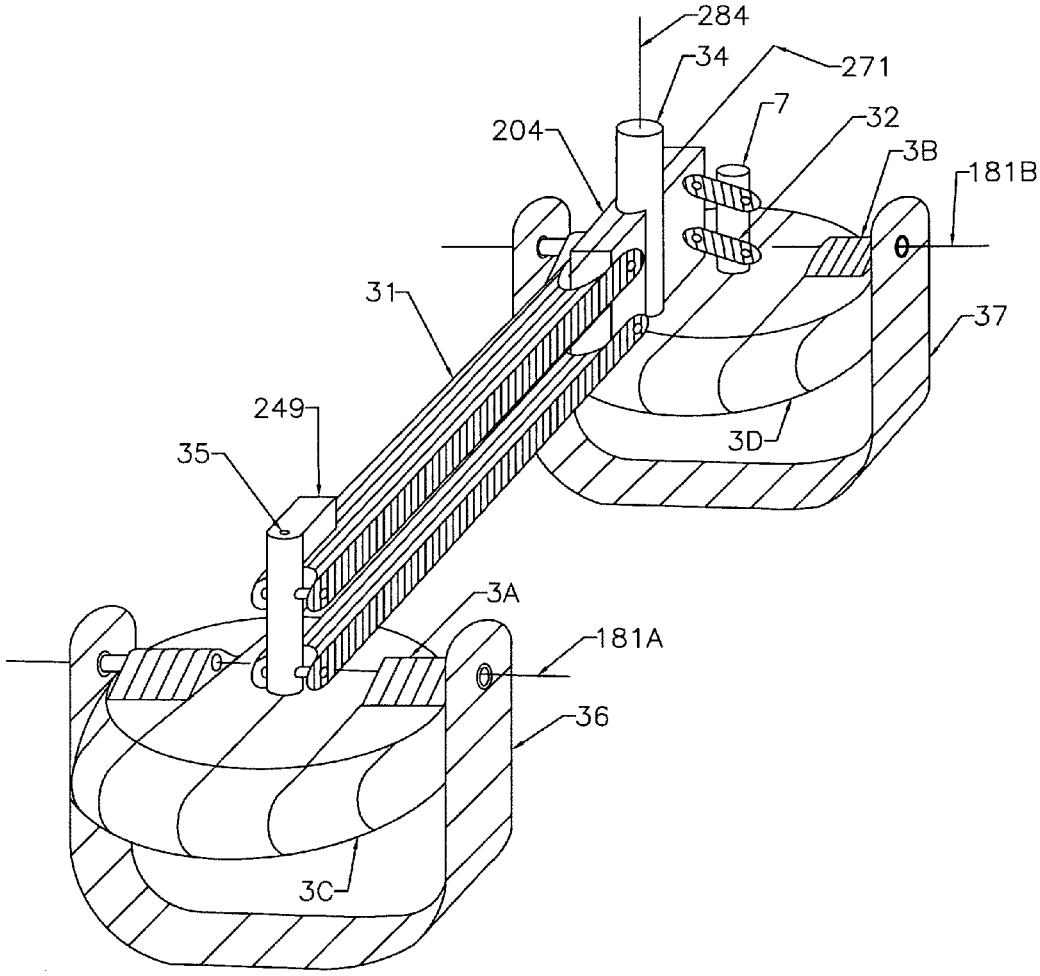
FIG. 5 is an isometric view of the rudder and dagger board assembly component of the sailboat of the present invention of FIG. 1.

FIG. 3A illustrates the central structural element 1, and the horn socket connections 14A and 14B, which are used when the sailboat of the present invention is in the pre-deployed configuration, whose use will be described in detail shortly. FIG. 3 A, also illustrates the location of the strut shaft bearings 12A and 12B, which accept the strut shafts, 88 and 87 (not shown), which connect the mast support arms 6B and 6A respectively (not shown) to the central structural element 1, through the set of struts 16A and 16B attached to the central structural element 1, also illustrated is the hull vertical shaft bearing 15, in the horn 10 of the central structural element 1, which accepts the bow hull vertical shaft 41, shown in FIG. 6A, and the hull support arm pivot link base hinges 11A and 11B locations on the central structural element 1. This central structural element 1 also incorporates the vertical bearing 13, which accepts the central vertical shaft 34 as shown in FIG. 5, of the sailboat of the present invention of FIG. 1. These hull support arm pivot link base hinges 11A and 11B are part of the connection means between the hull support arms and the central structural element 1.

FIG. 3B illustrates the side view of the central structural element 1 and the location of the sectional views AA, BB, and CC of this component, it also shows the location of the fore car screw bearing 20A, and the aft car screw bearing 20B, in the housing 17A, and the fore car 19A, and aft car 19B screw mechanism servo housing 17B both beneath the central structural element 1. Also shown is the side view of the base deck plan 63, and the bearings 251A and 251B which hold the cabin support shaft 90, and the fore spar support cradle 89 at the top of the cabin support shaft 90, and the location of the horn socket connections 14A and 14B. In addition, there is shown the solar cell assembly 312 on the roof area of the cabin 8, of the sailboat of the present invention of FIG. 1.

FIG. 3C illustrates the front view of the central structural element 1 with cabin 8 attached, of the sailboat of the present invention of FIG. 1.

FIG. 3D illustrates the cross section of the central structural element 1, with the fore car screw bearing 20A, and the aft car screw bearing 20B, in the housing 17A beneath the central structural element 1, where these components will be described in more detail later, for of the sailboat of the present invention of FIG. 1.

FIG. 3E illustrates the cross section of the central structural element 1 which has the fore car 19A, and aft car 19B screw mechanism servo housing 17B beneath it, for the sailboat of the present invention of FIG. 1.

FIG. 3F illustrates the cross sectional view CC of the fore and aft car servo housing 17B and the location of the fore car screw 18A, and the aft car screw 18B, for the sailboat of the present invention of FIG. 1.

Figure 4:
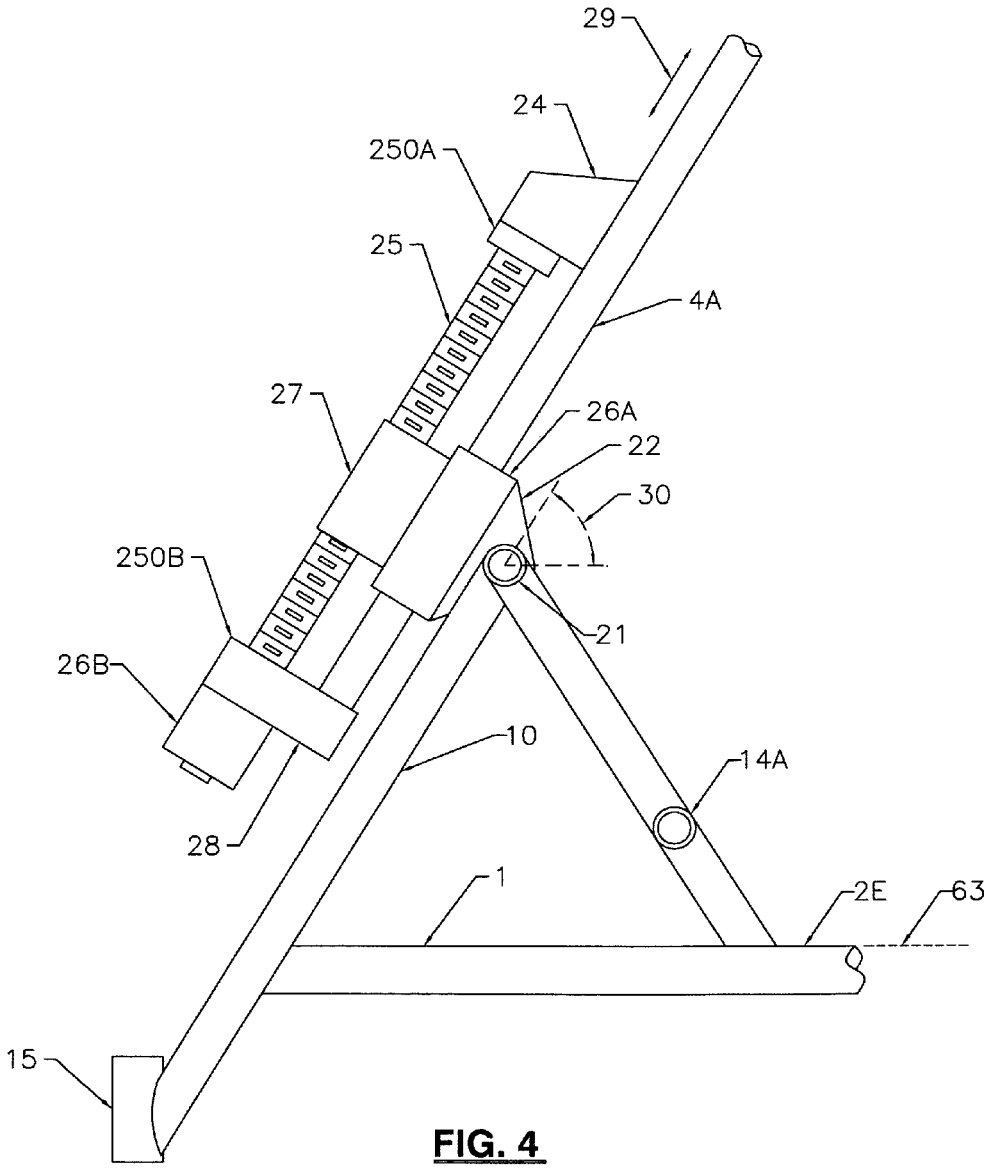
FIG. 4 is a side view of the horn component of the central structural element of the sailboat of the present invention of FIG. 1.

FIG. 4 illustrates the a side view of the components which are part of, or attached to, the horn 10, at the nominal bow end 2E of the central structural element 1, where the horn horizontal shaft 21 upon which the horn pivot mechanism 22 rotates, this mechanism incorporates the slide mechanism 26A, and the internally threaded component 27 through which the fore spar screw 25 moves, this screw is rotated by the fore spar screw mechanism servo 26B. Electrically driven screw mechanisms are used for linear motion these components of the present invention. Alternatively, the required translation motion at this location could also be accomplished by hydraulic or other means. The fore spar screw 25 is fixed to the fore spar 4A by means of a top bearing 24 and a lower bearing 28; these allow rotation of the fore spar screw 25, but not translation relative to the fore spar 4A. Motion of the fore spar 4A is therefore controlled relative to the horn pivot mechanism 22 in the direction indicated 29. Rotation angle 30 about the horn horizontal shaft 21 is allowed as the fore spar 4A moves through the fore spar slide mechanism 26A, yielding different effective length of fore spar 4A, between the horizontal shaft 21 and the top of the fore spar 4A, in the positions 272A through 272B, as shown in FIG. 27B, when the fore spar is in the deployed configuration. The full range of the rotation angle 30 becomes zero degrees, allows the fore spar 4A to be lowered to its extreme effective length, when the mast assemblies are in the pre-deployed configuration as shown in FIGS. 18 A and 18B, and the head of the top mast assembly is at the maximum distance from the horn horizontal shaft 21. When the fore spar 4A is at its shortest effective length configuration 272B shown in FIG. 27B, the fore spar lower stop 250A, rests against the internally threaded component 27. The horn pivot mechanism 22 is the connection means between the horn 10 and the fore spar 4A in the sailboat of the present invention of FIG. 1.

FIG. 5 illustrates the details of the rudder/dagger board assembly 7, which is located below the central structural element 1, as shown in FIG. 1, where the rudder assembly 3A is located as shown in the forward section, and the dagger board assembly 3B is shown in the rearward section of the rudder/dagger board assembly 7, where the 36 is the rudder foil, and can rotate about the rudder horizontal axis 181A and 37 is the dagger board foil, and the dagger board foil 37 can rotate about the dagger board horizontal axis 181B. FIG. 5 also illustrates the rudder assembly support articulation assembly 31, and the dagger board support articulation assembly 32 these assemblies are connected to central shaft base 204, which also is fixed to the central shaft 34. The central shaft 34 connects the rudder/dagger board assembly 7, to the central structural element 1 as shown in FIG. 1. The rudder vertical shaft 35 is used to rotate the rudder assembly, through the rudder rotation control servo 249, and used to steer the sailboat of the present invention of FIG. 1. The rudder/dagger board assembly horizontal axis 271, solely defines the direction in which the sailboat of the present invention travels while under way due to wind, or under auxiliary propulsion, since the hulls can weather vane when under way, and do not affect the direction of travel. Further details of the rudder/dagger board assembly 7 are provided in subsequent figures, for the sailboat of the present invention of FIG. 1.

Figure 6A:
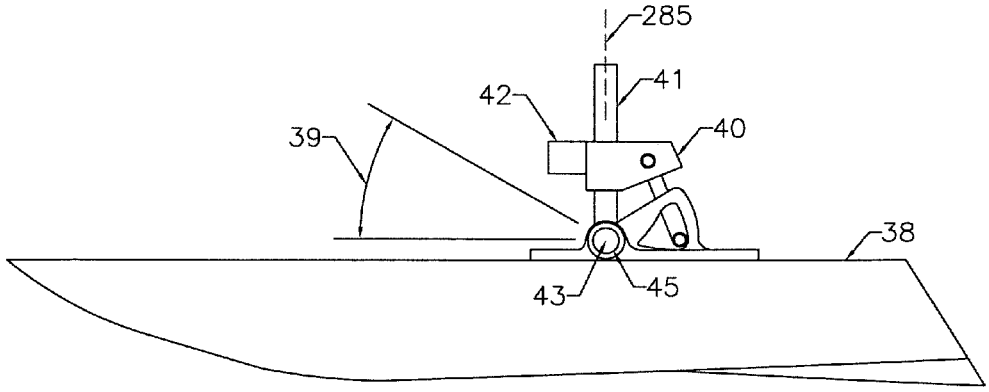
FIG. 6A is a side view of a hull of the sailboat of the present invention of FIG. 1.

FIG. 6A illustrates a typical side view of one of the three hulls 2A, 2B, and 2C, of the sailboat of the present invention in FIG. 1, including the hull angle range 39 of allowable rotation of the hull about its horizontal hinge shaft 45, having a horizontal hinge axis 43. In addition FIG. 6A, illustrates the location of the hull hinge angle range control mechanism 40, through which the hull vertical shaft 41 passes, and whose shaft axis is 285, and which also incorporates the hull vertical shaft rotation mechanism 42, and is fixed to the deck of the hull 38, for the sailboat of the present invention of FIG. 1.

Figure 6B:
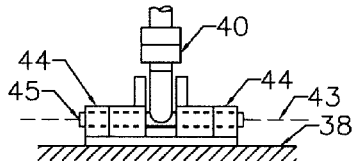
FIG. 6B is a front view of the hull angle range control mechanism of the sailboat of the present invention of FIG. 1.

FIG. 6B illustrates the front view of the hull hinge angle range control mechanism 40, and it's mounting on the deck plane of the hull 38, and the bearings housing 44 which contain the horizontal hinge shaft 45, which also incorporates the motor generators which are affixed to the horizontal hinge shaft 45, and which, can both dampen rotation about this shaft, while generating electric current, as well as rotate the hull around this shaft when the sailboat of the present invention is not under way (to be explained later), for the sailboat of the present invention of FIG. 1.

Figure 7A:
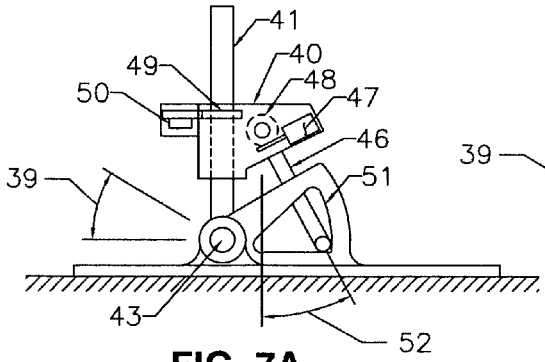
FIG. 7A is a side view of the hull angle range control mechanism, of the sailboat of the present invention of FIG. 1.

FIG. 7A illustrates, in more detail, the side view of the hull hinge angle range control mechanism 40, and its components, including the hull angle range limit device 51, the angle control shaft 46, the servo 47 which controls the free range of angular rotation 52 of the typical hull 2A about the horizontal hinge axis 43, through a worm and worm wheel mechanism 48, the servo 50 which controls the rotation of the hull vertical shaft 41, for the sailboat of the present invention of FIG. 1.

Figure 7B:
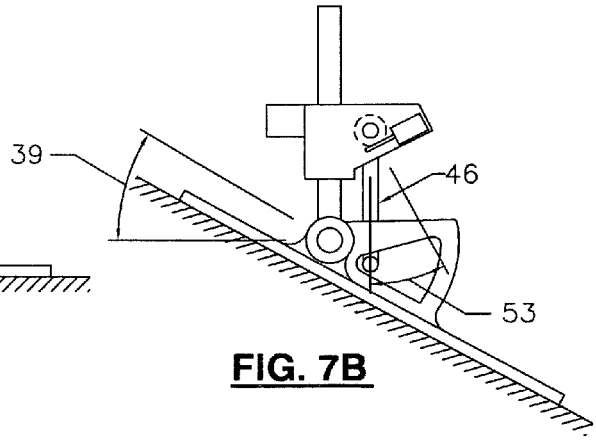
FIG. 7B is a side view of the hull angle range control mechanism, when the hull is at the maximum rotation about its hull horizontal axis of rotation, of the sailboat of the present invention of FIG. 1.

FIG. 7B illustrates the side view of the hull hinge angle range control mechanism, when a typical hull 2A, of the sailboat of the present invention in FIG. 1, has been rotated through an angle 39, by the rotation of the angle control shaft 46 through an angle 53.

Figure 8A:
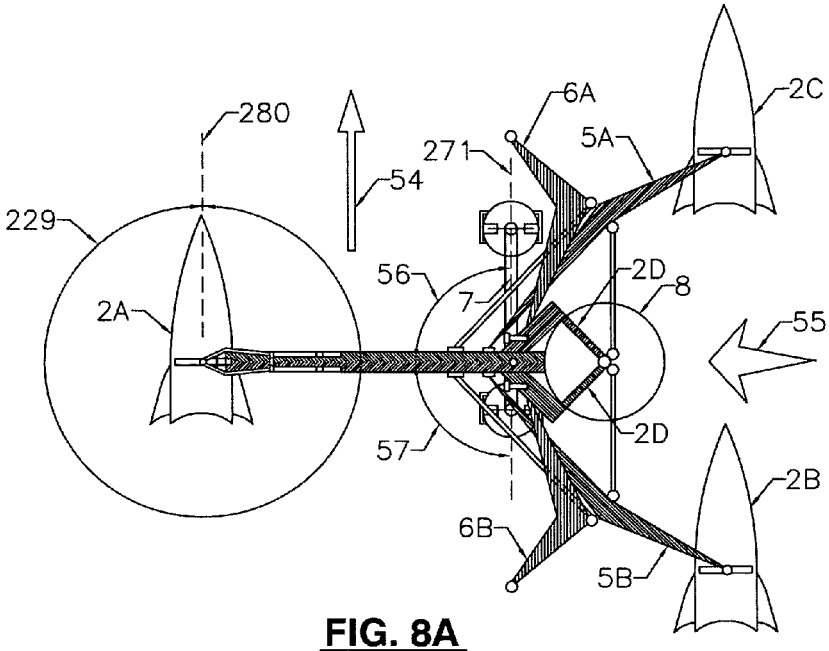
FIG. 8A is a top view of the base deck plane and hulls, in the Atlantic Proa configuration of the sailboat of the present invention of FIG. 1.

FIG. 8A illustrates a top view of the sailboat of the present invention of FIG. 1, for clarity purposes, without the fore spar 4A, or the mass assemblies 4B and 4C, in the Atlantic Proa configuration (with the bow hull 2A in the downwind outrigger position), with the wind direction 55, and sailboat of the present invention travel direction 54, and the rudder/dagger board assembly 7 rotated clockwise 56, by 90 degrees to the extreme limit on the starboard side relative to the nominal location shown in FIG. 1. The rudder/dagger board assembly 7 can also be rotated counter clock wise 57, to the extreme limit on the port side. There is no range limit of allowable rotation 229 for all three hulls 2A, 2B, and 2C, as is illustrated in FIG. 8A for hull 2A, whose hull axis 280 is shown.

Figure 8B:
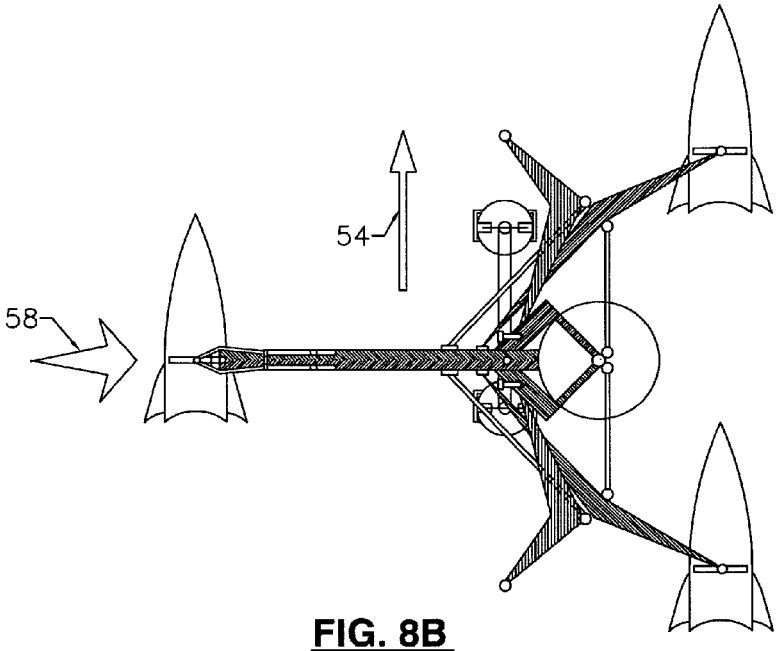
FIG. 8B is a top view of the base deck plane and hulls, in the Pacific Proa configuration of the sailboat of the present invention of FIG. 1.

FIG. 8B illustrates a top view of the sailboat of the present invention of FIG. 1, for clarity purposes, without the fore spar 4A, or the mass assemblies 4B and 4C, in the Pacific Proa configuration, (with the hull 2A in the upwind outrigger position) with the wind direction 58, and the sailboat of the present invention of FIG. 1 traveling in the direction 54.

FIG. 9 illustrates a top view of the sailboat of the present invention of FIG. 1, for clarity purposes, without the fore spar 4A, or the mass assemblies 4B and 4C, in the Atlantic Proa configuration, with the wind direction 55, where sectional view 59 is a cross Section AA through the fore car 59 and the central structural element 1, which further illustrates the locations of the sliding bearings 33 between the fore car 59 and the central structural element 1, and the detail of one sliding bearing 62. In FIG. 9 there are mentioned sliding bearings and electrically driven screw mechanisms, which are used for linear motion alternatively, the required translation motion could also be accomplished by hydraulic or other means. Section AA further illustrates the location of the three identical rails 76 that run the entire length of the central support element 1, between the forward housing for the fore and aft car screw mechanism 17A, and the rear housing for the fore car 59 and the aft car screw mechanism servos 17B, as shown in FIG. 3B. Electrically driven screw mechanisms are used for linear motion these components, alternatively, the required translation motion at this location could also be accomplished by hydraulic or other means. As shown, there are two rails on the sides and one on the bottom of the central structural element 1. A detail of one of the typical sliding bearings 62 is shown in detail 62, where a sliding bearing 33, typical of all four bearings on the aft car 71, and all four bearings on the fore car 59 are shown. There are two cylindrical holes 64 and 65 in the fore car 59, where the upper hole 64 is threaded. There are two cylindrical holes 67 and 68 in the top region of the fore car 59; these are the connection points for the mast support arm push rods, 69 and 70 respectively. Section BB, illustrates a cross sectional view through the aft car 71 and the central structural element 1, where this aft car 71 also incorporates two cylindrical holes 74 and 75 in its lower section, where the lower hole 75 is threaded, and there are also cylindrical holes 72 and 73, on the top of the aft car 71 which are the respective connection points for the hull support arms 5A and 5B. The sliding bearings between the aft car 71 and the central structural element 1 are identical to those for the fore car 59 and are also shown in detail 62.

Figure 10A:
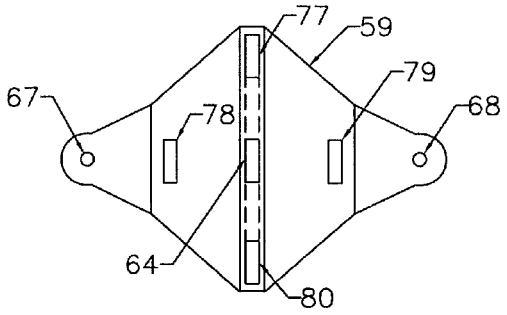
FIG. 10A is a top view of the fore car component of the sailboat of the present invention of FIG. 1.

FIG. 10A illustrates the top view of the fore car 59 in FIG. 9 with the locations of the four sliding bearings 77, 78, 79, 80, and the cylindrical holes 67 and 68, for the connection points mast support arm push rods 69 and 70, and the threaded cylindrical hole 64 (cylindrical hole 65 is hidden) for the sailboat of the present invention in FIG. 1.

Figure 10B:
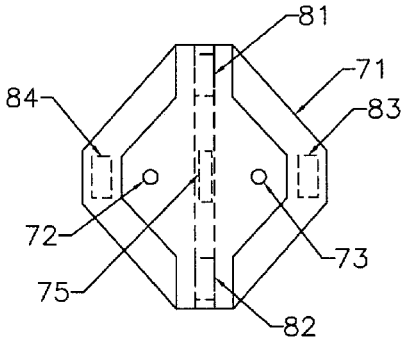
FIG. 10B is a bottom view of the aft car component of the sailboat of the present invention of FIG. 1.

FIG. 10B illustrates the bottom view of the aft car 71 in FIG. 9 with the locations of the four sliding bearings 81, 82, 83, 84, and the cylindrical holes 72 and 73 which are the connection points for the hull support arms 5A and 5B, and the threaded cylindrical hole 75 (cylindrical hole 76 is hidden), of the sailboat of the present invention in FIG. 1.

Figure 11A:
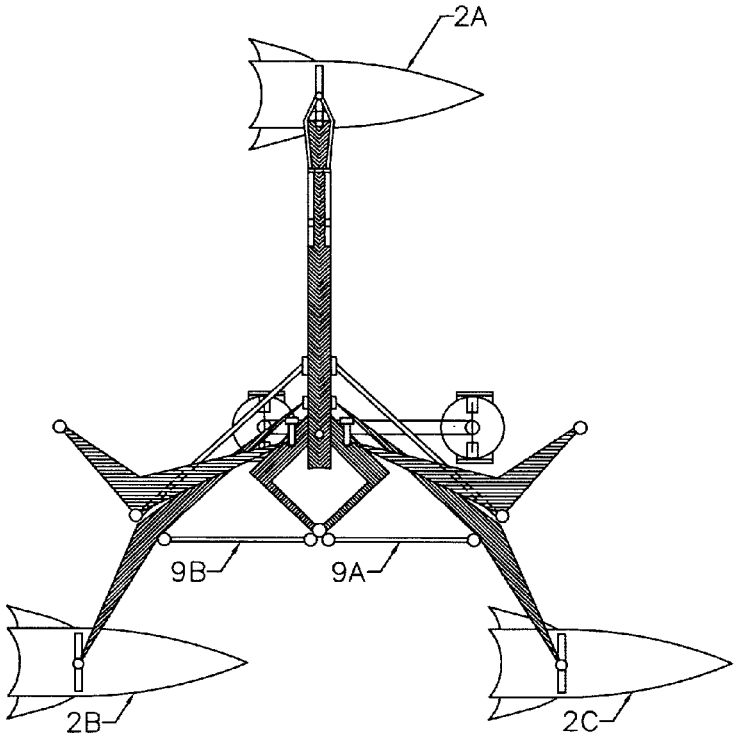
FIG. 11A is a top view of the base deck plane, without the cabin of the sailboat of the present invention of FIG. 1.

FIG. 11A illustrates a top view of the sailboat of the present invention of FIG. 1, for clarity purposes, without the fore spar 4A, the mass assemblies 4B and 4C, or the cabin 8 and shows the starboard hull support arm pivot links 9A and the port hull support arm 9B.

Figure 11B:
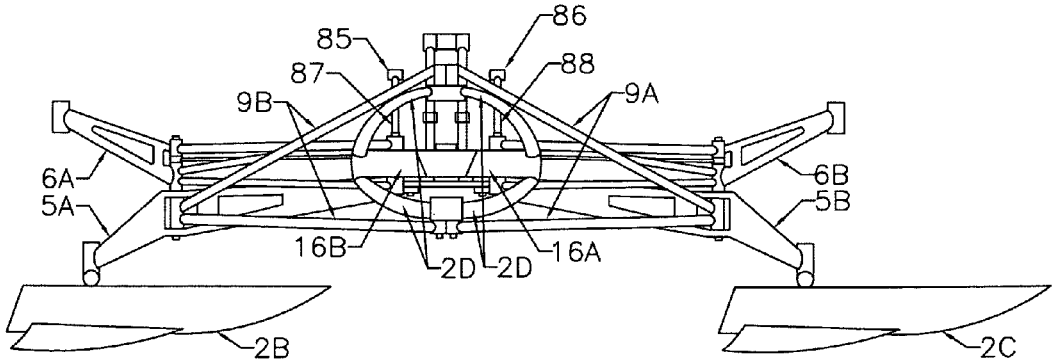
FIG. 11B is a stern view of the base plane, without the cabin of the sailboat of the present invention of FIG. 1.

FIG. 11B illustrates a detailed stern view of the sailboat of the present invention of FIG. 1, for clarity purposes, without the fore spar 4A, the mass assemblies 4B and 4C, or the cabin 8, where the cabin support structure assembly 2D are attached to the set of struts 16A and 16B on the central support element 1, as shown in FIG. 32A. Also shown are the strut shaft pin sockets 85 and 86 at the top of each strut shaft 87 and 88, respectively.

Figure 12:
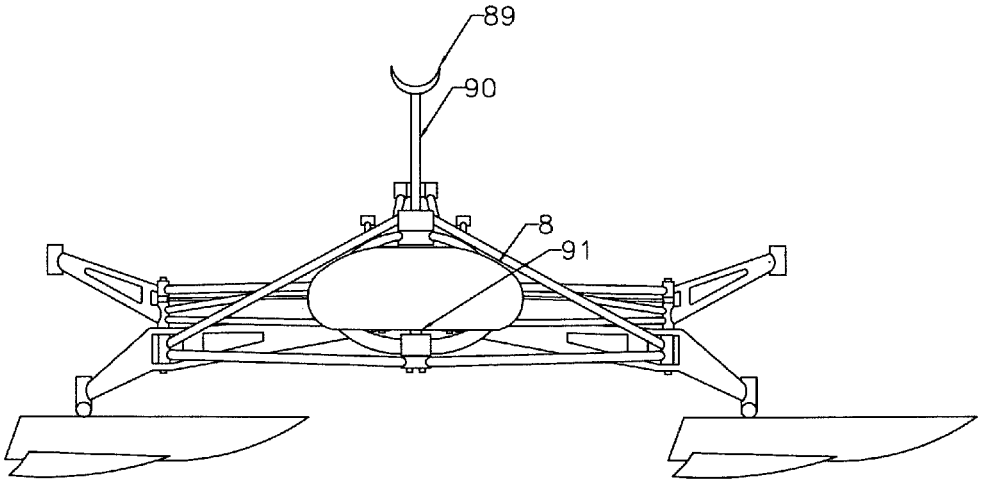
FIG. 12 is a stern view of the base deck plane, with the cabin of the sailboat of the present invention of FIG. 1.

FIG. 12 illustrates a stern view of the sailboat of the present invention of FIG. 1, for clarity purposes, without the fore spar 4A, the mass assemblies 4B and 4C, while showing the location of the cabin 8, and the fore spar support cradle 89 at the top of the top cabin vertical support shaft 90. Also shown is the bottom cabin vertical support shaft 91, which in combination with the top cabin support shaft 90 fixes the cabin 8 to the cabin support structure assembly 2D as shown FIG. 11B.

Figure 13A:
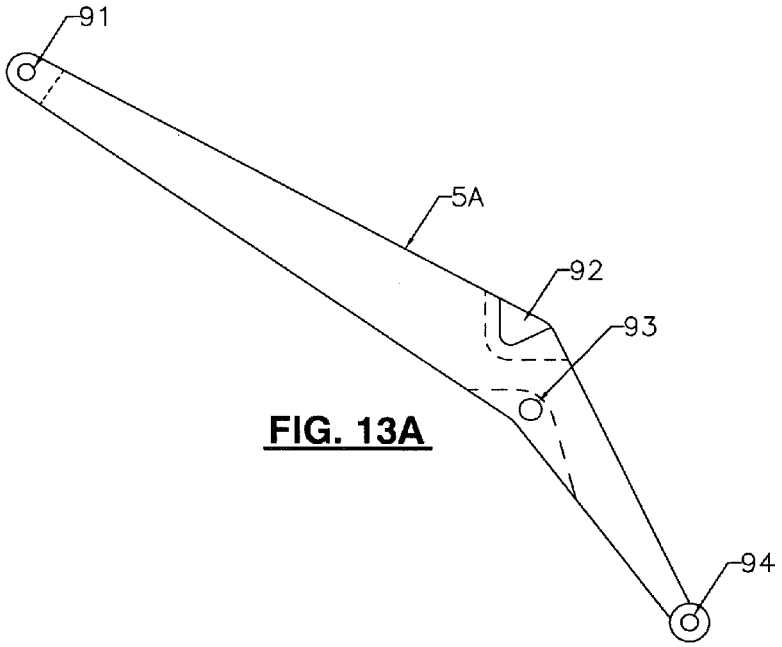
FIG. 13A is a top view of the starboard hull support arm of the sailboat of the present invention of FIG. 1.

FIG. 13A Illustrates the top view of the starboard hull support arm 5A. This hull support arm 5A is connected to the aft car 71 by means of a shaft (not shown) which would be located in cylindrical hole 91. The starboard mast support arm socket 92, in the starboard hull support arm 5A receives the starboard mast support arm pin 102 shown in FIGS. 14B and 14C. It should be noted that the corresponding port mast support arm socket is the mirror image of the starboard mast support arm socket 92, and is not shown. The cylindrical hole 93 receives the pin connection to the starboard hull support arm pivot links 9A, as shown in FIG. 11B. The port hull support arm 5B configuration is mirror image of this starboard hull support arm 5A. Thus these components, constitute a connection means for accomplishing the connecting the starboard hull support arm 5A, and the port hull support arm 5B to the aft car 71, for the sailboat of the present invention of FIG. 1.

Figure 13B:
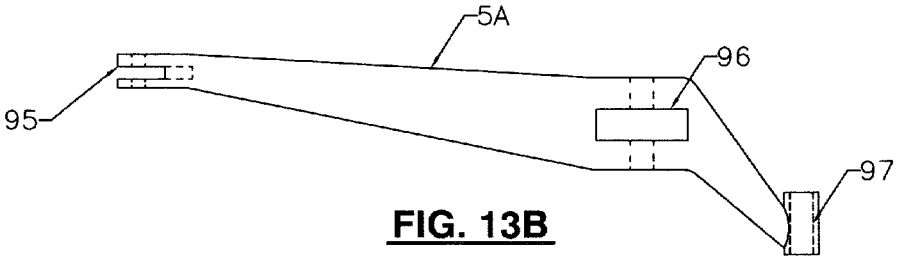
FIG. 13B is a side view of the starboard hull support arm of the sailboat of the present invention of FIG. 1.

FIG. 13B Illustrates the stern view of the starboard hull support arm 5A of the sailboat of the present invention shown in FIG. 1. The slot 95 captures the aft car 71 section with a shaft passing through cylindrical hole 73 as shown in FIG. 10B. The slot 96 captures the starboard hull support arm pivot link 9A, by means of a shaft (not shown) through cylindrical hole 93 shown in FIG. 13A. The hull vertical shaft 41 on the port hull 2B passes through the bearing 97. The port hull support arm 5B configuration is mirror image of this arm 5A, for the sailboat of the present invention of FIG. 1.

FIGS. 14A, and FIG. 14B illustrate a top and side view, respectively, of the starboard mast support arm 6A and the mast support arm push rod 70, with the associated components and mechanisms, including, the strut shaft 88, which connects the mast support arm 6A to the strut component 16B of the central structural element 1, through the bearing 86 as shown in FIG. 11B. This strut shaft 88 is "L" shaped as shown in FIG. 1, FIG. 14A, and FIG. 14B. There is a pin connection (not shown) located in cylindrical hole 286 between the starboard mast support arm push rod 70 and the fore car 59 (also not shown). The cross section AA of the starboard mast support arm 6A has an aerodynamic shape to reduce wind related drag forces. Thus these components constitute a connection means for connecting the starboard mast support arm and the port mast support arm to the fore car. Also illustrated is the mast deployment mechanism 61 which is comprised of the arm 103 which is fixed to the shaft 100 by means of the cylinder 107, this shaft 100 is also fixed to the mast support arm push rod 70, so that when this mechanism is engaged, the mast support arm push rod 70 is moved toward the stern by the fore car 59, the arm 103 rotates. This in turn moves the linkage bar 104, through a pivot pin 226 and causes, through the pivot pin 225, the arm 105 to rotate in a counter clockwise direction, and this rotates the boom base shaft rotation lock 112, which is mounted on top of the shaft 110, located in the mast support arm bearing 297. The disc 108 and the pad eye 111 normally rotate freely unless locked onto the boom base shaft rotation lock 112. The boom base shaft rotation lock 112, is shown in detail in FIG. 22A, and when engaged insures that the boom base 113 of the starboard mast assembly 4C, remains parallel to the central structural element axis 252. The port side mast support arm 6B and the mast support arm push rod 69 configurations and associated mast deployment mechanism 61 are a mirror image of the mast support arm 6A, of the sailboat of the present invention in FIG. 1.

FIG. 14C illustrates a cross section through the mast support arm 6A, where the mast support arm pin connection 102 becomes seated in the starboard hull support arm socket 92, as shown, when the mast assembly support arms 6A and 6B are moved into their fully deployed configuration (after the starboard and port hull support arms (5A and 5B) have been already fully deployed), for the sailboat of the present invention of FIG. 1.

Figure 15A:
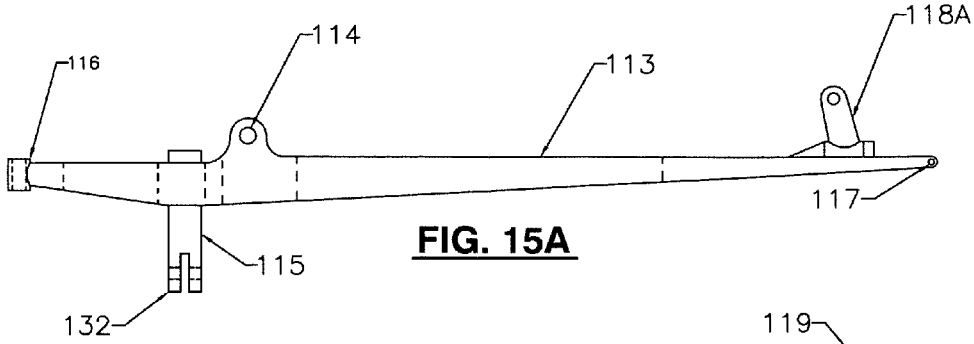
FIG. 15A is a side view of the boom base of the mast assembly of the sailboat of the present invention of FIG. 1.
Figure 15B:
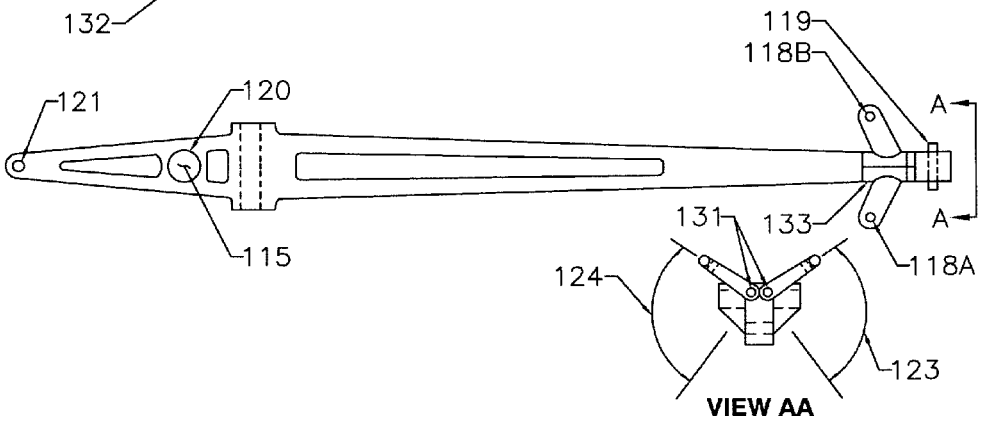
FIG. 15B is a top view of the boom base of the mast assembly of the sailboat of the present invention of FIG. 1.
Figure 15C:
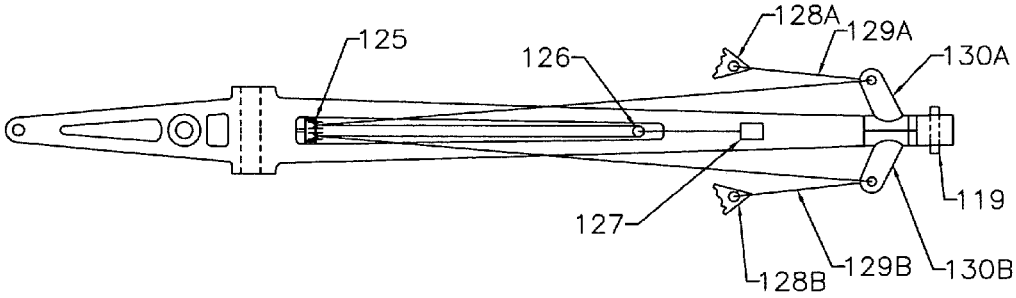
FIG. 15C is a top view of the boom base of the mast assembly, showing the lines that control the sails of the sailboat of the present invention of FIG. 1.
Figure 16A:
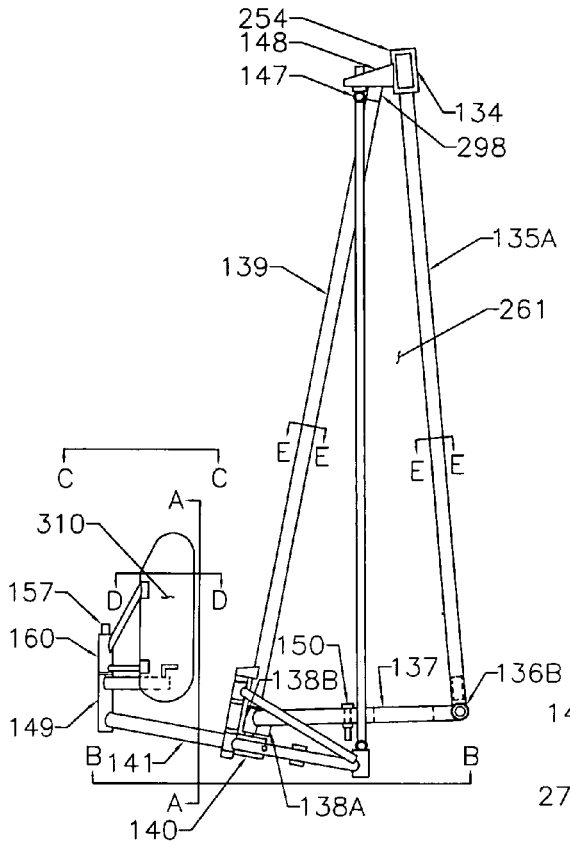
FIG. 16A is a side view of the top mast assembly of the sailboat of the present invention of FIG. 1.

FIGS. 15A, 15B, and 15C, illustrate, respectively a side view of the boom base assembly 113, the top view of the boom base assembly 113, and the top view of the boom base assembly 113 including lines from the clew (128A, 128B) of each of the two sails, in the twin sail set, affixed to the boom base assembly 113. The boom base hinge cylindrical hole 114 is where the boom base hinge shaft 136 is located, as shown in FIG. 16A. The boom base hinge shaft 136 connects the boom base assembly 113 to the top mast assembly 261 in FIG. 16A. At the bottom of the boom base assembly 113, is located the boom base shaft 115, which is terminated at its lower end in the top half of a universal joint 132, and at the top end 120 is fixed to the boom base assembly 113. At the forward end of the boom base assembly 113 there is located the top mast assembly pin lock mechanism 116, which is used to lock the top mast assembly 261, to the boom base assembly 113, as shown in FIGS. 16A through 16G in the fully deployed configuration for the mast assembly 4B, see FIGS. 17A and 17B. At the other end of the boom base assembly 113 is the cylindrical hole 117, which contains the mast pin 119, which is use to fix the boom base assembly 113, to the corresponding strut shaft pin socket 86 on the top of the strut shaft 88, when the mast assembly 4B is in the pre-deployed configuration—also see FIG. 27A. The mast assembly 4C has an identical configuration. At the extreme end of the boom base assembly 113, is located the pivot tail 133, which has two pivoting arms 130A and 130 B, each of these arms has at its extremity a block 118 A, 118 B through, which the corresponding sail clew lines 129A or 129B respectively, passes through. The clew lines 129A and 129B provide tension to the respective sail clews 128A and 128B. These two pivoting arms rotate about the shafts in the base 131. The range of motion of each pivoting arm, 123 and 124, is the same, but the motion of each arm is independent of the other arm, and allows the respective clew lines to provide the tension on the clew 128A and 128B of each sail under different orientations of the twin sail shaft 139 rotation, as shown in FIGS. 26D, and 26C. Just behind the boom base horizontal hinge is located a double sheave block 125, through which the two clew lines 129A and 129B pass on their path to the tensioning block 126, which in turn is tensioned by the servo 127. This insures that both sails in the twin sail set have the same tension on their clews. There are two identical boom base assemblies 113, one in each mast assemblies 4B and 4C of the sailboat of the present invention of FIG. 1. The boom base assembly 113 also has an approximately vertical boom base shaft 115 which extends down, through a universal joint 132, and onto shaft 111 into the mast support arm bearing 297, in the mast support arm 6A, as shown in FIG. 14B. This universal joint 132 allows the boom base shaft 115 to change its angle relative to the base deck plane 63 during the deployment and folding processes. This boom base shaft 115 and the shaft 258 at the mast head receiver bearing socket 254 of each top mast assembly 261 constrains the mast assembly 4B to rotate about the mast assembly axis of rotation 260, and allow the mast assembly 4B to rotate freely and weather vane in the apparent wind, except when the sailboat of the present invention is sailing as explained shortly. There is a electrically driven boom base shaft rotation damping mechanism 212 which can retard the free rotation the boom base shaft 115 against rotation, when activated by the helmsperson, in addition, this electrically driven boom base shaft rotation damping mechanism 212 can allow rotation of boom base shaft 115, while the sailboat of the present invention of the present invention is under sail when there are wind overloads, so as to protect the sails from damage (see FIG. 14B), as explained shortly, for the sailboat of the present invention of FIG. 1.

FIGS. 16A, 16B, 16C, 16D, 16E, 16F, and 16G, are a set of diagrammatic representations of the components of the top mast assembly 261.

Figure 16B:
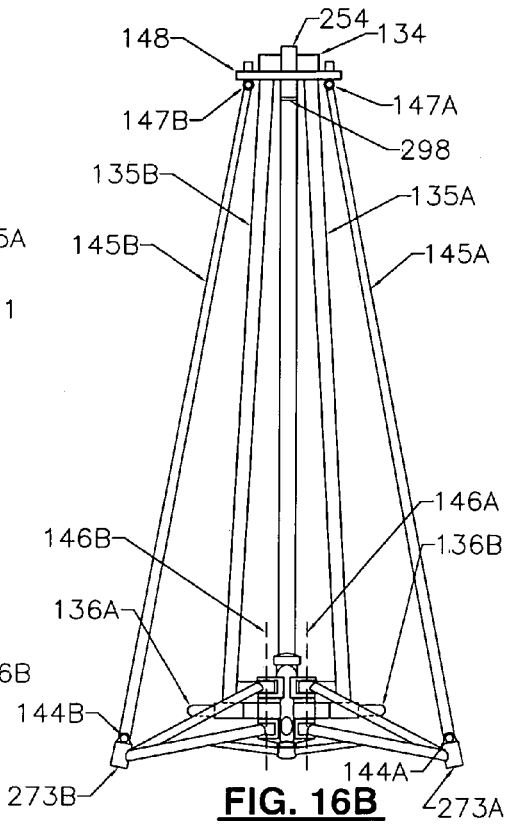
FIG. 16B is a front view of the top mast assembly, without the canard winglet assembly of the sailboat of the present invention of FIG. 1.
Figure 16C:
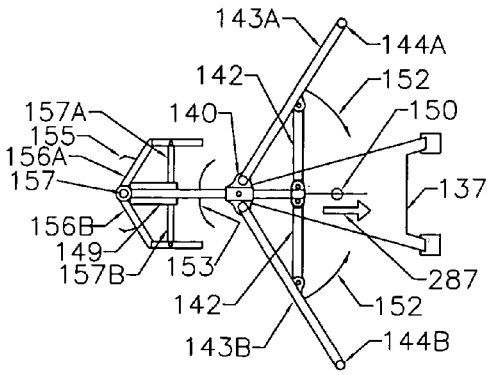
FIG. 16C is a top view of the canard winglet assembly of the sailboat of the present invention of FIG. 1.
Figure 16D:
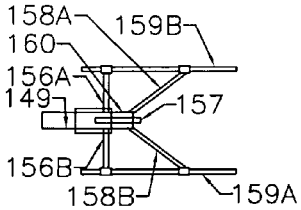
FIG. 16D is a bottom view of the canard winglet assembly and the top mast assembly base of the top mast assembly of the sailboat of the present invention of FIG. 1.
Figure 16E:
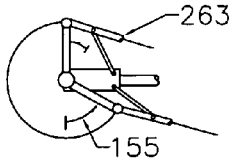
FIG. 16E is a top view of the winglets rotated counterclockwise, of the sailboat of the present invention of FIG. 1.
Figure 16F:
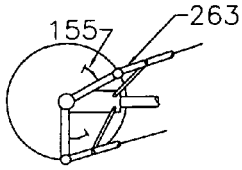
FIG. 16F is a top view of the winglets rotated clockwise, of the sailboat of the present invention of FIG. 1.
Figure 16G:
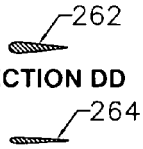
FIG. 16G is a cross sectional view of the canard winglet assembly of the sailboat of the present invention of FIG. 1.

FIG. 16A is a side view of the top mast assembly 261; it is comprised of the following components, where 135A is one of the two spar sections 135A and 135B which are attached to the hinge connection at the top mast assembly base 137 through the boom base hinge shaft 136 (spar 135B is hidden). At the extreme forward end of the top mast assembly base 137 is located the twin sail pivot shaft bearing 138B, this bearing holds the lower end of the twin sail pivot shaft 139, while the top end of the twin sail shaft 139 is held in the upper twin sail pivot shaft bearing 298—located in the top mast assembly head 134. Each top mast assembly 261 is also fixed to the spars 135A and 135B. These spars have an aerodynamic cross section to minimize wind related drag forces (Section EE, shown in FIG. 16G). The top mast assembly base 137, the two spars 135A and 135B and the twin sail pivot shaft 139 forms a rigid tetrahedral structure. The top mast assembly 261 has a triangular shaped base called the top mast assembly base 137; which incorporates a top mast assembly base lock pin 150, shown in FIG. 17B, which is used to lock the top mast assembly base 137 to the boom base assembly 113. The twin sail pivot shaft 139 incorporates a twin sail pivot shaft rotation lock servo 138 A (which is adjacent to the twin sail pivot shaft lower bearing 138B), that is capable of controlling, as well as locking, the rotation of this shaft 139 relative to the top mast assembly 261 structure. The twin sail pivot shaft rotation lock mechanism servo 138A can be used to rotate the twin sail pivot shaft 139 to the desired rotation angle and then lock it in this position without a constant energy input to the servo 138A. The bottom of the twin sail pivot shaft 139 which protrudes below the lower bearing 138B is fixed to a perpendicular bearing housing 140, which is connected to the canard winglet assembly 263 support shaft 141. A side view of one winglet 310 is shown in FIG. 16A. The canard winglet assembly support shaft 141 can be moved in translation through the bearing housing 140 by means of a servo driven rack 166 and pinion 167 mechanism 281, see FIG. 17C. Attached to this winglet support shaft 141 at the are two push rods 142 (shown in FIG. 16C), which, when the winglet support shaft 141 is moved forward through the bearing housing 140, extends the two pivoting sail support arms 143A and 143B shown in FIG. 16D, these sail arms pivot about their sail support arm hinges (whose rotation axes are 146A and 146B) which are fixed to the lower section of the twin sail pivot shaft 139, as shown in FIG. 17B. At the ends of each of these sail arms are located the lower spherical socket bearings 144A and 144B for each sail shaft 145A and 145B, respectively. These lower bearings allow rotation of the sail shaft 145A and 145B, and also allow slight angular movement of the sail shafts 145A and 145B, which is required when the twin sail pivot shaft 139 rotates. These respective sail shafts 145A and 145B are rotated in order to furl the associated sails, this is accomplished at the foot end of these sail shafts 145A and 145B which incorporate an electric roller furling device 273A and 273B to wind up the sails around their respective shafts when the sails are furled—as shown in FIG. 16B. The head of each sail shaft 145A and 145B fits into a bearing at the top of the twin sail pivot shaft 139, which allows unlimited rotation of the sails about their respective shafts. Note: this sail furl/unfurl mechanism is similar to the roller furling used on typical sailboat's jib sail, except that each sail is furled on rotating shaft instead of on a fore stay. The top end of each sail shaft 145A and 145B terminates in spherical socket bearing (147A and 147B respectively) that allows rotation as well as the slight angular movement of the sail shafts 145A and 145B when the twin sail pivot shaft 139 is rotated. These spherical bearing are incorporated in a mast top head housing 148, which also incorporate the top bearing for the twin sail pivot shaft 139. The forward end of the winglet support shaft 141 is fixed to the winglet rotation lock mechanism 149. FIG. 16B is a front view of the top mast assembly 261, and for clarity purposes, without the winglet support shaft 141 and the winglet rotation lock mechanism 149. The top of the top mast assembly 261 includes the mast head receiver bearing socket 254. The hinge axes for the sail arms 146A and 146B are shown as well as their attachment to the twin sail pivot shaft 139. FIG. 16C is an diagrammatic representation of Section BB in FIG. 16A, which is a bottom view of the top mast base 137, with the winglet support shaft 114, the pivot arms 142, and the sail arms 143A and 143B. These sail arms 143A and 143B move through the angle 152, when the winglet support shaft 141 is moved toward the top mast assembly base pin lock mechanism 116. When this motion is complete these two pivot arms 143A and 143B are in the folded configuration. The winglet rotation lock mechanism 149 attached to the winglet support shaft 141. When the bearing housing 140 is rotated with the rotation of the twin sail shaft 139, the winglet support shaft 141 can also be rotated through an angle 153 up to a 30 degree magnitude to either side of the nominal position shown in FIG. 16C. Independently the winglet rotation lock mechanism 149 can rotate the winglets arms 156A and 156B (which are fixed to each other), through an angle 155 of magnitude 30 degrees to either side of the nominal position shown in FIGS. 16E and 16F. The winglet lower arms 156A and 156B, as well as the upper arms 158A and 158B, are all fixed to the winglet cylinder 160 which rotates about the vertical winglet shaft 157. This winglet cylinder 160 is rotated by the winglet rotation lock mechanism 149, as shown in FIG. 16D, which illustrates the Section AA view in FIG. 16A. The two winglets 159A and 159B are further constrained in the motion to remain approximately parallel by the two idler arms 157A and 157B, when the winglet cylinder 160 is rotated, as shown in the top view of the winglet rotation lock mechanism in FIG. 16E and FIG. 16F. Each winglet has the same aerodynamic cross section as shown in FIG. 16G, Section DD. Each mast assembly 4B and 4C, must be approximately balanced about its respective axis of rotation 260 in FIGS. 17A, 26A, 26B, and this balance should be approximately preserved, independent of the rotation of the twin sail pivot shaft 139 and its attached components, when the mast assembly is fully deployed. This is a further requirement needed to maintain overall balance requirements of each mast assembly 4B and 4C. There are two top mast assemblies, one in each of the respective mast assemblies 4B and 4C of the sailboat of the present invention of FIG. 1.

Figure 17A:
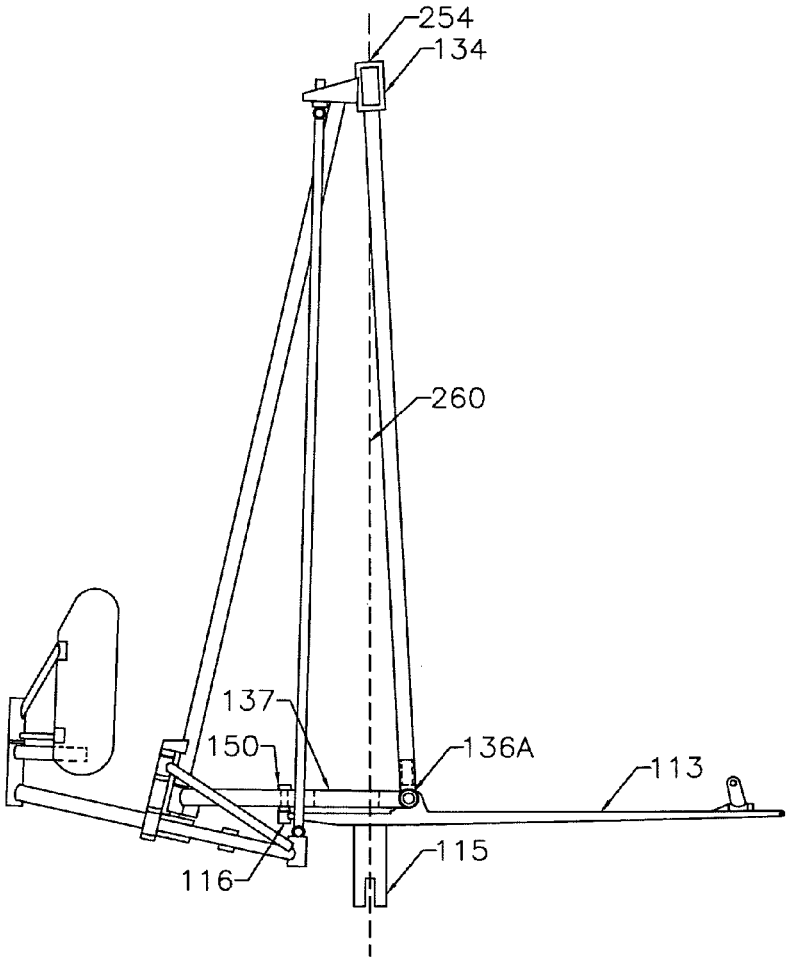
FIG. 17A us a side view of the top mast assembly attached to the boom base of the sailboat of the present invention of FIG. 1.
Figure 17B:
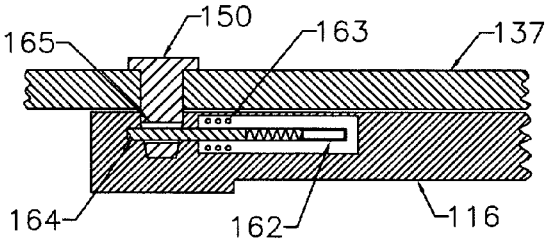
FIG. 17B is a detailed view of the top mast assembly pin lock mechanism, of the sailboat of the present invention of FIG. 1.

FIG. 17A illustrates a side view of the top mast assembly 261 and the top mast assembly base 137. In this illustration the top mast assembly 261 is attached by the boom base hinge 136, and the top mast assembly base lock pin 150 to the top mast base pin lock mechanism 116, on the boom base assembly 113. The top of the top mast assembly 261, includes the mast head receiver bearing socket 254, which is centered on the axis of rotation for the mast assembly 260, this axis is collinear with the cylindrical axis of the boom base shaft 115, of the sailboat of the present invention of FIG. 1.

Figure 17C:
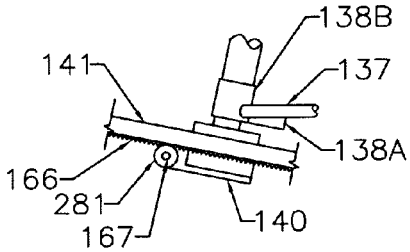
FIG. 17C is a detailed view of the rack and pinion that deploys the winglet support shaft of the sailboat of the present invention of FIG. 1.

FIG. 17C illustrates the details of the bearing housing 140, which holds the winglet support shaft 141 which can be moved in translation through the bearing housing 140 by means of a servo driven rack 166 and pinion 167 mechanisms 281, of the sailboat of the present invention of FIG. 1.

Figure 18A:
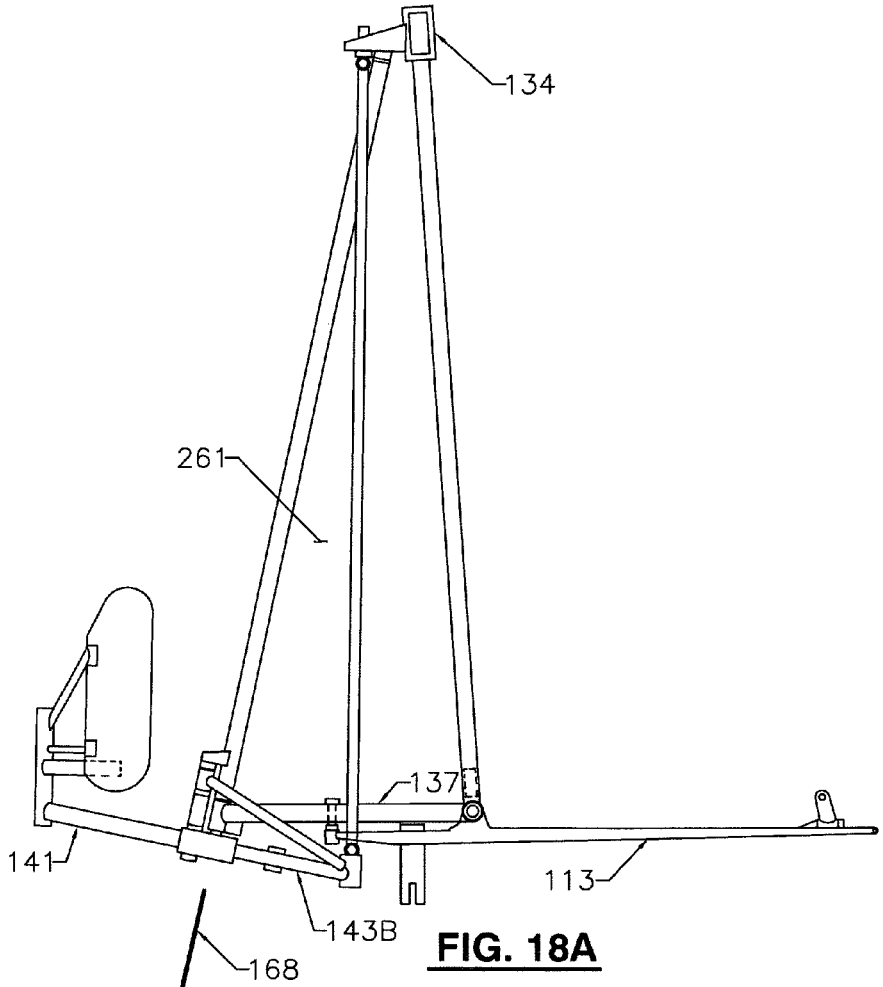
FIG. 18A is a side view of a mast assembly in folded configuration and the winglet support shaft extended, of the sailboat of the present invention of FIG. 1.

FIG. 18A illustrates the top mast assembly 261 fully deployed and fixed to the boom base assembly 113, while the winglet support shaft 141 is fully extended with the sail arms 143A (hidden) and 143B in their fully deployed configuration, of the sailboat of the present invention of FIG. 1.

Figure 18B:
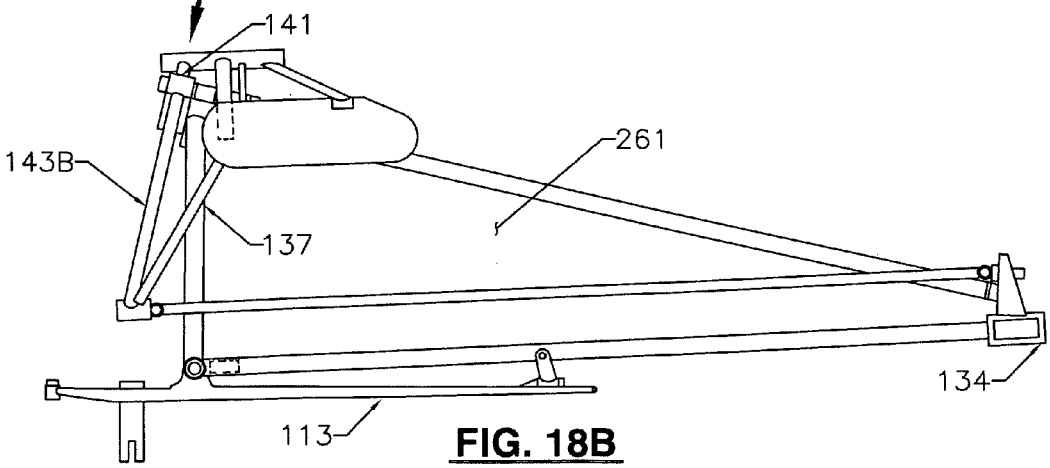
FIG. 18B is a side view of a mast assembly in folded configuration and the winglet support shaft in the pre deployed configuration, of the sailboat of the present invention of FIG. 1.
Figure 31:
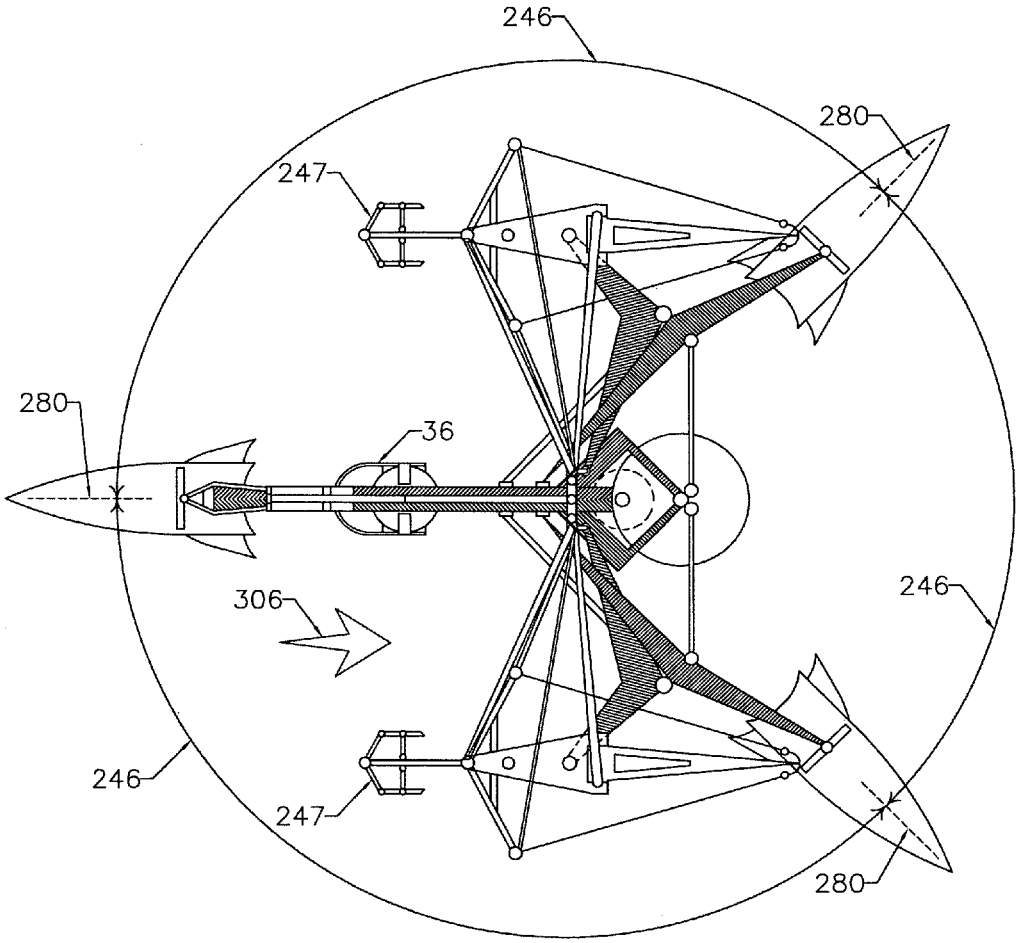
FIG. 31 is a top view of the sailboat of the present invention of FIG. 1, with sails furled and hulls in the star formation.

FIG. 18B illustrates one of the two identical (6A and 6B) top mast assemblies 261 folded down on top of the boom base assembly 113, while the winglet support shaft 141 is in the fully retracted configuration, relative to the fully deployed location, having been moved in the direction 168 while the mast support arms 6A and 6B, were in the fully deployed configuration (shown in FIG. 31). In FIG. 18B, the sail arms 143A (hidden) and 143B are in their fully folded configuration, in the angular position indicated by arrows 152, (as shown in FIG. 16C) against the top mast assembly 261, of the sailboat of the present invention of FIG. 1.

Figure 19A:
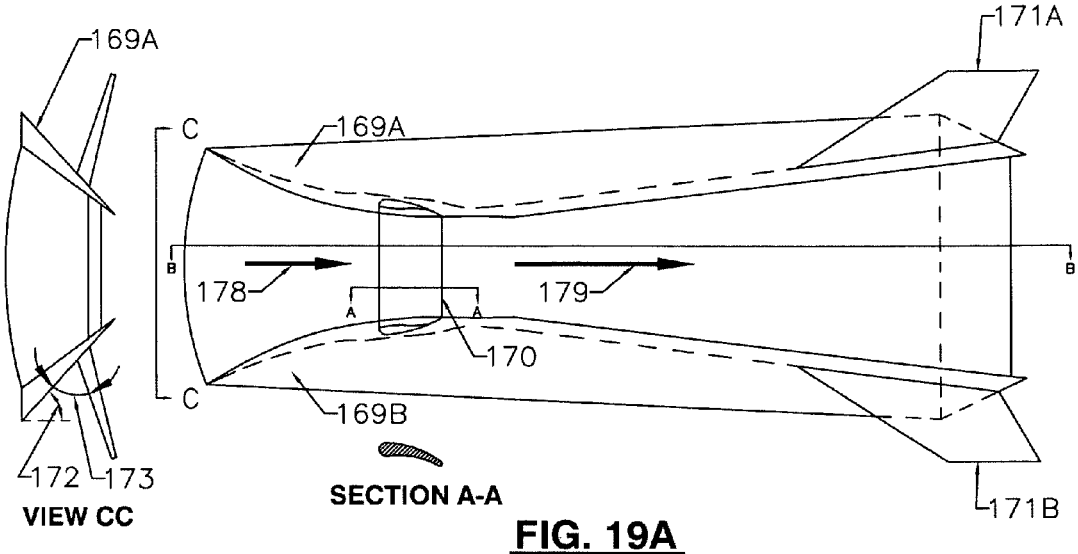
FIG. 19A is a bottom view of a hull of the sailboat of the present invention of FIG. 1.
Figure 19B:
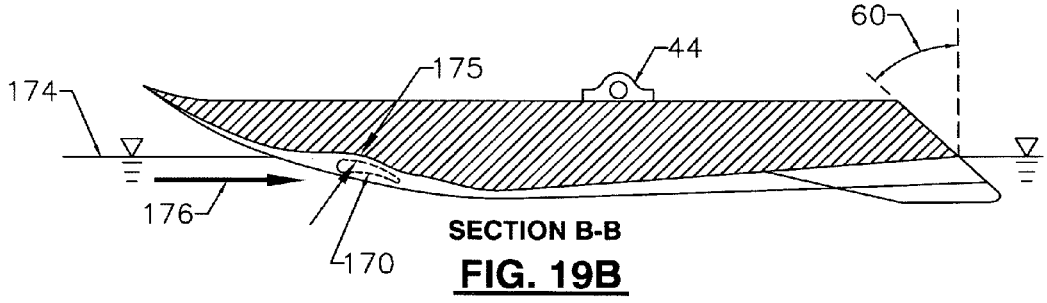
FIG. 19B is a sectional view, of a hull of the sailboat of the present invention of FIG. 1.
Figure 19C:
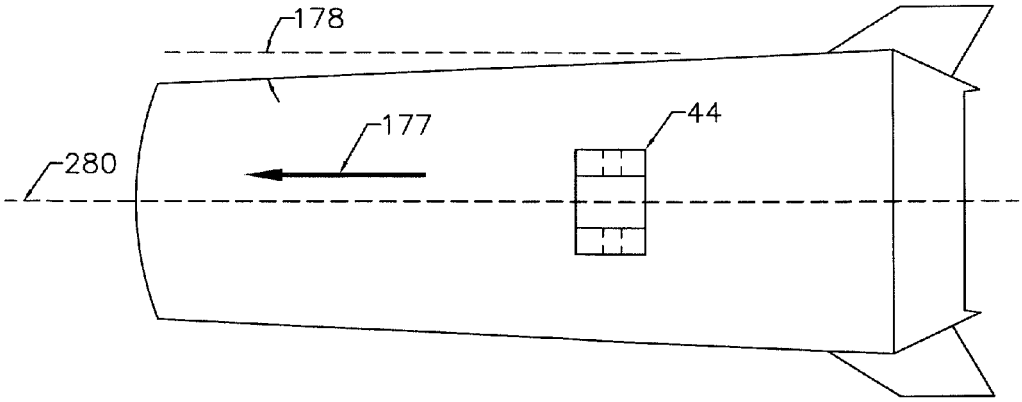
FIG. 19C is a top view of a hull of the sailboat of the present invention of FIG. 1.

FIGS. 19A, 19B, 19C illustrate a typical view of the bottom, the cross section and the top view, respectively, of the hulls 2A, 2B, 2C of the sailboat of the present invention of FIG. 1, each having a hull axis 280, in FIG. 19C, where a horizontal foil 170, having a cross-section shown in Section AA, is connected to the two flat side plates 169A and 169B which form the sides of the hull. This horizontal foil 170, is located so that its top surface is slightly below the water line leaving a channel for the water 175 through which the top layer of the water surface passes through when the typical hull 2A is moving over the water. This layer of water 178 is mixed with the air captured in the hull inlet 176, between the two side plates, the bow of the hull and the water surface, when the hull is moving in the forward direction 177. In the stern section of the hull are two fluke like fins 171A, and 171B, which make an angle 173 of approximately 60 degrees with the side plates 169A and 169B. These side plates 169A and 169B make an angle 172 of approximately 45 degrees with the vertical direction, when the hull 2A is at rest in the water. The water line 174 for the hull at rest in the water is shown in FIG. 19B. The side plates 169A and 169B are tapered inward toward the bow by an angle 178 of approximately 5 degrees. The water layer under the hull moves down stream of the horizontal foil in the direction 179, and the velocity decreases with increased flow area as the flow gets closer to the stern of the hull 2A. The angle of the hull stern 60 is required to make each hull dig into the water if it is pushed in a direction not collinear with the normal weathervane direction of motion 177. View CC shows the front view of the hull of the sailboat of the present invention of FIG. 1.

Figure 20A:
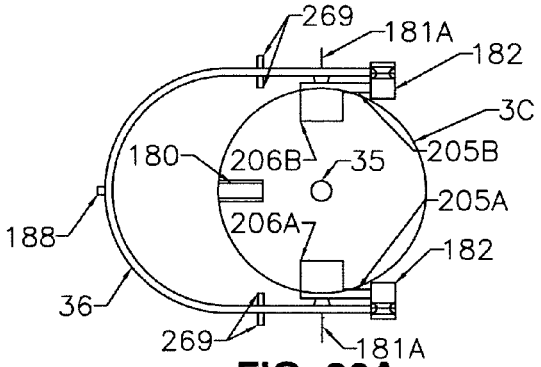
FIG. 20A is a top view of the rudder assembly with the rudder foil raised, of the sailboat of the present invention of FIG. 1.
Figure 20C:
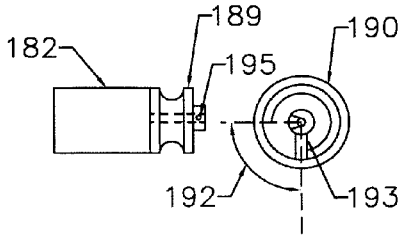
FIG. 20C are two views of the rudder foil elevation device, of the sailboat of the present invention of FIG. 1.
Figure 20B:
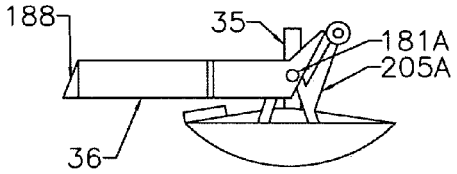
FIG. 20B is a side view of the rudder assembly with the rudder foil raised, of the sailboat of the present invention of FIG. 1.
Figure 20D:
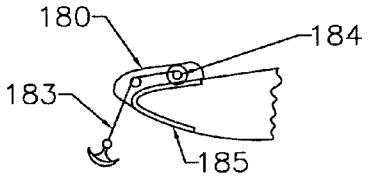
FIG. 20D is a side view of the anchor mechanism on the rudder hull of the sailboat of the present invention of FIG. 1.
Figure 20E:
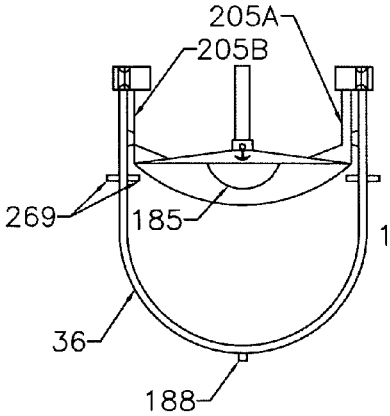
FIG. 20E is a front view of the rudder assembly with the rudder foil lowered, of the sailboat of the present invention of FIG. 1.
Figure 20F:
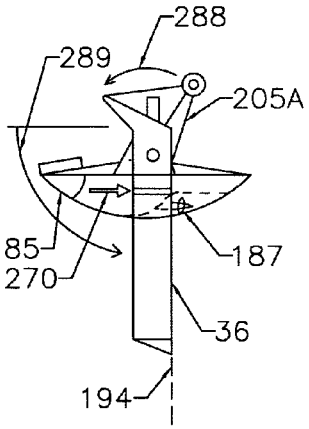
FIG. 20F is a side view of the rudder assembly with the rudder foil lowered, of the sailboat of the present invention of FIG. 1.
Figure 20G:
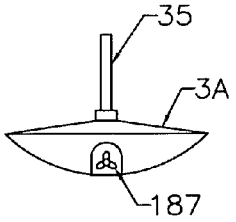
FIG. 20G is a stern view of the rudder assembly, showing the auxiliary propulsion propeller, of the sailboat of the present invention of FIG. 1.

FIGS. 20A, 20B, 20C, 20D, 20E, 20F, 20G are a set of diagrammatic representations of the components of the rudder hull assembly 3A, which is comprised of the rudder hull 3C, the rudder foil 36, anchor housing assembly 180, rudder foil hinge shafts 181A, semi ring wing foil retraction servos 182, semi ring wing retraction and deployment structure 205A and 205B, rudder hull vertical shaft 35, and where the anchor housing assembly incorporates the anchor 183, the anchor winch 184, and the hull anchor shield 185. The rudder assembly 3A also incorporates the auxiliary electric motor driven propulsion system 187, and the semi ring wing foil skid plate 188. FIG. 20A, illustrating a top view of the rudder hull assembly 3A with the rudder foil 36, in the retracted position, and FIG. 20B illustrating the side view of the rudder hull 3A assembly, with the semi ring wing foil 36 in the retracted position. FIG. 20C illustrates the semi ring wing foil retraction servo 182 with the detail of the retraction pulley 189 and the range of rotation 192 of the semi ring wing foil. The shaft with the tab 193 is shown with the semi ring wing foil 36 in the deployed position 194. The shaft 193 also has a shear pin 195, which connects the servo shaft to the retraction pulley 190 assemblies. FIG. 20D is an illustration of the bow of the rudder hull 3C, with a sectional view of anchor housing assembly 180, in which is found the anchor winch 184, the anchor 183, and the hull anchor shield 185. FIG. 20E illustrates the front view of the rudder hull 3C, with the semi ring wing foil 36 in the deployed position, with small plates 269 perpendicular to the foil 36 on either side of the foil, just below the horizontal shaft axis 181A, which are used to maintain the flow 270 perpendicular to the foil cross section while the sailboat of the present invention is underway. FIG. 20F illustrates the side view of the rudder hull 3C, with the semi ring wing foil 36 in the deployed configuration, with its trailing edge vertical 194, and also the location of the auxiliary electric propulsion motor and propeller 187. FIG. 20E illustrates the stern view of the rudder hull 3A just showing the location of the auxiliary electric motor driven propulsion system 187, relative to the rudder hull 3A of the sailboat of the present invention of FIG. 1.

FIGS. 21A, 21B, 21C, and 21D, are a set of diagrammatic representations of the components of the dagger board assembly 3B, with the respective views of the top of the rudder hull 3C assembly (with semi ring wing foil 37, retracted), the side view of the rudder hull 3B assembly (with rudder foil 37, retracted), the front view of the dagger board 3C assembly (with semi ring wing foil 37, deployed), and the side view of the dagger board 3C assembly with semi ring wing foil 37, deployed). Also shown in these figures is the dagger board vertical shaft 207 (which cannot rotate about its cylindrical axis 203) and the semi ring wing foil retraction and deployment structure 206A and 206B, and the retraction servos 182, where, 206A and 206B are identical to semi ring wing foil retraction and deployment structure 205A and 205B in FIG. 20A, and where 206A, 206B, and 182 components are identical to, and perform the same functions as these same components in FIG. 20A. Small plates 269 are located on the foil 37 as shown perpendicular to the foil 37 on either side, just below the horizontal shaft axis 181B to maintain the flow 270 perpendicular to the foil cross section while the sailboat of the present invention is under way, for the sailboat of the present invention of FIG. 1.

Figure 21A:
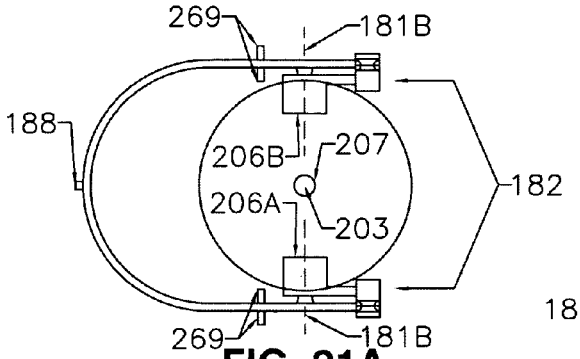
FIG. 21A is a top view of the dagger board assembly, with the dagger board foil raised, of the sailboat of the present invention of FIG. 1.
Figure 21B:
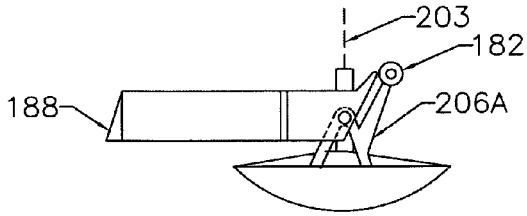
FIG. 21B is a side view of the dagger board assembly, with the dagger board foil raised, of the sailboat of the present invention of FIG. 1.
Figure 21C:
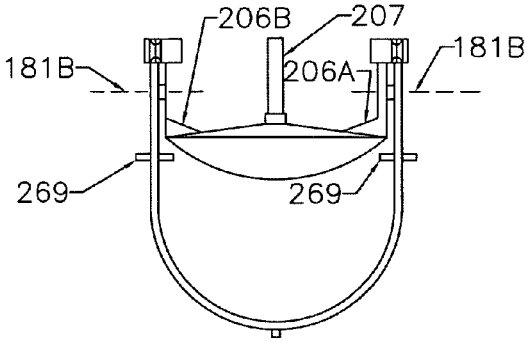
FIG. 21C is a front view of the dagger board assembly with the dagger board foil lowered, of the sailboat of the present invention of FIG. 1.
Figure 21D:
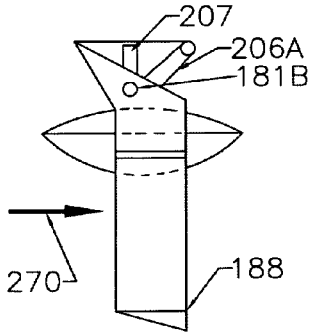
FIG. 21D is a side view of the dagger board assembly with the dagger board foil lowered, of the sailboat of the present invention of FIG. 1.
Figure 21E:
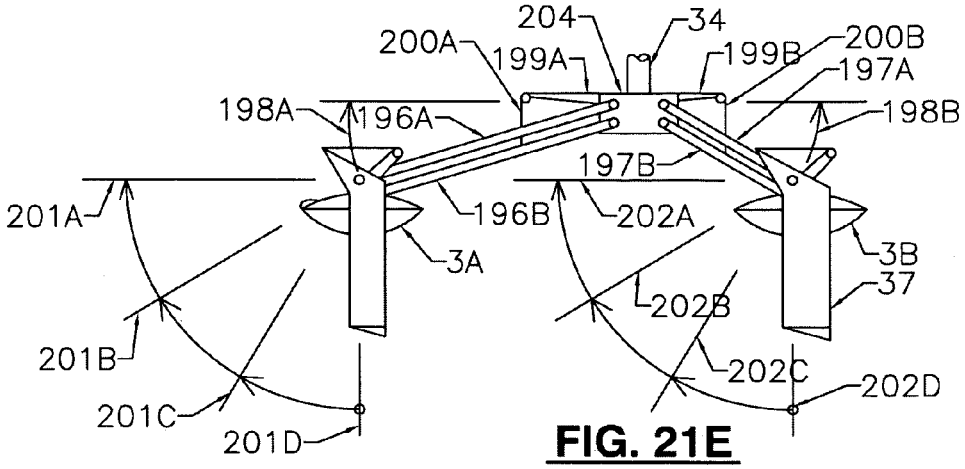
FIG. 21E is a side view of the rudder/dagger board assembly, of the sailboat of the present invention of FIG. 1.

FIG. 21E is a diagrammatic representation of a side view of the components of the rudder/dagger board assembly 7, where the rudder support articulation assembly 31, has an upper arm 196A, which can move through an angle 198A when the rudder assembly 3A is retracted into folded configuration, this is accomplished when the lower arm 196B which is connected to the lift cable 200A, is retracted by the rudder assembly rudder electric winch (not shown) that is incorporated into the rudder assembly lift arm 199A. The allowable motion of the rudder assembly semi ring wing foil 36 is shown by representative multiple locations 201A, 201B, 201C, and 201D. Similarly, the dagger board support articulation assembly 32, has an upper arm 197A, which can move through an angle 1986 when the dagger board assembly is retracted into folded configuration, this is accomplished when the lower arm 1976 which is connected to the lift cable 200B, is retracted by the dagger board assembly dagger board electric winch (not shown) that is incorporated into the dagger board assembly lift arm 199B. The upper and lower arms 196A, 196B; 197A, 197B, the rudder assembly lift arm 199A, and the dagger board assembly lift arm 1996, are all attached to the central shaft base 204. The allowable motion of the dagger board assembly semi ring wing foil 37 is shown by representative multiple locations 202A, 202B, 202C, and 202D, of the sailboat of the present invention of FIG. 1.

Figure 21F:
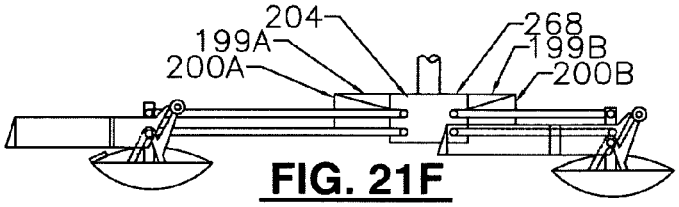
FIG. 21F is a side view of the rudder and dagger board assemblies draw up in their folded configuration, of the sailboat of the present invention of FIG. 1.

FIG. 21F is a diagrammatic representation of a side view of the components of the rudder/dagger board assembly 7, showing the pre-deployed (folded) configuration, when the rudder and dagger board assemblies (3A and 3B) are draw up into their folded configuration 268, and the foils 36 and 37 are in the retracted position to minimize the draft of these components for beaching or for launching from a trailer, for the sailboat of the present invention of FIG. 1.

Figure 22A:
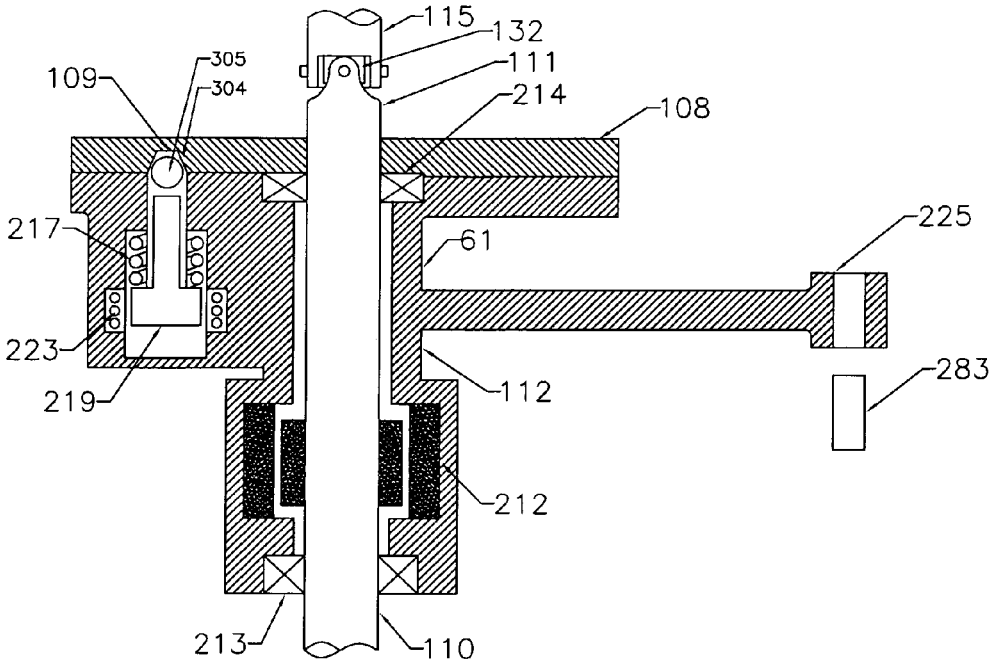
FIG. 22A is a sectional view of the boom base lock pin mechanism, of the sailboat of the present invention of FIG. 1.

FIG. 22A is a diagrammatic representation of a side view of the components of the boom base shaft rotation lock 112, of the lock mechanism 61, where 115 is the boom base shaft with the attached top section of the universal joint 132. This section mates with the lower section of the universal joint 111, which is fixed to the shaft 110. This shaft in turn is fixed to the disc 108, whose bottom surface has a cylindrical hole 109 which partially penetrates its thickness. This cylindrical hole 109 receives the metal ball 305, which is used to couple or decouple the disc 108 from the rotation of the boom base shaft rotation lock 112. The metal ball 305 is raised into the cylindrical hole 109 by the solenoid mechanism integrated into this boom base shaft rotation lock 112, where the ferromagnetic plunger 219 is held down by a spring 217 in the nominal configuration, and then raised, as shown in this figure, by the activation of the electric coil 223. There are a number of locations in where a solenoid based locking mechanisms are described herein. This locking function can be carried out by alternate electro-mechanical or other means, and the use of the solenoid base mechanisms is used herein as an example of one type of locking mechanism in this functional description. The boom base shaft rotation lock 112 rides on two sets of bearings 213 and 214 on the shaft 110. The lock mechanism 61 is normally disengaged by the spring hold down 217 and only when the solenoid coil 223 is energized by the helmsperson does the mechanism engage and control the rotation of the boom base assembly 113 to maintain it parallel to the central structural element axis 252. This solenoid coil function can be carried out by alternate electro-mechanical or other means, and the use of the solenoid base mechanisms is used herein as an example of one type of locking mechanism in this functional description. Another component of the lock mechanism 61 is the electrically driven boom base shaft rotation damping mechanism 212, which can be activated by the helmsperson, to provide either an adjustable amount resistance of resistance to boom base shaft rotation relative to the mast assembly support arm 6A (or 6B), or enough torque to rotate the mast assembly 4B (or 4C) as required (when the sails are furled), when the folding process for the mast assemblies 4B and 4C is to be implemented. This capability may be required in order to assure the rotation of the mast assembly 4B and or 4C so as to get the solenoid plunger 219 on the mast deployment mechanism 61 engaged, as shown in this figure. This solenoid coil function can be carried out by alternate electro-mechanical or other means, and the use of the solenoid base mechanisms is used herein as an example of one type of locking mechanism in this functional description. The partial hole 109 has walls that are slightly cone shaped 304, as shown, in order to assure that the metal ball 305 is forced to drop when the solenoid is deactivated, causing the ferromagnetic plunger 219 to descend due to the spring 217 load, for the sailboat of the present invention of FIG. 1.

Figure 22B:
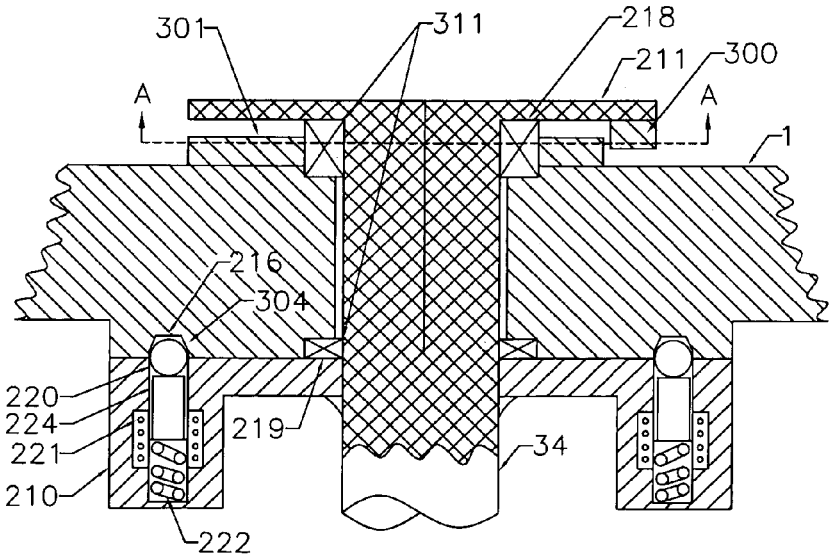
FIG. 22B is a section view of the details of central shaft bearing, of the sailboat of the present invention of FIG. 1.

FIG. 22B is a diagrammatic representation of a side view of the components of the central shaft 34 rotation constraint mechanism 210, this mechanism is the connection means between the central structural element 1, and the rudder/dagger board assembly central shaft 34. A sectional view of the central structural element 1 is shown in this figure. The central shaft 34 passes through the central structural element 1 as shown and is held in place by the central shaft bearing set 311, which incorporates ball bearings 218 and 219. A helmsperson's chair base 211 is fastened to the top of the central shaft 34. The rotation constraint mechanism 210 incorporates twelve solenoid mechanisms' located at equal spacing around the circumference of the helmsperson's chair base disc 211. One of these solenoids is shown in the detail of a typical solenoid mechanism 210. These twelve solenoids are used to normally couple (automatically due to spring 222 load on the ferromagnetic plungers 224 (typical) or simultaneously decouple (pushed down to compress the spring 222), when the solenoids coils 221 are energized by the helmsperson. The coupling or decoupling of the central shaft 34 to the central structural element 1 is accomplished by means of the twelve metal balls, shown as 220 associated with each solenoid in the solenoid mechanisms 210. The partial hole 216 has walls that are slightly cone shaped 304, as shown, in order to assure that the metal ball 220 is forced to drop when the solenoid is activated, and the ferromagnetic plunger 224 descends. This solenoid coil function can be carried out by alternate electro-mechanical or other means, and the use of the solenoid base mechanisms is used herein as an example of one type of locking mechanism in this functional description. On top of the central structural element 1 deck area, there is fixed a stop ring 301 (shown in more detail in sectional view AA in FIG. 22C), this is used to prevent the rotation of the rudder/dagger board assembly 7 more than plus or minus 90 degrees (302, 303) from the nominal orientation shown in FIG. 1. This rotation stop action is accomplished when the stop pin 300 (which is fixed to the helmsperson's chair base disc 211) comes to rest again the stop ring 301 as also shown in FIG. 22C, of the sailboat of the present invention of FIG. 1.

Figure 22C:
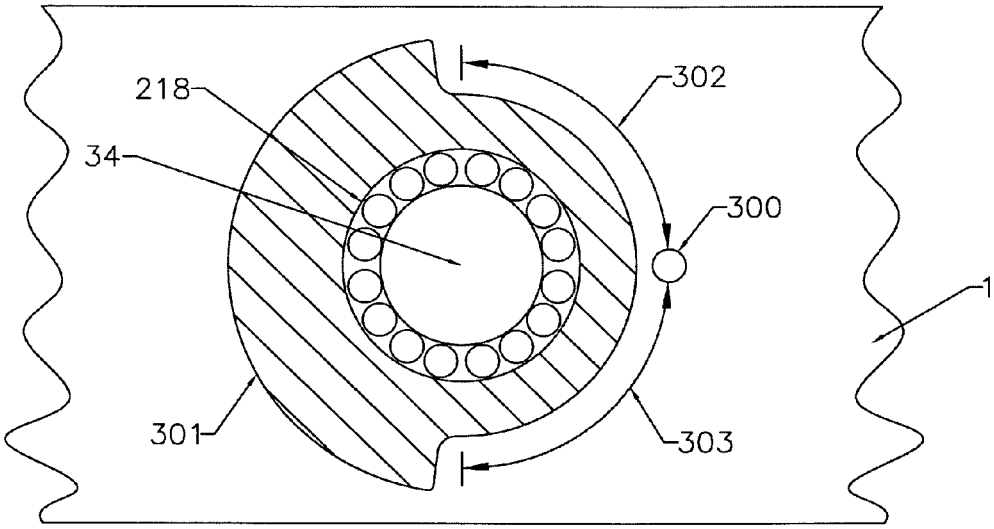
FIG. 22C is a top view of the details of stop ring and stop pin, of the sailboat of the present invention of FIG. 1.

FIG. 22C is a diagrammatic representation of a top view of the sectional view AA (in FIG. 22B) of the stop ring 301, which is fixed to the top of the central structural element 1, which surrounds the central shaft 34. Also shown is the stop pin 300 which is fixed to the helmsperson's chair base disc 211, which is fixed to the central shaft 34. The rotation of the central shaft 34 is limited by the stop pin 300, and the stop ring 301, to +/−90 degrees away (302, 303) from the nominal position of the rudder/dagger board assembly 7, which is fixed through the central shaft 34 to the helmsperson's chair base disc 211, of the sailboat of the present invention of FIG. 1.

Figure 23A:
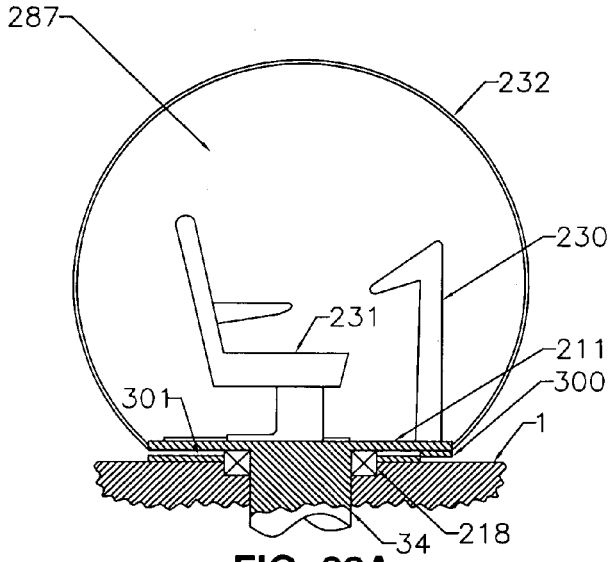
FIG. 23A is a top view of the helmsperson's chair, control panel and weather shield, of the sailboat of the present invention of FIG. 1.
Figure 23B:
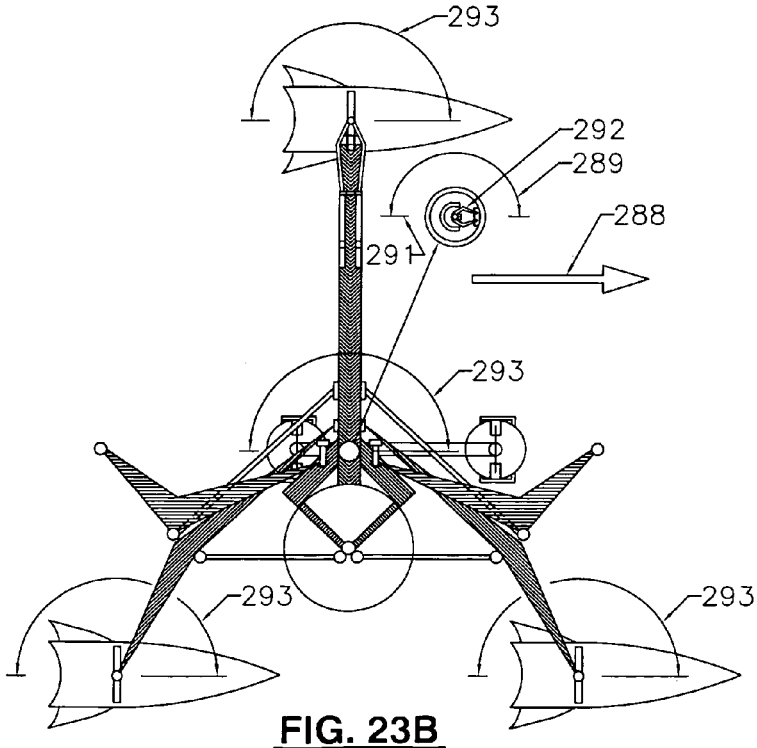
FIG. 23B Is a section view of the sailboat of the present invention deck and the visibility range for the helmsperson, of the sailboat of the present invention of FIG. 1.

FIG. 23A is a diagrammatic representation of a side view of the components of the helmsperson's chair assembly 287, which is comprised of the helmsperson's chair 231 with associated nearby components; control console 230, weather shield 232, and the helmsperson's chair base disc 211 attached to the central shaft 34. The helmsperson's chair 231 is fixed to the helmsperson's chair base disc 211, which in turn is fixed to the central shaft 34, all of which insures that the helmsperson's chair 231, the helmsperson, and the control console 230 always face the direction in which the sailboat of the present invention of FIG. 1 is moving. Beneath the helmsperson's chair base disc 211 is located the stop pin 300, which limits the rotation of the central structural element 7 as well as the helmsperson's chair 231, and the control console 230, by means of the stop ring 301 fixed to the top of the central structural element 1, of the sailboat of the present invention of FIG. 1:

FIG. 23B is a diagrammatic representation of a top view of the sailboat of the present invention of FIG. 1, showing the angular range of visibility for the helmsperson 289, while seated in the helmsperson's chair 231, which is shown with the helmsperson 292 facing the direction of travel of the sailboat of the present invention 288, which is governed by the rudder/dagger board assembly 7 orientation and rotation limits. The range of rotation 289 of the disc 221, and the helmsperson's chair 231, and the control console 230 is limited by the stop ring 301 fixed to the central structural element 1, and the stop pin 300 fixed to the helmsperson's chair base disc 211, which is directly related to the rotation 293 of the rudder/dagger board assembly 7. Also shown are the corresponding rotations 293 of the hulls (2A, 2B, and 2C), which although capable of weather vane motion in any direction, typically line up approximately parallel to the direction of motion dictated by the rudder and dagger board assembly 7 orientation, whose range is shown by 293 in here, for the sailboat of the present invention in FIG. 1.

Figure 24:
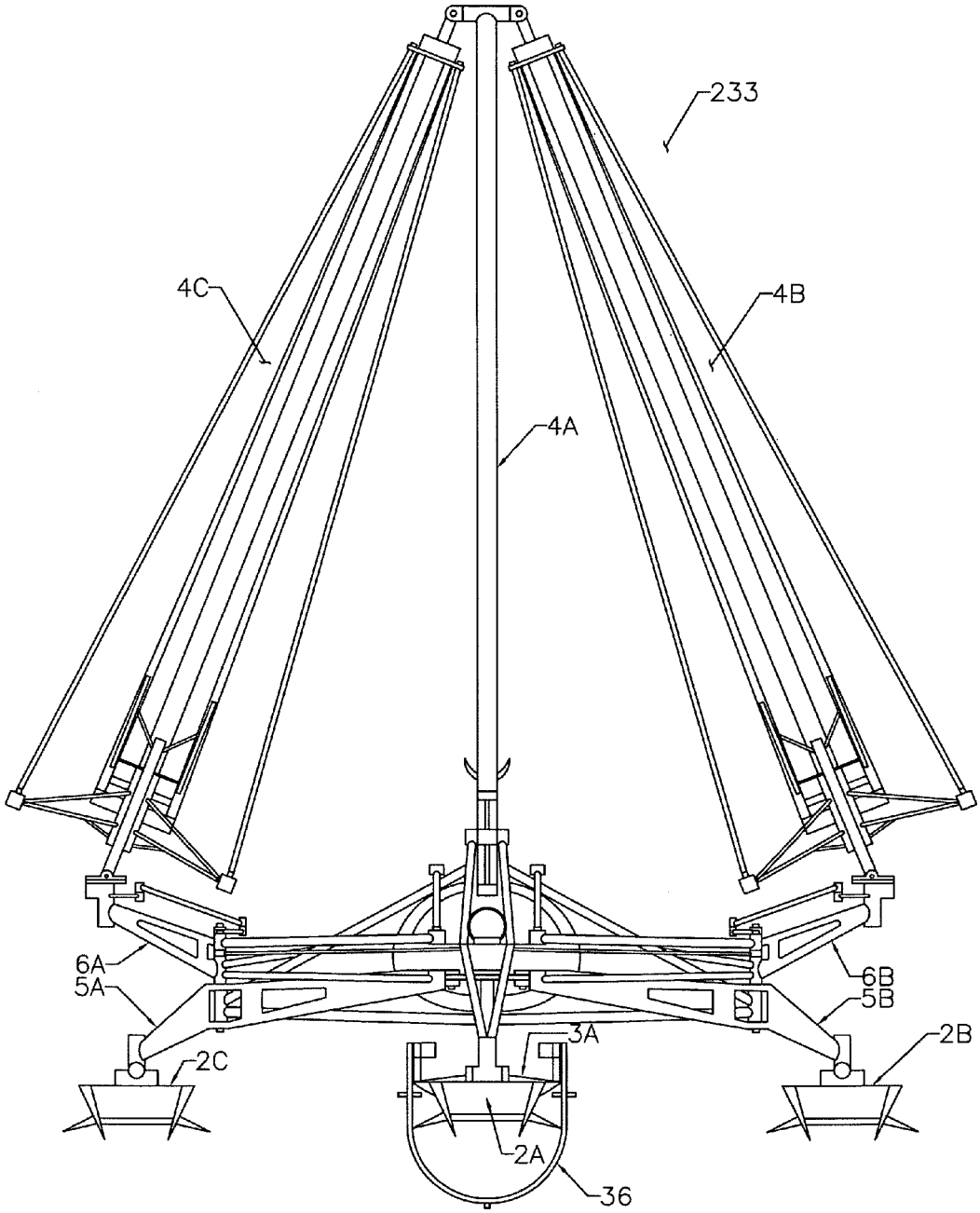
FIG. 24 is a front view of the sailboat of the present invention with sails furled, of the sailboat of the present invention of FIG. 1.

FIG. 24 is a diagrammatic representation of the front view of the complete and fully deployed sailboat of the present invention in FIG. 1. The central structural element 1, the fore spar 4A, the mast assemblies 4B, and 4C, and, the starboard hull support arm 5 A and the port hull support arm 5 B, when fully deployed, are defined as the space frame of the sailboat of the present invention of FIG. 1. FIG. 24 also shows a diagrammatic representation of additional components of the sailboat of the present invention including the hulls, 2A, 2B, 2C, and rudder/dagger board assembly 7 (partially hidden), and the rudder foil 36 on the rudder assembly 3A. The dagger board assembly 3B and dagger board foil 37 are hidden by the rudder assembly 3A, and the rudder foil 36 and are not shown here. The entire sailboat of the present invention is shown in the fully deployed configuration 233, of FIG. 1.

Figures 25A, 25B, 25C:
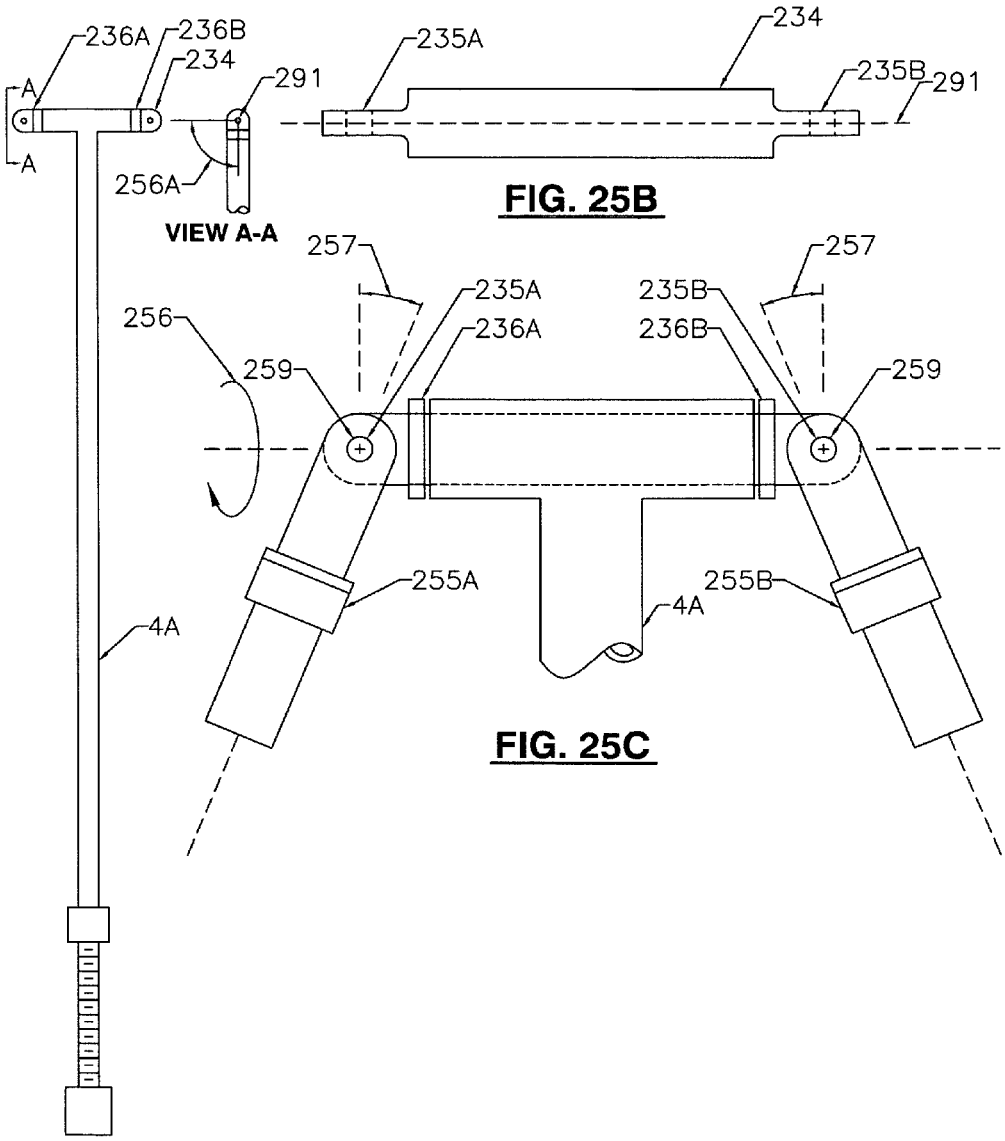
FIG. 25A is a front view of the fore spar, of the sailboat of the present invention of FIG. 1.
FIG. 25B is a top view of the shaft at the top of the fore spar, of the sailboat of the present invention of FIG. 1.
FIG. 25C is a detailed view, of the top of the fore spar and the attachments to the two mast assemblies of the sailboat of the present invention of FIG. 1.

FIGS. 25A, B, and C, are a diagrammatic representations of the fore spar 4A, where FIG. 25A shows a front view of the fore spar, FIG. 25B shows a shaft 234 passing through the top of the fore spar 4A, which is pinned to the two mast assemblies (not shown), through cylindrical holes 235 A and 235 B. FIG. 25C shows a sectional view through the top of the fore spar 4A where the shaft 234 is housed and free to rotate about the shaft cylindrical axis 291, within the housing in direction 256, when the effective length of the fore spar 4A is changed during the deployment process for the space frame, or during adjustments while sailing, see View AA. The shaft 234 is fixed to remain within the housing and is centered by the two lock rings 236A and 236B. FIG. 25C illustrates the mast head receiver bearings 255A and 255B on either side of the shaft 234, Each of these bearings 255A and 255B incorporate ball bearings to allow free rotation of the associated mast assembly (4B or 4C) attached to them through the corresponding respective mast head receiver socket 254, these bearings are free to pivot through the angle 257, during the deployment of the mast assemblies, about the pins 259, passing through the cylindrical holes 235A and 235B, of the sailboat of the present invention of FIG. 1.

Figure 26A:
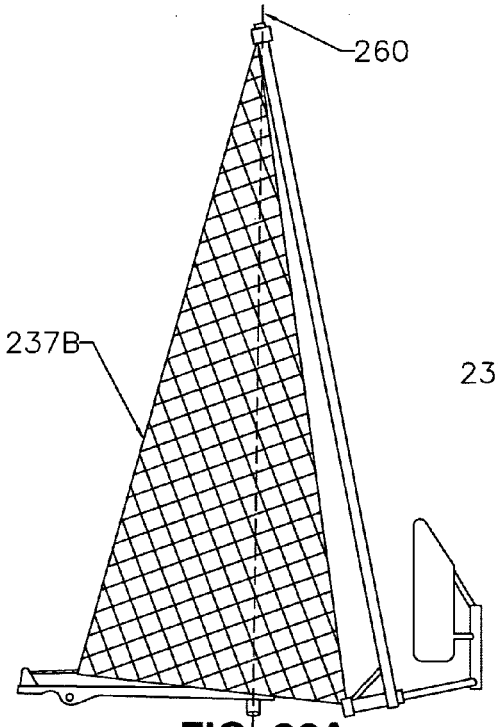
FIG. 26A is a side view of a mast assembly with the sails unfurled, of the sailboat of the present invention of FIG. 1.
Figure 26B:
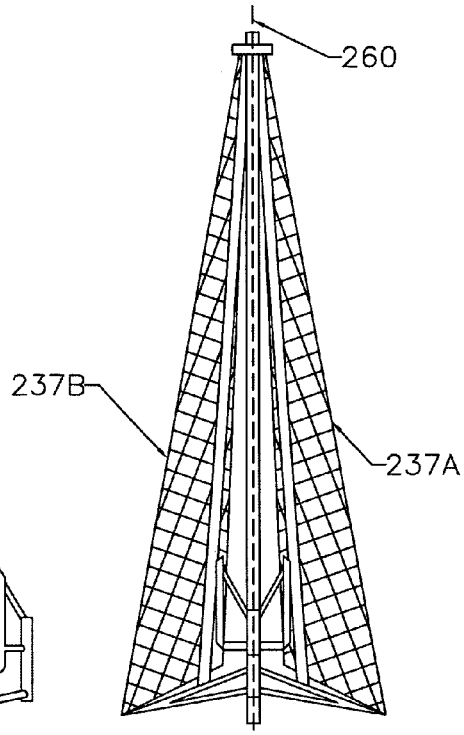
FIG. 26B is a front view of a mast assembly with the sails unfurled, of the sailboat of the present invention of FIG. 1.
Figure 26C:
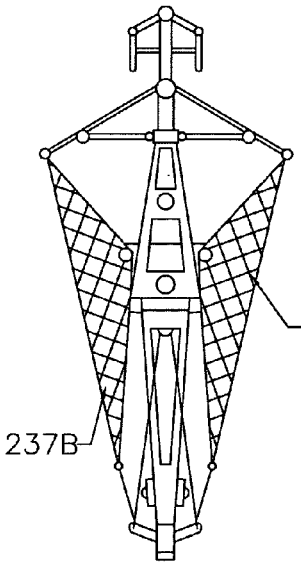
FIG. 26C is a bottom view of the mast assembly with the sails arms in a weather vane orientation, of the sailboat of the present invention of FIG. 1.
Figure 26D:
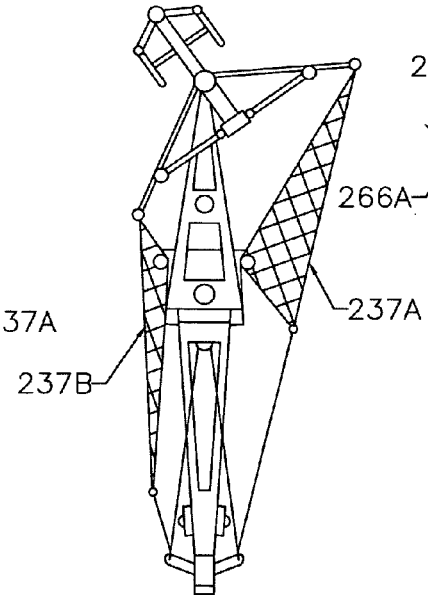
FIG. 26D is a bottom view of the mast assembly with the sails unfurled, and the twin sail shaft rotated to one extreme position, of the sailboat of the present invention of FIG. 1.
Figure 26E:
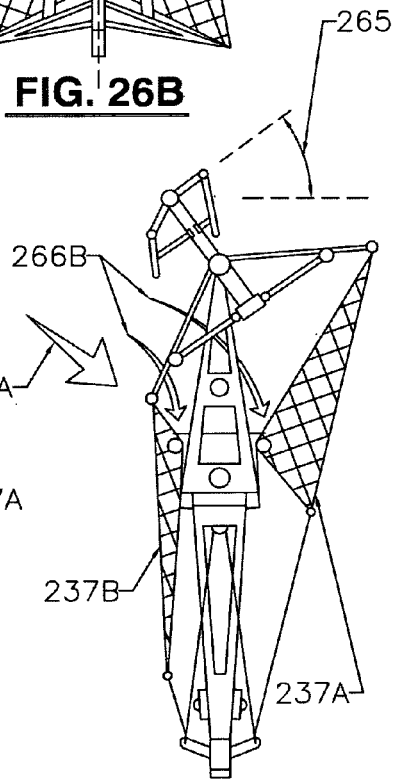
FIG. 26E is a bottom view of the mast assembly with the sails unfurled, and the twin sail shaft, and winglet shaft rotated to one of their extreme positions, of the sailboat of the present invention of FIG. 1.

FIGS. 26A, 26B, 26C, 26D, and 26E are diagrammatic representations of the top mast assembly 261, (4B and 4C) where FIG. 26A illustrates a side view of the top mast assembly 261 with sails deployed, and FIG. 26B illustrates a front view of the top mast assemblies 261, with sails deployed, and FIG. 26C illustrates a bottom view of the top mast assemblies 261 in the nominal weather vane configuration. FIG. 26D illustrates the twin sail pivot shaft 139 rotated to one extreme of its travel, while the canard winglets 159A and 159B still remain in the nominal configuration, and finally FIG. 26E illustrates a bottom view of the deployed top mast assembly, with both the twin sail pivot shaft 139 rotated to one extreme of its rotational range 265, and the winglet cylinder 160 rotated by the winglet rotation lock mechanism 149 to one extreme of its rotational range 265, with this configuration generating thrust from the apparent wind 266A, and showing the wind flow through the sails 266B for the sailboat of the present invention of FIG. 1.

Figure 27A:
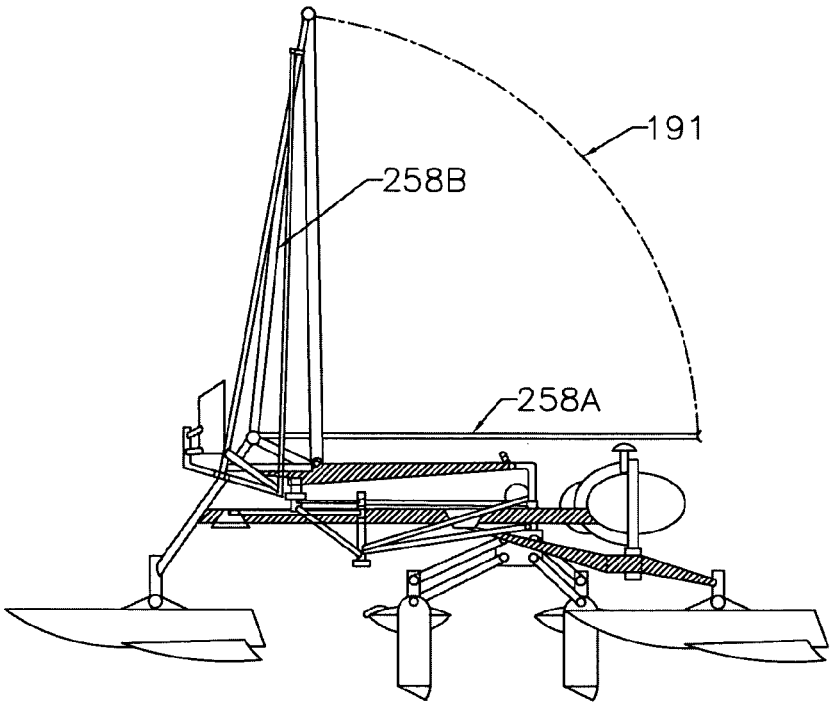
FIG. 27A is a side view of the of the sailboat of the present invention of FIG. 1, before the sail support arms are extended.
Figure 27B:
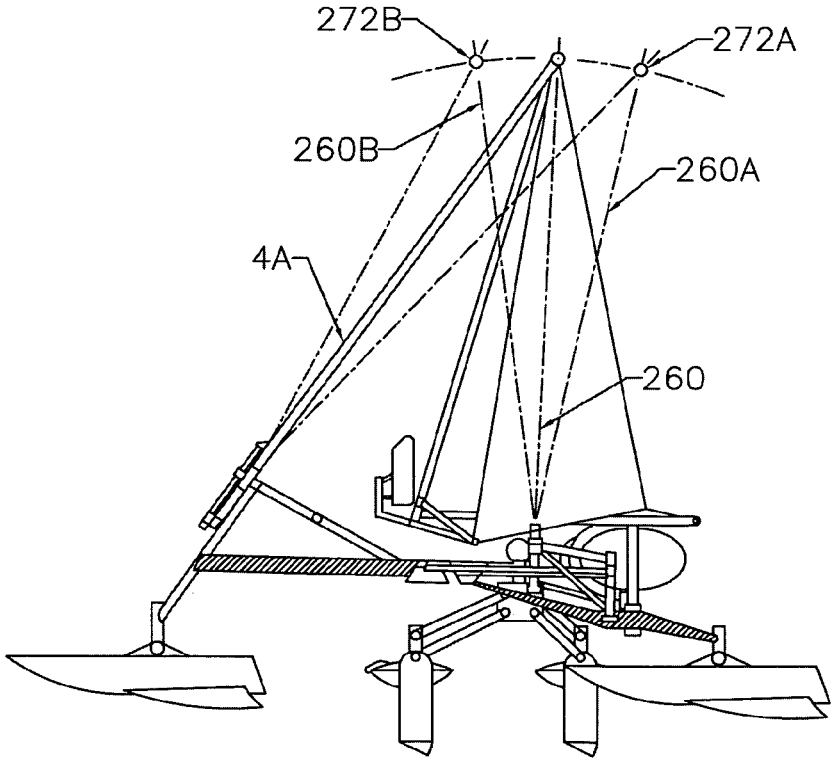
FIG. 27B is a side view of the sailboat of the present invention of FIG. 1. With the sail arms and sails in the fully deployed configuration of the sailboat of the present invention of FIG. 1.

FIGS. 27A, and 27B, are diagrammatic representations of the side view of the sailboat of the present invention of FIG. 1, where the initially pre-deployed position 258A of the fore spar 4A is shown, before the effective length of fore spar 4A is shortened for the deployment (elevation) of the mast assemblies 4B and 4C. During deployment of the fore spar 4A, the effective length of fore spar 4A is reduced by activation of the fore spar screw mechanism 25 and servo 26B (as shown in FIG. 4). Electrically driven screw mechanisms are used for linear motion these components, alternatively, the required translation motion at this location could also be accomplished by hydraulic or other means. This in turn causes the fore spar 4A to move up in the direction 191 and pull up the mast assemblies 4B and 4C into the deployed position until the fore spar 4A reaches the final deployed position 258B. FIG. 27A also shows the pre-deployed position of the mast assemblies 4B and 4C before the mast support arms 6A and 6B are deployed, and FIG. 27B, shows the same side view of the sailboat of the present invention of FIG. 1, where the mast support arms 6A and 6B are in the fully deployed configuration, and the twin sails 237A, and 237B (not shown) are in the fully deployed configuration. FIG. 27B further illustrates the effect of changing the effective length of the fore spar 4A on the position of the top of the fore spar 4A, which can move forward to position 272B, or backward, relative to the nominal location, to position 272A. This change in the effective length of the fore spar 4A changes the angle in the fore and aft direction), which the axis of rotation 260 of each of the mass assembly 4B and 4C makes with the base deck plane 63, of the sailboat of the present invention of FIG. 1.

Figure 28A:
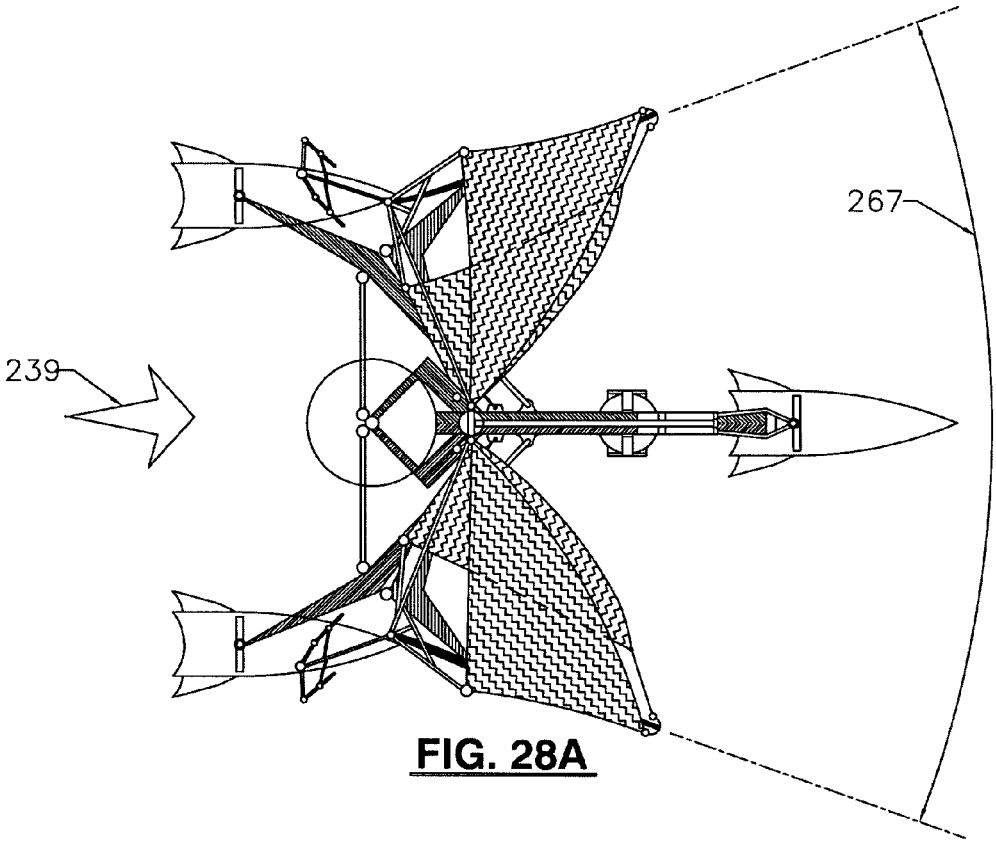
FIG. 28A is a top view of the sailboat of the present invention of FIG. 1 on a broad reach in an Atlantic Proa configuration sailing.

FIG. 28A is a diagrammatic representations of the top view of the sailboat of the present invention of FIG. 1 shown sailing directly downwind 239, with mast assembly 4B and 4C sail sets arranged to balance each other, with the wind direction and the sailing direction being identical 239, of the sailboat of the present invention of FIG. 1.

Figure 28B:
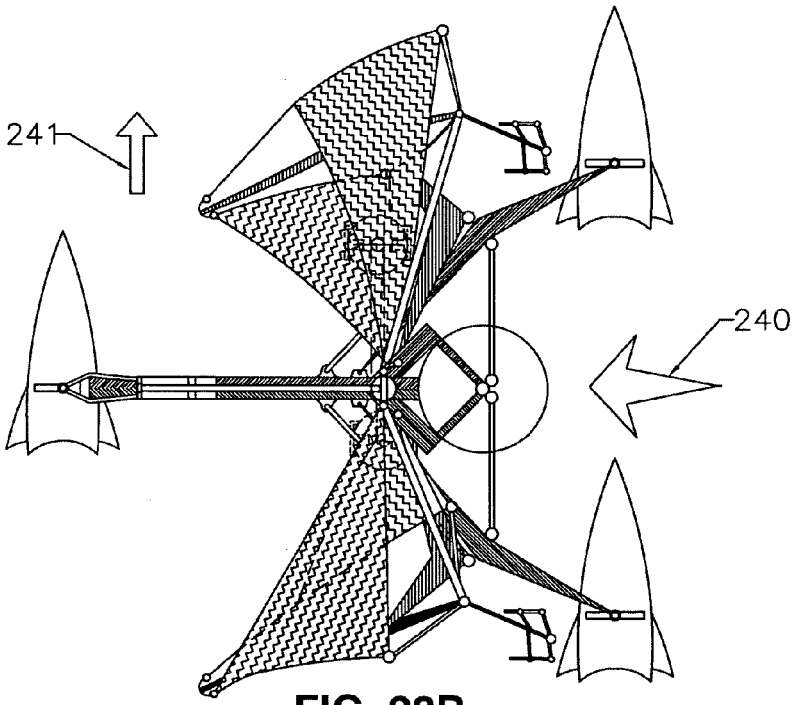
FIG. 28B is a top view of the sailboat of FIG. 1 sailing in an Atlantic Proa configuration.

FIG. 28B is a diagrammatic representation of the top view of the sailboat of the present invention of FIG. 1 sailing in the Atlantic Proa configuration, with the wind direction 240 and the direction of motion 241, of the sailboat of the present invention of FIG. 1.

Figure 29:
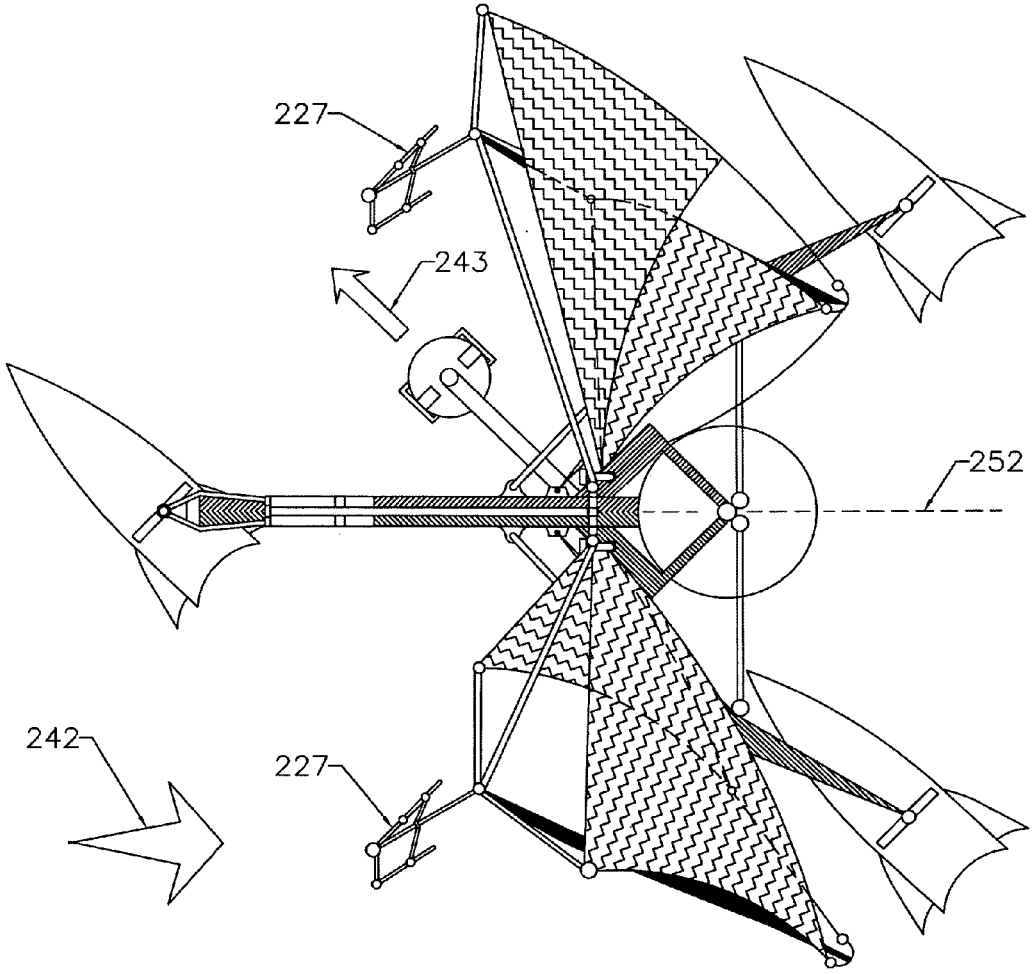
FIG. 29 is top view of the sailboat of the present invention of FIG. 1 sailing on a broad reach, in a Pacific Proa configuration.

FIG. 29 is a diagrammatic representation of the top view of the sailboat of the present invention of FIG. 1, close hauled, on a port tack with the wind direction 242 and the direction of motion 243, and the central structural element axis 252 parallel to the direction of the apparent wind 242 flow, where the angular orientation 227 of the canard winglets 159A and 159B are used to assure the correct angle of the sail sets relative to the apparent wind 242, of the sailboat of the present invention of FIG. 1.

Figure 30A:
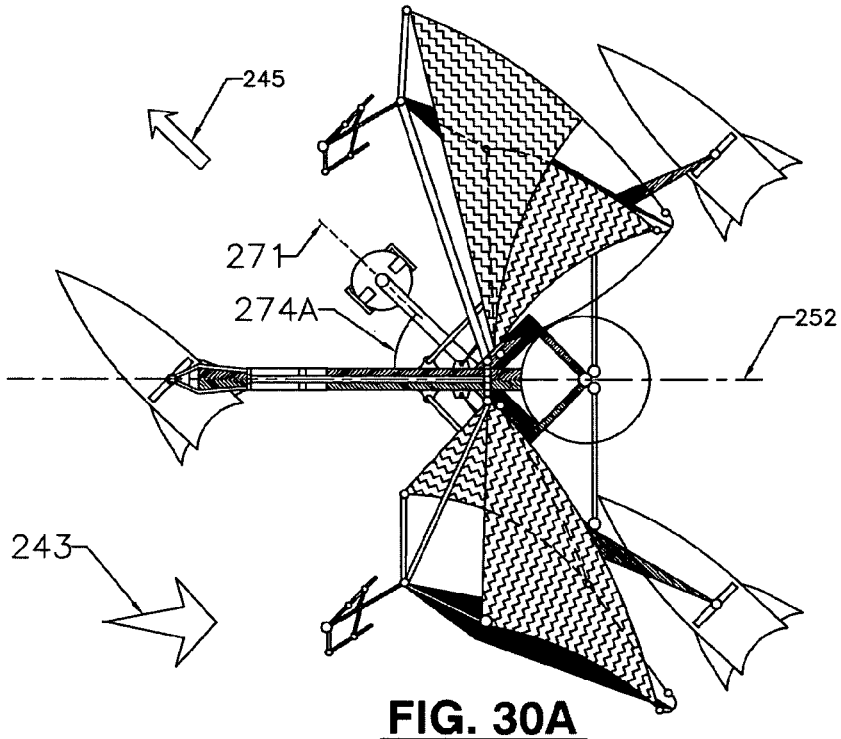
FIG. 30A is a top view of the sailboat of the present invention of FIG. 1, closely hauled on a port tack.

FIG. 30A is a diagrammatic representations of the top view of the sailboat of the present invention of FIG. 1 on a port tack, where the wind direction is 243 and the direction of motion is 245, which is aligned with orientation of rudder and dagger board horizontal center line 271 which is making an angle of 274A with the central structural element axis 252 of the sailboat of the present invention of FIG. 1.

Figure 30B:
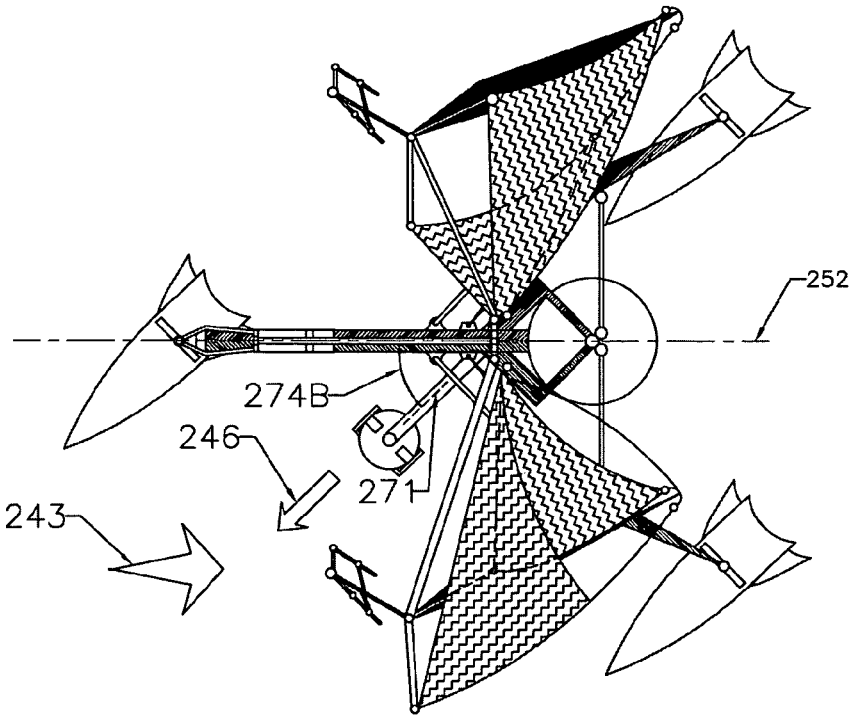
FIG. 30B is a top view of the sailboat of the present invention of FIG. 1; closely hauled on a starboard tack.

FIG. 30B a diagrammatic representations of the top view of the sailboat of the present invention of FIG. 1 on a starboard tack, with wind direction 243, and the direction of motion is 246, which is aligned with orientation of rudder and dagger board horizontal center line 271, which is making an angle of 274B with the central structural element axis 252 of the sailboat of the present invention of FIG. 1.

Figure 30C:
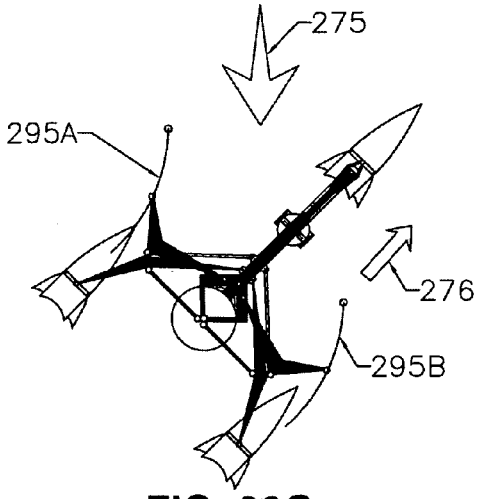
FIG. 30C is a top view of the sailboat of the present invention of FIG. 1; in the Pacific Proa configuration closely hauled on a starboard tack, in the nominal configuration of the space frame.

FIG. 30C is diagrammatic representation of the top view of the sailboat of the present invention of FIG. 1, showing the sailboat of the present invention in the nominal configuration on a port tack, with the wind direction 275, the mast assemblies 4B and 4C (simplified for clarity purposes) whose sails are in the 295A and 295B orientation shown, where the presence of the sails 295A effect the downwind efficiency of the sails 2958, while the sailboat of the present invention s travels in the direction 276.

Figure 30F:
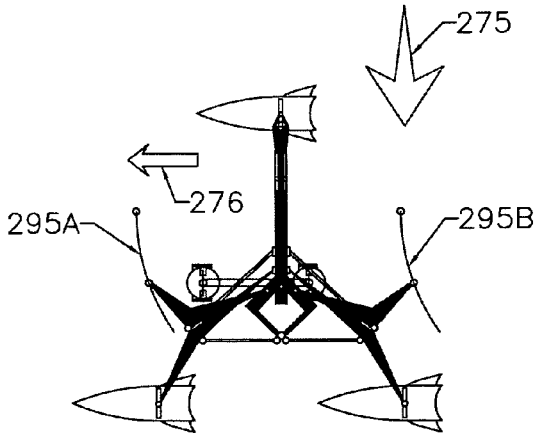
FIG. 30F is a top view of the sailboat of the present invention of FIG. 1 in a Pacific Proa configuration on a beam reach sailing in a westerly direction.
Figure 30D:
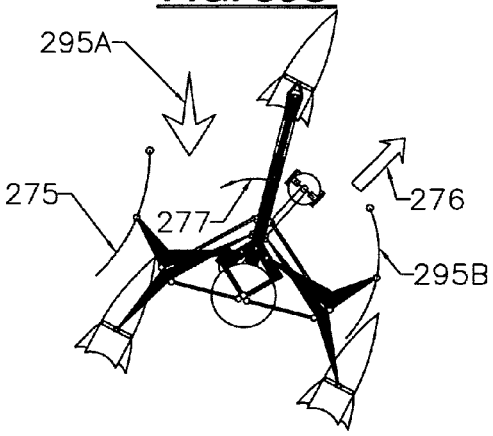
FIG. 30D is a top view of the sailboat of the present invention of FIG. 1 in the Pacific Proa configuration closely hauled on a starboard tack, with the port mast assembly used to generate a space frame rotation in the counter clockwise sense relative to the rudder and dagger board horizontal axis orientation.

FIG. 30D is diagrammatic representation of the top view of the sailboat of the present invention of FIG. 1, showing the sailboat of the present invention the space frame away rotating away 277 from the nominal configuration in FIG. 30C, while on a port tack, with the wind direction 275. The mast assemblies 4B and 4C (simplified for clarity purposes) whose mast assembly 4B sails are in the position 295A rotated away from their initial orientation shown in FIG. 30C, so as to be generating a larger torque on the space frame relative than the sails 295B which are maintaining their original orientation as shown in FIG. 30C, while the sailboat of the present invention continues to travels in the direction 276.

Figure 30G:
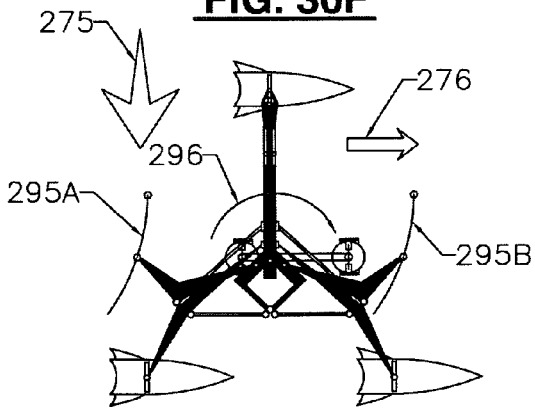
FIG. 30G is a top view of the sailboat of the present invention of FIG. 1, in a Pacific Proa configuration on a beam reach after reversing direction and now sailing in an eastward direction.
Figure 30E:
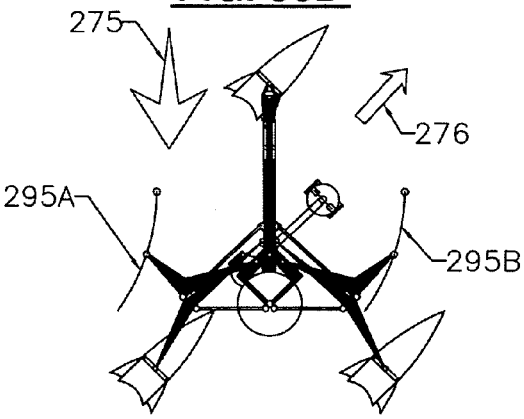
FIG. 30E is a top view of the sailboat of the present invention of FIG. 1; closely hauled on a starboard tack, with the space frame in the Pacific Proa configuration.

FIG. 30E is diagrammatic representation of the top view of the sailboat of the present invention of FIG. 1, showing the sailboat of the present invention at the completion of its rotation of the space frame away from the original configuration in FIG. 30C, while still on the initial port tack shown in FIGS. 30C and 30D, with the wind direction 275, the mast assemblies 4B and 4C (simplified for clarity purposes) whose sails 295A and 295B are in identical orientations, and now both mast assemblies 4B and 4C can both see equivalent and clean apparent wind, while the orientation of the rudder and dagger board assembly 7, maintains its original orientation as shown in FIGS. 30C and 30D, while the sailboat of the present invention in FIG. 1 continues to travel in the direction 276.

FIG. 30F is diagrammatic representation of the top view of the sailboat of the present invention of FIG. 1, showing the sailboat of the present invention on a beam reach in the Pacific Proa configuration, with the wind direction 275, the mast assemblies 4B and 4C (simplified for clarity purposes) whose sails are in the 295A and 295B orientations shown, while the sailboat of the present invention travels in the direction 276.

FIG. 30G is diagrammatic representation of the top view of the sailboat of the present invention of FIG. 1. showing the sailboat of the present invention on a beam reach in the Pacific Proa configuration, with the wind direction 275, after having reversed the direction of the mast assemblies 4B and 4C (simplified for clarity purposes), relative to those shown in FIG. 30F, whose sails are now in the 295A and 295B orientations shown, and after the rudder/dagger board assembly has been realigned by rotation 296 through an angle of 180 degrees with the new direction of wind thrust on the space frame, and the sailboat of the present invention of FIG. 1 traveling in the new direction 276.

Figure 30H:
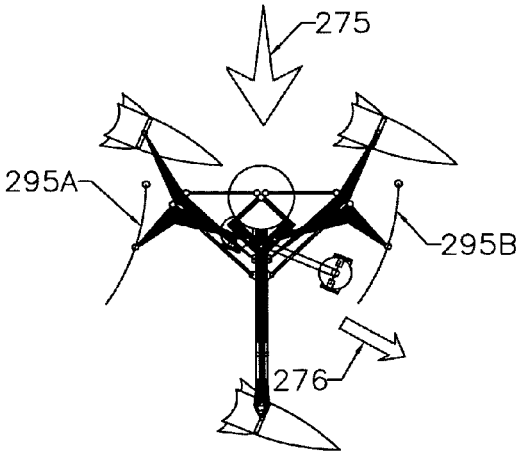
FIG. 30H is a top view of the sailboat of the present invention of FIG. 1 in the Atlantic Proa configuration on a broad reach.

FIG. 30H is a diagrammatic representation of the sailboat of the present invention of FIG. 1 in the Atlantic Proa configuration, sailing on a broad reach, with the wind direction 275, with the mast assemblies 4B and 4C (simplified for clarity purposes) oriented as shown 295A and 295B, respectively, and traveling in the direction 276.

FIG. 31 is a diagrammatic representation of the top view of the sailboat of the present invention of FIG. 1, with the hulls (2A, 2B, and 2C) in the Star Formation, with each the hull axis 280 oriented as shown, where each hull axis 280 of the three hulls 2A, 2B, and 2C is oriented at 120 degrees relative to each other 246, and the rudder foil 36 and the dagger board foil 37 not shown) are in the partially elevated configurations 201B and 202B respectively (as shown in FIG. 21E), and the twin sails 237A, 237B in FIGS. 26A through 26C are all furled, on both mast assemblies 4B and 4C, and the canard winglets 159A and 159B are in the nominal configuration 247, with the wind direction 306 relative to the sailboat of the present invention which is automatically oriented with its bow hull 2A pointing into the wind, and the rudder and dagger board foils 36 and 37 elevated (dagger board foil 37 hidden) as shown to generate resistance to the wind induced aerodynamic drag forces on the sailboat of the present invention of FIG. 1.

Figure 32:
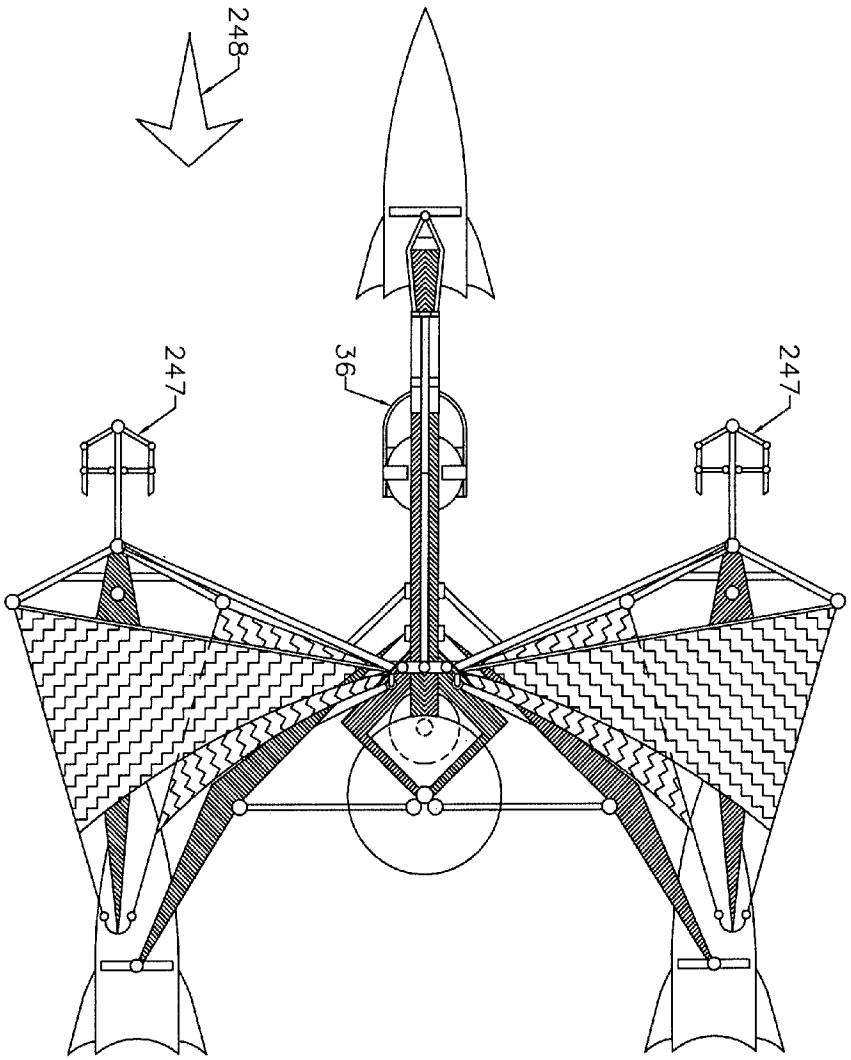
FIG. 32 is a top view of the sailboat of the present invention of FIG. 1, not under way with and pointing into the wind due to the rudder and dagger board foils rotation.

FIG. 32 is a diagrammatic representation of the top view of the sailboat of the present invention, not under way, and pointing directly into the wind 248, with mast assemblies 4B and 4C in the weather vane configuration, and sails unfurled, with both winglets 159A and 159B, in the nominal configurations 247, with the rudder foil 36 partially elevated to decrease downwind drifting, and the dagger board foil 37 also partially elevated (but hidden in this figure), for the sailboat of the present invention of FIG. 1.

Figure 33A:
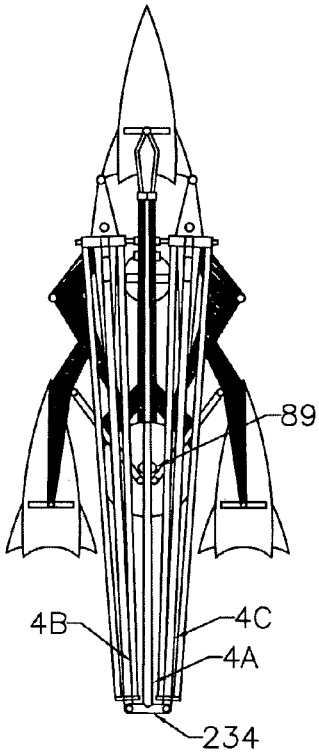
FIG. 33A is a top view of the sailboat of the present invention of FIG. 1, with the mast assemblies and starboard and port hull support arms in the pre-deployed configuration.

FIG. 33A is a diagrammatic representation of the top view of the sailboat of the present invention of FIG. 1, illustrating the pre-deployed initial configuration (for example when the sailboat of the present invention is a slip), and the fore spar 4A is down and resting in the fore spar support cradle, 89, at the top of the cabin support shaft 90, along with the mast assemblies 4B and 4C, which, are also in the pre-deployed configuration and whose mast head receiver bearing sockets 254 are attached to the shaft 234, through the mast head receiver bearings 255A and 255B (as shown in FIG. 25C) at the top of the fore spar 4A, of the sailboat of the present invention of FIG. 1.

Figure 33B:
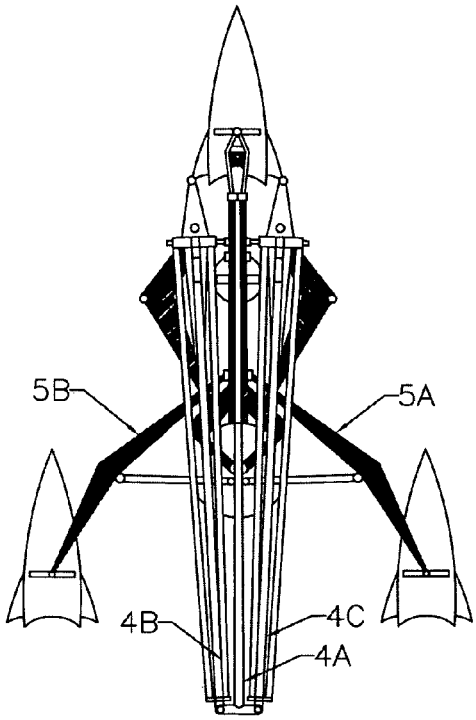
FIG. 33B is a top view of the sailboat of the present invention of FIG. 1, with the starboard and port hull support arms in the fully deployed configuration.

FIG. 33B is a diagrammatic representations of the top view of the sailboat of the present invention of FIG. 1, illustrating the starboard hull arm 5A and the port hull support arm 5B in the fully deployed configuration, while the fore spar 4A and the mast assemblies 4B and 4C remain in the pre-deployed configuration of the sailboat of the present invention in FIG. 1.

Figure 33C:
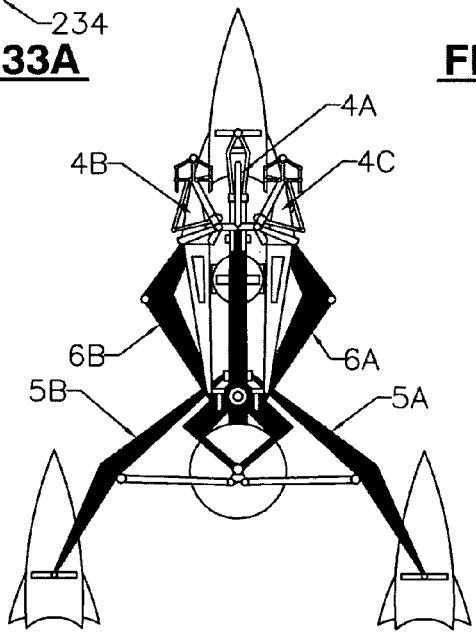
FIG. 33C is a top view of the sailboat of the present invention of FIG. 1, with the mast assemblies in the full deployed configuration, before the mast support arms are deployed.

FIG. 33C is a diagrammatic representations of the top view of the sailboat of the present invention of FIG. 1, illustrating the port hull 2B and the starboard hull 2C in their fully deployed configuration, and the elevated position of the fore spar 4A to its fully deployed configuration, and the mast assemblies 4B, 4C respectively in their fully deployed configuration, but before the deployment of the mast support arms 6A and 6B, and before the deployment of the sail support arms 143A and 143B, on each mast assembly 4B and 4C of the sailboat of the present invention of FIG. 1.

The primary structural element of the sailboat of the present invention s space frame is a central structural element 1 as illustrated in FIG. 1 that extends from the "nominal" bow of the craft 2E in FIG. 1, to the cabin area, structural support assembly 2D at the "nominal" stern of the craft as illustrated in FIG. 1. The structural elements of the sailboat of the present invention space frame can be constructed from hollow aluminum cylindrical elements, and associated cast aluminum fittings, while bearings and sliding surface elements are fabricated from other appropriate materials. The use of the term "nominal" pertains to reference configuration of the sailboat of the present invention, for the multiple sailing configurations that the sailboat of the present invention can assume. The nominal configuration is defined as that associated with downwind run sailing where the bow hull 2A is forward position and the port hull 2B and starboard hull 2C and cabin 8 are in the stern section of the sailboat of the present invention in FIG. 1.

In this realization of the sailboat of the present invention, this central structural element 1 is fabricated from a hollow cylindrical element having a trapezoidal cross section in FIGS. 3A, through 3F. At the fore section 2E of the central structural element a vertical element is attached to the central structural element 1 and is called the horn 10 see FIGS. 3A, 3B, 3C. The horn has a horn pivot mechanism 22 at its top which supports the fore spar 4A, which can slide through the fore spar slide bearing 26A in the horn pivot mechanism 22, while being driven by the fore spar screw mechanism 25 and servo 26B, in FIG. 4. Electrically driven screw mechanisms are used for linear motion these components, alternatively, the required translation motion at this location could also be accomplished by hydraulic or other means. A portion of the horn extends below the base deck plane 63 and has a vertical horn bearing 15 (whose cylindrical axis is perpendicular to the base deck plane 63, which accepts the bow hull vertical shaft 41, which is the connection means between the bow hull 2A and the horn 10 in FIGS. 6A, 6B.

The hull vertical shaft 41 is attached to the bow hull through a hull hinge angle range control mechanism 40—see FIGS. 6A, 6B, 7A, and 7B. This hull hinge angle range control mechanism 40 is identical on each of the three hulls 2A, 2B, and 2C in FIG. 1. The location along the fore to aft length of the hull for the hull hinge angle range control mechanism 40 connection to the deck plane of the hull 38 is constrained by the requirement that the hull float with its deck plane of the hull 38 parallel to the water line—in FIG. 6A. This mechanism constrains the hulls to remain either parallel to the base deck plane 63 or to rotate freely around the horizontal hull hinge axis 43 to lift the bow of the hull up to an angle of 30 degrees (relative to the base deck plane 63 in FIG. 2), before this rotation 39 is stopped—in FIG. 7B.

The hull vertical shaft 41 is a component of the hull hinge angle range control mechanism 40, and fits into the horn vertical bearing 15, and allows free rotational movement of the hull about this vertical axis 228, in FIG. 3B without any restraint, when in the weathervane mode—see typical range of allowable hull rotation 229 in FIG. 8A.

Each hull incorporates an electric shock absorber set 44 which can provide an adjustable resistance to the hull rotation rate about its horizontal axis 43 in the hull hinge angle range control mechanism 40 in FIG. 6B. This electric shock absorber serves a second function which is to generate electricity from the wave action which tilts the hulls about the hull horizontal axis of rotation 43. Note: This electric shock absorber set 44 can utilize the same mechanism as the regenerative braking system used on hybrid electric cars. When the any of the three hulls rotates around the horizontal axis 43 to move over a wave, the electric shock absorber generates electricity by resisting this rotation to a controllable degree. These electrical shock absorbers are used to both dampen hull rotation about the horizontal hinge, as well as, simultaneously generating electrical energy, a further capability embodied in said electrical shock absorbers is the controllability by the helmsperson to make the electrical shocks stiffer (for use in heavy chop sea conditions) as well as to make them softer (for calmer sea conditions). The stiffer the electric shock absorbers are against rotation, the more electrical energy will be generated for the same amount of rotation of the hull about the horizontal axis 43. The electrical generating capability of the electric shock absorbers on the hulls can also be utilized when the sailboat of the present invention is at anchor or not under way, since the hulls will still rock when waves pass under them independent of any motion of the sailboat of the present invention in FIG. 1.

Each hull also incorporates a hull angle range control mechanism 40, in FIGS. 7A, 7B, which is controlled by the helmsperson in special circumstances and can change the angular orientation of the hull (to be discussed later). The output of the electric shock absorbers 44, when the hulls are normally allowed to rotate about the hull horizontal axis of rotation 43, is sent to the battery bank, located in the cabin 8, in FIG. 1, which in turn provides the current required for the electrical operational demands of the sailboat of the present invention in FIG. 1. These electrical demands include primarily; the twin sail pivot shaft rotation lock mechanism servo 138A as shown in FIG. 16A, the winglet rotation lock mechanism in FIG. 16B, the rudder rotation control servo 249 in FIG. 5, the anchor winch 184 in FIG. 20D, the unfurl mechanisms 127, and the auxiliary electric motor driven propulsion system 187 in FIGS. 20E-20G. The battery bank is located in the cabin 8 at the aft section, at the structural support assembly 2D on the central structural element 1 in FIG. 1, and receives electrical power input from the electric shock absorbers and solar cell assembly mounted on the roof area of the cabin 8. There is also located in the cabin 8, a motor generator (not shown), fuelled by gas or oil that can be used as an ultimate electric power backup for all these systems, in an emergency.

At the nominal stern, there are located the structural support assembly 2D of the central structural element 1, which support the cabin 8 in FIG. 1. This cabin 8 is connected to the central structural element 1 through the cabin structural support assembly 2D, which extends from the set of struts 16A and 16B on either side of the central support element 1 to the cabin support shafts 90 and 91, through the bearings 251A and 251B in the structural support assembly 2D, in FIG. 3B. This cabin support structure assembly 2D is oriented so as to allow visibility in the three principal directions of motion, including the nominal space frame configuration FIG. 1, as well as Atlantic and Pacific Proa configurations FIGS. 8A, 8B, respectively where these configurations are shown without the superstructure above the deck so as to make the subject components visible. The lens like shape for the cabin 8 also provides a large living area for cabin functions, as well as a large roof surface for the use of solar cell assembly 312 for supplementary electric energy generation as an electric energy source for the battery bank. The weight of the cabin 8 and its associated support structure is used to offset the weight of the horn 10 and the fore spar 4A, thus keeping the resultant center of mass of the sailboat of the present invention (in the horizontal base deck plane 63—in FIG. 2) close to the center of mass of the deployed space frame along the central structural element axis 252 in FIG. 3A. At the center of mass in the central support structure there is located a vertical bearing 13, which houses the central shaft 34, which connects the central structural element 1 to the rudder and dagger board assembly 7 as shown in FIG. 5. The cabin 8 is a large rigid lens like (ellipsoidal) accommodations area in this preferred realization of the sailboat of the present invention in FIG. 1. The lens like cross section for the cabin 8 provides the minimum apparent wind related aerodynamic drag forces which are independent of the orientation of the sailboat of the present invention, contrary to prior art with more rectilinear, in both monohull and other multihull sailing craft.

This central structural element 1 is designed to be the strongest part of the space frame in order to accommodate the major loads on the space frame from the cabin 8, the mast assemblies 4B, 4C, the hulls, 2A, 2B, 2C, and the rudder/dagger board assembly 7 in FIG. 1. The central structural element 1 has three rails affixed to it 76 as shown in FIG. 9. These central structural element rails have two traveler cars 59, and 71 mounted on them which can be moved in the range 253 between the aft sections of the central structural element to the fore section of the central structural element as shown in FIG. 9. The fore car 59 carries two push rods 69 and 70 that are used to deploy the corresponding mast support arms 6B and 6A in FIG. 8A. FIG. 14 shows the details of only the starboard mast support arm 6A, and the port side mast support arm 6B is symmetrical to this arm. The aft car 71 in FIG. 9 is connected to the starboard hull support arm 5A and the port hull support arm 5B in FIG. 8A, and their associated hulls 2B and 2C. The two mast support arms 6A and 6B are pivoted in two corresponding mast support arm bearings 12B and 12A in FIG. 3A which exist in the corresponding aft set of struts 16A and 16B, which are affixed to the central structural element 1, in FIG. 3A. The location of these bearings corresponds to the location of the central shaft bearing 13 with respect having approximately the same coordinate of distance along the central structural element axis 252 in FIG. 3A away from the cabin. This location for these bearings is required to insure that the thrust loads from the mast assemblies 4B and 4C and the resistance at the central shaft bearing 13 load from the rudder/dagger board assembly 7 lie at approximately the same point along the central structural element axis 252 in the base deck plane 63, when the mast support arms 6A and 6B and the mast assemblies 4B and 4D and the fore spar 4A are all in the fully deployed configuration in FIG. 8A. The starboard and port hull support arm pivot links 9A and 9B respectively are attached to their bearings 11B and 11A in FIG. 3A, which in turn are fixed to the cabin support shaft bearings 251A and 251B in FIG. 3A and FIG. 11B. These pivot links form a triangle as shown in FIGS. 3A, and 8A. The other end of each pivot link 9A and 9B is attached to the respective starboard and port hull support arms 5A and 5B, through hull support arm pivot link hinges 11A and 11B locations, at approximately mid span of the arm. This linkage is shown for the starboard hull support arm 5B in FIG. 13A, where the hull arm pivot links are attached to hull support arm by a pin (not shown) passing through the cylindrical hole 93.

At the top of the cabin 8, the cabin support shaft 90 extends above the cabin roof and has a fore spar support cradle 89 at its top, in FIG. 12. This support cradle is used to support the starboard and the port mast assemblies 4B and 4C by the fore spar 4A to which they are connected, when they are in the pre-deployed configuration, see FIGS. 33A, 33B. In the pre-deployed configuration of the sailboat of the present invention in FIG. 1 as shown in FIG. 33A, the lower fore spar stop bearing 28 rests against the fore spar slide bearing 26A preventing any further motion of the fore spar through this bearing as shown in FIG. 4.

The positions, along the rails 76 on the central structural element 1, of the fore car 59 and aft car 71 are controlled independently by the fore car servo 19A and the aft car servo 19B which activate their respective electrically driven car screws 18A and 18B, which drive the respective cars through the internally threaded components 64 and 75 which are incorporated in the fore car 59 and the aft car 71 as shown in FIG. 9 and FIGS. 10A and 10B. The arrangement of the cars along the rails 76 is such that the hull support arms 5A and 5B must be extended fully by the aft car moving down towards the cabin 8 until it reaches the fore and aft car servo housing 17B in FIG. 3B. At this point the mast support arms 6A and 6B are opened to their full extent in FIG. 33 B. This insures the stability of the sailboat of the present invention in FIG. 1 and the position the aft car 71 must occupy before the fore car 59, which deploys the mast support arms 6A and 6B, through the push rods 70 and 69 is allowed to move on the central structural element rails 76 up to the aft car 71 location against the fore and aft car servo housing 17B. At this point the mast support arms 6A and 6B are opened to their full extent in FIG. 9.

The mast support arms pin connection 102 in FIGS. 14 A and 14B is used so that when these arms are fully extended this pin 102 on each mast support arm 6A (and 6B not shown) slips into the adjacent starboard hull support arm socket 92 in FIGS. 13A and 13B. The mating of the mast support arm 6A pin connection 102 with the starboard hull support arm socket 92 is shown in cross section in FIG. 14C. The completion of deployment process insures that the mast support arm pins stay in the mast support arm sockets in the respective starboard and port hull support arms once the deployment is fully complete in FIG. 24. The function of these mast support arm connection pins is to support the mast support arms 6A, and 6B with the starboard hull support arm 5A and the port hull support arm 5B in the vertical direction (perpendicular to the base deck plane 63), and, in combination with the two mast assemblies 4B and 4C and the fore spar 4A, this makes the entire tetrahedral space frame structurally rigid in the fully deployed configuration in FIG. 24.

As mentioned earlier, the fore spar 4A is connected to the horn 10 on the central support element 1 in FIG. 1. The relative position of the fore spar 4A with respect to the horn pivot mechanism 22 is controlled by the fore spar servo 26B which activates the electrically driven fore spar screw 25 which in turn provides the force required to raise or lower the foot of the fore spar 4A through the horn pivot mechanism 22, and then lock it in the desired final position when the fore spar screw 25 stops rotating, when deployment is completed as shown in FIG. 24.

The top of the fore spar 4A has two mast head receiver bearings 255A and 255B shown in FIG. 25C, one for each of the two masts, which allows rotation of each mast assembly about its axis of rotation 260 in FIG. 17A. These connections to the top of the fore spar 4A, allows for the mast assemblies to rotate about their respective axes of rotation 260, and also to pivot in the direction 257 in FIG. 25C during the deployment and folding processes.

The two mast assemblies 4B and 4C are identical in construction and are comprised of the boom base assembly 113, and the top mast assembly 261. The top mast assembly 261 is connected to the boom base assembly 113 by a boom base hinge shaft 136. This allows the top mast assembly 261 to fold down on top of the boom base assembly 113 (in FIGS. 16A, 16B), when the mast assemblies 4B and 4C are in the pre-deployed configuration FIG. 33A. This boom base hinge shaft 136 extends beyond the actual boom base hinge 136A, 136B on both the outboard and inboard sides of each mast assembly 4B and 4C, and the inboard extension of the hinge 136B is used to lock the boom base assembly 113 to the horn 10 via the horn socket connections 14A and 14B in FIG. 3A. This boom base hinge pin 136B remains mated with the respective socket connections during the unfolding of the top mast assembly 261 away from the boom base assembly in FIGS. 33B and 33C. This occurs when the top mast assemblies 261 are being raised until they are locked into the boom base assembly 113, through the top mast assembly pin lock mechanism 116. Under both these conditions, folded and in deployment, the boom base assembly 113 is fully constrained to the central structural element 1. Subsequently, during the deployment of the mast arms 6A and 6B away from the central structural element 1, the boom base assembly 113 components of the mast assemblies 4B and 4C are released from the constraint to the central structural element 1, and the each mast pin 119 comes out of the strut shaft pin socket 85 and 86 at the top of each strut shaft 87 and 88 respectively, this occurs simultaneously with each boom base hinge shaft 136 coming out of the respective horn sockets 14A and 14B in FIG. 3B.

The top mast assembly 261 is has a tetrahedral structure, where top mast assembly base 137 forms the bottom of the tetrahedron, the spars 135A and 1356 in combination with the hinge 136A form the rear triangular face of the tetrahedron, and the fore spar 4A, completes the tetrahedral structure as shown in FIGS. 16A and 16B. This tetrahedral shape gives the top mast assembly 261 the required rigidity to resist bending loads, and gives the boom base hinge 136A the required support so that this doesn't become a weak point in the mast assembly 4B and 4C. The whole mast assembly must be balanced carefully about its rotational axis 260 in order for it to weathervane in the wind properly. This is the case because of the mast assembly axis of rotation angle 257 that each mast assembly makes with the base deck plane 63. If this axis of rotation were perfectly vertical relative to the base deck plane 63 the balancing would not be required, but an imbalance in the mast assembly around the rotational axis 260 will cause the mast assembly 4B and 4C to tend to rotate to a mast assembly minimum potential energy configuration (lowest position for the center of gravity of each mast assembly relative to the base deck plane 63). The balance may not be perfectly achievable but should be aimed for since any imbalance will slightly effect the desired weather vane action of the sails. Similarly it is also important to minimize the imbalance associated with components attached to the twin sail shaft 139, throughout its range of rotation, about the twin sail shaft 139 axis of rotation, so as to have the minimum impact on the overall balance about the mast assembly axis 260. This design constraint insures that the power of the wind is well utilized to make sail orientation changes without requiring high mechanical advantage mechanisms (such as block and tackle) to offset wind loads, and maintain sail orientation to the apparent wind, as would be the case for sailboat of the present invention as found in prior art having rigid or non-rigid sails.

The present invention has a number of improvements over prior art with respect to deployment and erection of the masts. The second prototype has a severe problem with erection of the two sail masts from the non-deployed initial configuration, in that the knuckles in the two masts made the erection of the sail structures very unstable and difficult to accomplish. This configuration required that the single spar at the stern of the space frame was required to hold the two masts up while they were not rigid during the erection process. This sailboat of the present invention configuration allows the sail and masts structures to be stable throughout the erection process from pre-deployed (folded) to fully deployed. This capability allows the superstructure of the space frame above the base deck plane 63 with twin sail set, 237A and 237B and fore spar 4A to be either erected or lowered to just above base deck plane 63 level in FIGS. 2 and 3B. This capability, for example in a storm situation would help reduce the danger to the crew and the craft, where having this super structure in the deployed configuration FIG. 24 would cause high wind drag loads and susceptibility of the sailboat of the present invention in FIG. 1 to lightening strikes. The second prototype also had the problem that the sails could rotate while the masts were being erected. The present invention has the advantage that the boom base assembly (s), 113 in FIGS. 15A, 15B and 15C, are locked into a position parallel to the central structural element 1 and cannot rotate from this parallel configuration during the deployment process. In addition the rigidity of the second prototype was marginal during the expansion process for the triangular deck structure from the folded to the deployed configuration, as well as during the erection the masts and mast spar. The sailboat of the present invention is rigid in all phases of deployment from the unfolding of the starboard and port hull support arms (5A and 5B in FIG. 1), to the deployment of the masts assemblies (4B and 4C in FIG. 1) and the fore spar (4A in FIG. 1), components of the space frame. In addition the first and second prototypes utilized cable stays to support the space frame structure, there are no cable or rod rigging stays utilized in the sailboat of the present invention, because the two masts assemblies 4B and 4C, and the fore spar 4A all combine with the rest of the space frame structure form a rigid tetrahedron, when these components are fully deployed. The lack of cable or rod rigging of the present invention is a major advantage over the prior two prototypes as well as conventional catamarans and trimarans, since cable or rod rigging can deteriorate and fail. In addition the existence of mast stays in the prior art (monohulls, catamarans, and trimarans) stops the main sail from rotation when the main sail boom impacts the stays. In strong wind conditions this can lead to unsafe loading on the rigging, and difficulty for the helmsperson in the control of the sailboat of the present invention. Some other sailboats have no stays or rod rigging, but they have a flexible mast, which can bend significantly, and thus distorting the attached sail contour in a non-thrust enhancing fashion. The present invention has no cable or rod rigging and still can maintain a rigid mast assembly structure and fully controlled sail contours.

The sailboat of the present invention has advantages over prior multi-hulled sailboats in that the sailboat of the present invention can safety carry (because of its much large effective beam for the same displacement) a much larger sail area (due the configuration of the two mast assemblies 4B and 4C in FIG. 1, and their associated twin sails 237A and 237B in FIGS. 26A through 26C). This in turn allows the sailboat of the present invention to sail much faster than comparable displacement multi-hulled sailboats; this speed factor is further enhanced by the use of the short planing hulls 2A, 2B and 2C in FIG. 1 which incur less drag at all speeds than typical hulls on other multi-hulled sailboats. The sailboat of the present invention also has a number of improvements over prior art with respect to sail furling. The second prototype has sails that were fixed to their respective masts, and could not be furled without bending their respective masts at their knuckles. The sailboat of the present invention has sails (237A and 237B as shown in FIG. 26A) and utilizes roller furling devices 273A and 273B. These sails are maintained in the furled configuration (by the roller furling devices 273A and 273B), during the erection process. On conventional mono and multi hulled sailboats the sailboat will have one or more main sails and one or more jibs (which are attached to the forward stays). The use on the sailboat of the present invention of all "jib like sails" minimizes aerodynamic drag forces since they have a very thin shaft which forms the leading edge of each sail and not a thick mast. Therefore all the sails on the present invention can be furled (by the roller furling device 273A and 273B or unfurled simply by tension on the respective clew lines 129A and 129B, provided by the unfurl mechanisms 127, on the boom base assembly 113 in FIG. 16B.

The total trust generated by the sails on each mast can adjusted by use of the twin sail pivot shaft rotation lock mechanism servo 138A, which rotates the twin sail pivot shaft 139. That is, one sail shaft (for example 145A) and the attached sail will move forward (and away from mast assembly axis of rotation) while the other sail shaft (for example 145B) and sail will move backward (and closer to the mast assembly axis of rotation). In this configuration the more forward sail acts like a jib and the rearward sail acts like the main sail (as on a typical sailboat). Similarly if the twin sail pivot shaft is rotated in the opposite sense the other sail which is more forward acts like the jib while the rearward sail acts like the main sail. In this fashion the net thrust generated by the sails on the mast can be finely tuned to generate a range of thrust magnitudes. In the nominal (neutral) rotation configuration of both the 159A and 159B and the twin sail pivot shaft, there is no wind related thrust generated by the winglets 159A and 159B and the sails, and the mast assemblies' just weathervane in the wind without generating any thrust—see FIG. 26C. The winglets 159A and 159B are used to fine tune the angle of attack for the sails 237A and 237B in FIGS. 26A through 26E, relative to the apparent wind 266 in FIG. 26E. The canard winglet assembly 263 in FIGS. 16E and 16F has two rigid winglets 159A and 159B, fabricated from a rigid material (such as fiber glass, or aluminum), and having an aerodynamic symmetrical cross section 264, shown in section DD, in FIG. 17G. These two winglets 159A and 159B act in concerted action. These winglets 159A and 159B are controlled by a winglet rotation lock mechanism 149 (in FIG. 16C) which either moves one winglet further forward than the other, or further backward from the other. These winglets 159A and 1598, effectively act as small jib and main sail analogs of a typical set of sails; —see FIGS. 16E, and 16F. This relative motion of the winglets 159A and 159B as shown 265 in FIG. 26E, causes a fine tuning torque to be generated by the passage of the wind over these winglets 159A and 159B, and this in turn causes an unbalanced torque on the mast assembly 4B or 4C, which is already rotated because of the rotation of the sail pivot shaft as shown in FIG. 26D thus causing the mast assembly to rotate and change its angle to the apparent wind, until equilibrium is again re-established, and the desired sail contour and net thrust from mast assembly is achieved FIG. 26E. If the winglets 159A and 159B are rotated in the same sense as the sail pivot shaft, the angle that the boom base assembly makes with the apparent wind will increase and approach, but not reach 90 degrees, see FIG. 26E. Note, the clews of the two sails in each or the twin sail sets are closer to each other than the distance between the sail shafts on the top mast assemblies. When the sails are in the weathervane mode, also called the nominal configuration FIG. 26C, this configuration, when a wind is blowing, causes the two sails in each twin sail set to generate opposing thrust vectors which partially cancel out the net thrust on each mast assembly as shown in FIG. 26C, and thus prevent flapping and sail chafing in the weather vane mode.

The present invention incorporates improvements over prior art with respect to independent sail controls and fine tuning. The twin sails on the second prototype were linked so that there booms had to remain roughly parallel throughout their range of rotation. In the present invention, the twin sails sets are completely independent of each other. They can rotate without any limits on angle or number of revolutions. This allows fine tuning of the twin sail orientation to suit sailing requirements exactly. In one scenario, when sailing in a downwind run, the sails can be oriented with an included dihedral angle 267 see FIG. 28A so that they balance each other and allow the sailboat of the present invention to stay lined up with the wind direction 239 and move directly downwind without helmsperson intervention—see FIG. 28A. In the second prototype, when sailing downwind, a complex maneuver was required to have the leading edges of the sails face the stern of the sailboat of the present invention. In this present invention, the mast assemblies 4B and 4C can rotate freely without limit and downwind sailing does not require any special maneuvers. Sail rotation on the second prototype required continuous force to be applied by the helmsperson, while the sailboat of the present invention requires only activation of two control servos, one to rotate the sail pivot shaft 139, and if required, one to rotate the winglets 159A and 159B on each mast assembly 4B and 4C. Once these rotations are complete, no further energy input is required, yielding minimal energy requirements because of the balance of the sails and the winglets 159A and 159B about the mast assembly rotation axis 260, while the mast assemblies are still generating thrust.

As stated earlier, the electric power for control and operation of the sailboat of the present invention comes from a battery bank, which gets charged from the wave action on the hulls electric shock absorbers 44, and the solar cell assembly 312 in FIG. 3B on the roof area of the cabin 8. The winglets 159A and 159B in turn use the power of the wind motion relative to the sailboat of the present invention to generate the torque required to rotate the mast assemblies 4C and 4D. It should be noted that once the winglet angles are set and the twin sail shaft 139 rotation angle is set, the mast assemblies rotate about their mast assembly axes of rotation to balance the wind loads on the sails and the winglets 159A and 159B so as to adjust their angle of attack to the apparent wind and generate the desired thrust force on the sailboat of the present invention of the present invention. As long as the wind direction is fairly constant, the only active control subsequently required by the helmsperson is the rudder rotation servo 249 activation for steering.

The rudder/dagger board assembly 7 is attached to the central structural element 1 through a central shaft 34 that passes through the vertical bearing 13 in the central structural element 1 as shown in FIGS. 3A and 5. This rudder/dagger board assembly 7 has two sets of support arms, the rudder support articulation assembly arms (196A and 196B) which are forward of this assembly's central shaft 34 and the dagger board support articulation assembly arms (197A and 197B) are located to the rear of this assembly's central shaft 34. Both the rudder support articulation assembly arms (196A and 196B) and the dagger board support articulation assembly arms (197A and 197B) have the form of a parallelogram as viewed from the side, see FIG. 21E. The parallelogram configurations of these arms insure that the rudder and the dagger board foils 36 an 37 remain perpendicular to the base deck plane 63 throughout their range of motion, when these components are fully deployed, and while the sailboat of the present invention is under sail. It is important that the rudder and dagger board remain perpendicular to the base deck plane 63 to minimize drag forces and insure constant resistance to leeward motion for the sailboat of the present invention as shown in FIGS. 20E and 21D. Thus the vertical orientation of the rudder and the dagger board is independent of the wave action which can raise or lower the rudder hull 3C and/or the dagger board hull 3D (described below). The range of motion of these rudder and dagger board articulation assembly arms (196A, 196B, 197A, and 197B)) is limited by the central structural element 1 at the top of its travel, while under way or when these components are in the folded configuration—see FIG. 21F. The lower limit of this range for the rudder and dagger board is dictated the respective lift cables 200A and 200B.

The rudder assembly 3A and the dagger board assembly 3B can each be lifted by their respective lift cables 200A and 200B respectively, in the folding process. These cables rudder rotation servo 249 are fixed to the respective lower arms 196B and 197B on their bottom terminations, and to a corresponding electric winches (not shown) mounted inside the respective Central shaft arms 199A and 199B in FIG. 21E. When the respective winches are not active their cables remain under a slight tension and the rudder and dagger board hulls 3C and 3D ride on the local water level in which they float. When it is desired to convert to the folded configuration of the rudder and dagger board assemblies 3C and 3D the respective winches are activated by the helmsperson and the rudder and dagger board assemblies (3A and 3B) are draw up into their folded configuration 268 in FIG. 21F.

The rudder assembly 3A and the dagger board assembly 3B both have semi ring wing foils, also referred to as "foils". These foils are constrained by their attachment to their respective hulls through the respective rudder foil and dagger board foil rotation mechanisms (182 in FIGS. 20A and 203 in FIG. 21A) to remain perpendicular to the base deck plane 63 by a shear pin 195 in FIG. 20C, which stops the rotation of the foils about their hinge point in the aft direction. Both the rudder and dagger board foils 36 and 37 are protected by a shear pin 195 configuration as shown in FIG. 20C. Although the rudder and dagger board foils 36 and 37 can rotate upward freely in the forward direction, while under way they remain pressed against their respective shear pins 195 due drag forces induced by the forward motion of the sailboat of the present invention. Both the rudder and the dagger board foils 36 and 37 have a drag guard on the bottom 188, shown in FIGS. 20A and 21A, so that in the event of the craft moving through shallow water this drag guard 188 would impact the ocean floor before the foil, and shear off the respective shear pins 195, thus helping to lessen the possibility of the foil catching, and digging into the bottom and being severely damaged. Both the rudder and dagger board foils 36 and 37 can be reset to the perpendicular orientation by their respective foil rotation mechanisms, when there is enough depth to allow this to occur, and the shear pin 195 replaced. This stop does not prevent the foils 36 and 37 from rotating forward and upward when the sailboat of the present invention is not under way, in order to impede the sailboat of the present invention drifting downwind. The foils 36 and 37 also have small plates 269 perpendicular to the foil on either side, just below the horizontal shaft axis 181A, and 181B in order to maintain the flow 270 of water perpendicular to the foil cross section while the sailboat of the present invention is under way see FIGS. 20A and 21A.

The rudder hull assembly 3A also incorporates the electrically driven anchor winch 184, guides 180 for the anchor chain and line 183, and a protective metal sheathing 185 to protect the rudder hull 3C from the anchor while it is being raised or lowered—see FIG. 20D.

The rudder/dagger board assembly 7 is attached to the central structural element 1, by means of a central shaft 34. This central shaft 34 passes through the central shaft rotation constraint mechanism 210 in FIG. 22B. This mechanism is normally locked and prevents rotation of the central shaft 34 of the rudder/dagger board assembly 7 relative to the central structural element 1 component of the space frame of the sailboat of the present invention. In a tacking maneuver, under the helmsperson's control, a servo activates the solenoids to drop the metal balls 220, which in turn unlocks the central shaft from the central structural element 1 component of the space frame. When the central shaft is unlocked, and simultaneously, the rudder hull 3C is rotated, by its servo 249, the rudder/dagger board assembly (whose direction is characterized by the rudder and dagger board horizontal center line 271 will start rotating (under the influence of the water passing by the rudder foil 186. This rotation will continue until the rudder assembly 3A is returned to its nominal orientation, shown in FIG. 5, and the central shaft 34 (and hence the rudder and dagger board) is relocked to the central structural element 1. The rudder and dagger board horizontal center line 271 will then be oriented at the desired angle relative to the central structural element axis 252. This rotation of the rudder and dagger board horizontal center line 271 can be up to +/−90 degrees relative to the central structural element axis 252. The rotation can be locked at discrete angular increments, relative to the nominal configuration shown in FIG. 28A. The number of equally spaced angular rotation increments are based on the number of solenoids spaced around the circumference of the central shaft rotation control mechanism (18 solenoids are used in the sailboat of the present invention, yielding 10 degrees per angular increment). This solenoid coil function can be carried out by alternate electro-mechanical or other means, and the use of the solenoid base mechanisms is used herein as an example of one type of locking mechanism in this functional description. The nominal configuration of the rudder/dagger board assembly 7 exists when this rudder/dagger board assembly horizontal center line 271 is parallel to central structural element axis 252.

At the base of the rudder assembly vertical shaft 35 there is located the rudder hull 3C, and at the base of the dagger board shaft 207, there is located the dagger board hull 3D. Both of the rudder and dagger board hulls 3C and 3D, have a lens like (saucer) shapes. These hulls support the full weight of the respective rudder and the dagger board assemblies 3A and 3B and half the weight of the rudder and dagger board support articulation assembly arms 196A, 196B, and 197A, 197B respectively, allowing them to ride over waves. In addition the lens like shape of these hulls diminishes any wave drag forces that might tend to impart rotation forces on the rudder or the dagger board foils 36 and 37, which would occur if these hulls didn't have a lens like shape—see FIGS. 20A, B and 21A, 21B. The dagger board shaft 207 is located at a distance "x" away from the central shaft 34 of this structure, while the rudder assembly vertical shaft 35 is located at a distance, of "3x" away from the central shaft 34—see FIG. 21E. The dimensions of the respective foils 36 and 37 under the rudder hull 3C and the dagger board hull 3D respectively, are sized so that the resultant thrust loads from these foils, under sail, just balance at the central shaft 34. These rudder and dagger board foils (36 and 37) provide high dynamic thrust (since there are no drag losses, as would be associated with the bottom of a typical single blade type rudder or dagger board (used in prior art)—see FIGS. 20A, and 21A. The rudder assembly 3A is rotated by the rudder rotation servo 249 about the rudder vertical shaft 35, while the dagger board assembly 3B is fixed and cannot rotate relative to rudder and dagger board horizontal center line 271—see FIG. 5. As stated earlier, the rudder and the dagger board are constrained by their respective support articulation assembly arms, 196A, 196B, and 197A, 197B respectively, to remain perpendicular to the base deck plane 63 independently of the level of the waves beneath the sailboat of the present invention. The rudder/dagger board assembly 7 is solely responsible for controlling the direction of travel 243 of the sailboat of the present invention see FIG. 29, since it is rigidly affixed to the central structural element 7 of the space frame, except while the sailboat of the present invention is the process making configuration changes to the space frame relative to the rudder and dagger board orientation, or while tacking. During a tacking maneuver, this rudder/dagger board assembly 7 is allowed to rotate around the cylindrical axis 284 of central shaft 34. As mentioned earlier the three hulls weather vane in the water flowing by the sailboat of the present invention, whose direction is controlled by the orientation of the rudder/dagger board assembly 7, and these hulls 2A, 2B, 2C automatically line up with this flow direction independent of the orientation of the central structural element 1 of the sailboat of the present invention. The weather vane hulls can all move independently about their horizontal and vertical axes 285, 43 respectively, and if one or more hulls are stuck by a wave, those hulls can respond to it and rotate around their vertical axis 285, and/or their horizontal axis 43, to mitigate the loads imparted to the space frame.

For slight course corrections the rudder assembly 3A is rotated about the rudder vertical shaft 35 and the sailboat of the present invention moves in this direction as propelled by the wind thrust on the sails. In a tacking maneuver the rudder assembly 3A is rotated by the helmsperson through the associated rudder rotation servo 249, and then the central shaft 34 in the central shaft rotation constraint mechanism 210 is released by the helmsperson through the controls so that the rudder/dagger board assembly 7 can rotate in its entirety in the direction of the desired heading, independent of the central structural element axis 252 orientation. This configuration insures that the forward motion/momentum of the sailboat of the present invention through the water while under way is utilized to assist in rotating the rudder/dagger board assembly-7 relative to the central structural element 1, and therefore almost instantly changing the sailing direction of the sailboat of the present invention, with only the minimal energy input required to rotate the balanced rudder assembly 3A about the rudder vertical shaft 35, and in turn the balanced rudder/dagger board assembly 7, is lined up with the new desired sailing direction. At this point the central shaft rotation constraint mechanism 210 is again deactivated by the helmsperson to lock the central shaft 34 to the central structural element 1

The helmsperson's chair 231, and the associated control console 230 is located on and fixed to the top of the central shaft 34, and when this shaft is rotated (by the rotation of, such as during a tacking maneuver), the helmsperson's chair 231 and control console 230 are also simultaneously rotated. This linkage makes the helmsperson always face the direction in which the sailboat of the present invention is sailing, or moving in, while under auxiliary electric motor propulsion system 187. An option on larger realizations of the present invention would be to also directly link the lower cabin support shaft 91 to the rudder/dagger board assembly central shaft 34 so that the cabin 8 would rotate (just as the helmsperson's chair 231 in the smaller realization of this design), thus insuring that the forward section of the cabin would always face the direction of travel and stay aligned with the rudder/dagger board assembly horizontal centerline 271 again independent of the space frame orientation.

There are a number of improvements in the present invention over prior art with respect to tacking ability and controllability. The canard configuration of rudder assembly 3A (where the rudder is the forward position and the dagger board assembly 3B is in the aft position) in the present invention insures that once the rudder assembly 3A is rotated (while any forward motion of the sailboat of the present invention) the rudder assembly 3A rotation will generate a torque on the rudder/dagger board assembly 7 and cause the rudder/dagger board assembly horizontal center line 271 to rotate up to a maximum of +/−90 degrees (relative to its nominal configuration) before it reaches its rotation limit (90 degrees). Because of this configuration, only the mass of the rudder/dagger board assembly 7 has to be rotated, for the direction of the sailboat of the present invention to be changed. Thus the sailboat of the present invention can execute a right angle turn quickly, because the rudder and dagger board assembly, dimensions and mass are a small fraction of the total dimension and mass of the space frame of the present invention. This type of direction change maneuver is especially useful during tacking. This is an improvement over the rudder function in the second prototype, where as the sailboat is turning due to the rotation of the rudder at point is reached where the effectiveness of the rudder in rotating the hulls decreases during the turning process as the sailboat velocity decreases. In the present invention, the direction of motion completely controlled by the rudder/dagger board assembly 7 orientations. This is a major improvement over the second prototype in that the relative dimension and mass of this control mechanism is less than that of the extended rudder structure on the second prototype. Furthermore, during a tacking maneuver, the hulls freely rotate around their individual hull vertical axis to line up with the direction of motion. This direction can be different for the different hulls during the maneuver. This is opposed to the second prototype which required all hulls to rotation simultaneously. Similarly the rotation of the rudder on the second prototype required force exerted by the helmsperson, while on the present invention the rudder is rotated via an electric control element with minimal force requirements because of the balance between the forward section of the rudder assembly foil 36 and the rearward section of the rudder foil 36 about the rudder assembly vertical shaft 35, as well as, the balance of the thrust forces from the rudder and the dagger board foils 36 and 37 about the central shaft 34, and finally the circular lens like configuration of the rudder and dagger board hull, which minimizes the torque to rotate the rudder assembly, and to rotate the entire rudder/dagger board assembly 7—see FIG. 5. In addition the second prototype had dagger boards on the two bow hulls and an extended rudder support structure. This configuration made a contribution to overall length of this sailboat of approximately double the length of the fore to aft deck dimension. The present invention has a rudder and dagger board structure that does not extend beyond the triangular foot print of the hulls of the sailboat of the present invention on the water, and is much shorter than the distance between the hulls, thus protecting this structure from damage. Finally the stresses induced in the space frame from the rudder/dagger board assembly 7 in resisting leeward movement, are all located in the strongest part of the space frame structure (the central support element 1). This is an improvement over the second prototype, which had the dagger boards and the rudder at positions relatively far from the center of the deck area, and therefore requiring a stronger deck structure to resist the forces generated by these elements.

The present invention also incorporates major improvements over conventional multi-hulled sailboats such as the catamaran and the trimaran with respect to tacking maneuvers. Tacking of catamarans and trimarans is a partially inhibited because the drag associated with the long hulls of each type of sailboat requires a significant distance to change direction. In the sailboat of the present invention the process of tacking just involves the slight rotation of the rudder assembly 7, release of the central shaft rotation constraint mechanism 210, and relocking the central shaft 34 on the desired new heading.

The rudder and dagger board also have an additional function beyond the control of the sailboat of the present invention's heading. This other function is required when the sails are furled and the sailboat of the present invention is not under way. Under this situation, the sailboat of the present invention will always point into the wind, which is the configuration most capable of accommodating large waves, and strong winds, and reducing the probability of the sailboat of the present invention broaching or capsizing. To insure that this occurs in the present invention, both the rudder and the dagger board foils are capable of rotating in the forward and upward direction up to approximately 90 degrees about the horizontal shaft axis 181A and 181B, on their respective support hulls, as shown in FIGS. 20A and 21A. Under normal under sail operations the rudder and the dagger board foils 36 and 37 respectively, are held in the vertical position by the water drag forces associated with forward motion-pushing each of them against their own foil rotation stop component 190, but when the sailboat of the present invention is not under sail, and for example in the nominal configuration (with the bow hull in the forward position FIG. 31), the sailboat of the present invention will begin to drift backward because of the wind drag forces on the masts and fore spar. These drag forces, as the sailboat of the present invention drifts backwards, will tend to lift the rudder and the dagger board into the upward and forward direction FIG. 21E. When this occurs the rudder foil 36 and the dagger board foil 37 provide a strong resistance to drifting backward because of their semi ring wing configuration, and thus generates a force that pulls these foils in the forward and upward direction as shown in FIG. 21E. The resultant drag forces generated by both these foils is forward of the central shaft, so they provide a torque to point the sailboat of the present invention with the bow hull into the wind-see FIG. 31. When the helmsperson desires to resume sailing, the sails can be oriented to provide thrust in the forward direction, and the rudder and the dagger board foils 36 and 37 will rotate back down to the nominal vertical configuration against their respective foil rotation stop component 190, and again provide directional control for the of the present invention's desired heading.

When it is desired to fold the rudder/dagger board assembly, a rudder and dagger board foil rotation mechanism is used by the helmsperson to rotate the rudder and dagger board foils in the forward direction, as shown in FIGS. 20B, 21B, and 21F. This is the folded configuration for these components when the sailboat of the present invention is either being carried onto a trailer, being launched, or being beached. An additional function of the rudder hull 3C is to provide the location of the auxiliary electric motor propulsion system 187. This location insures that the propeller will remain at the correct depth under water independent of wave action, and the relative elevation of the base deck plane 63. The relative elevation of the rudder and dagger board hulls 3C and 3D respectively) to the base deck plane 63 is limited by the constraints of the parallelogram structure which connects the rudder hull 3C and the dagger board hull 3D to the central shaft 34. This prevents the rudder and dagger board assemblies 3A and 3B from impacting the central structural element 1 above them, or going to far down below the base deck plane 63. Therefore even if the sailboat of the present invention high waves and the individual hulls are going over waves locally under them, the rudder hull 3C and the dagger board hull 3D will maintain their displacement in the water directly under them. When the helmsperson decides to steer the sailboat of the present invention under auxiliary power, he activates the rudder rotation control servo, thus rotating the rudder hull 3C and the embedded auxiliary electric motor propulsion system 187. If the helmsperson wants to change the orientation of the space frame for docking, he can use the rudder rotation control servo 249 and the central shaft rotation constraint mechanism 210 to lock the rudder and dagger board assembly, similarly to its use while under sail. Again in the weathervane mode, the hulls will follow the direction dictated by the rudder/dagger board assembly horizontal center line 271.

There are major improvements in the present invention over prior art of the second prototype with respect to optimizing the configuration of the space frame for sail thrust generation. The second prototype had a limited hull direction rotation range of 60 degrees vs. the space frame orientation. The present invention has an increased range of rotation between the rudder and dagger board horizontal axis and the central structural element axis 252 equal to 180 degrees. This extended range of rotation allows the present invention to effectively sail as an Atlantic Proa (with outrigger on the windward side), as well as a Pacific Proa (with outrigger on the leeward side), at 90 degree rotation to either side of the nominal sailing configuration (with the rudder assembly 3A closest to the horn 10). The capability to control the space frame orientation through a range of 180 degrees insures that the most advantageous configuration of the masts and sails can be presented to the apparent wind for effectiveness over the entire range of allowable configurations from Atlantic to Pacific Proa. This capability allows the mast assemblies to "see" "clean" apparent wind velocity and generate thrust on a broad reach; in either of the Proa configurations—see FIG. 8A or 8B. In addition the sailboat of the present invention has a unique capability relative to prior multi-hulled craft for keeping the central structural element axis 252 aligned with the direction of the apparent wind as shown for example in FIG. 29, independent of the direction of motion 242, which reduces aerodynamic drag forces associated with the space frame, while simultaneously presenting the sails with clean apparent wind inlet flow.

In addition the large distance between the hulls of the present invention, yields a footprint on the sea which reduces the rocking of the space frame in rough water relative to the second prototype, which in turn minimizes the impact of large wave sea conditions on the potential disruption of the air flow over the sails while under way. The triangular arrangement of the hulls disposition insures that the space frame does not have excessive rocking while under way, independent of sailing direction, as opposed to the conventional catamaran or the trimaran multi-hulled craft.

In addition the mast assemblies can be controlled independently, so that when the space frame is in the nominal or slightly off nominal configuration (for example, sailing in a downwind run with the rudder assembly closest to the horn 10), the two mast assemblies 4B and 4C can be adjusted independently with respect to the angle each makes with the apparent wind. This in turn allows the helmsperson to steer the sailboat of the present invention by altering the angle that each the sail set makes with the apparent wind. If the port side sail set is adjusted to make a greater angle with the apparent wind, than the starboard sail set, the port sail set will generate more thrust than the starboard sail set. Under these conditions the helmsperson changes the sailboat of the present invention heading toward the port side, without the use of the rudder. Therefore the control of the orientation of space frame and the individual sail sets by the helmsperson while sailing, offers the potential for achieving acceptable sail use of the wind for propulsion, independent of the sailing direction—see FIGS. 28A, 28B, 29, 30A, 30B, 30C, 30D, and 30E.

The three hulls 2A, 2B, and 2C, of the present invention sailboat are identical. These hulls have been designed to have unique features required for this sailboat of the present invention's realization. The hulls are short and wide relative to the second prototype hulls, the shortness allows the hulls to weathervane and move through the water in a planing mode. Each of the three hulls having a trapezoidal cross section when viewed from the bow view CC in FIG. 19A, where the flat sides of each hull make a 45 degree angle with the deck plane of the hull 38, and the hull having a narrower beam at the bow than at the stern of the hull, to improve the tracking ability of the hulls in their motion aver the water. The cross section of the hull as viewed from the port side and as shown in FIG. 9B, illustrates the bottom surface of the hull having a gentle curve down to just above the nominal water line 174 at approximately 20% back along its OAL, the bottom of the hull then flattens out to be parallel to the water line for about 15% of its OAL (called the dwell area), the hull bottom then resumes its gentle curve down to its maximum depth at about another 10% of the OAL, then the bottom of the hull rises almost linearly up to the water line elevation 174 at the stern of the hull. The hull further having flukes 171A and 171B located on either side of the hull, situated at a 90 degree angle to the side plates 169A and 169B of the hull, at the stern section of the hull occupying approximately 20% of the OAL. These flukes are required to insure that the weathervane functional requirement for the hulls is met. These flukes, act as scoops, and generate very large drag forces when they are not aligned with the flow past the hull in the fore to aft direction. In addition the angle that the flukes make with the side plates force the hulls to rotate when the flow is perpendicular, or in the opposite direction to normal flow. When the flow is in the opposite direction to the normal direction of motion of the hulls through the water, the angle of the hull stern 60, forces the stern down into the water and makes the rotation of the hull in the weather vane mode to line up with the direction of motion through the water. The 45 degree angle of the side plate also reduces the drag forces on the hull forward of the hull vertical shaft when the hull is not aligned with the direction of water flow. This low resistance to flow forward of the hull vertical shaft and the high resistance of the side plates and the flukes aft of the hull vertical shaft allow the hull to always rotate in a weathervane fashion until it aligns itself with the direction of flow. This specific angle was chosen for the side plates of the hulls was for ease of fabrication. Other angles are possible and the plates don't have to be flat, as long as the weathervane function is preserved. The side plates 169A and 169B of the hull extend to a depth slightly lower than the bottom of the hull along the entire length of the hull, this serves to capture a froth layer under the hull and minimize the drag forces due the friction of the waters passage under the hull. In the dwell region of the hull, the side plates are deeper than in the remainder of the hull length, see FIG. 19B.

The side plates also serve to support an hull entry horizontal foil that is approximately parallel to the deck plane of the hull 38, and having a streamlined cross section. This horizontal foil 170 is oriented so that the water passing under the hull and interacting with the horizontal foil, tends to be deflected by the foil in a downward direction so as to make the flow of water anticipate the approaching hull bottom where the hull is deepest. This foil serves to eliminate the bow wave since the flow is already moving downward when it interacts with the hull bottom aft of the foil. The hull is effectively planing as soon as it is moving. Once the velocity of the hull increases the hull rides up on the foil in the bow of the hull, and also rides on the stern section of the hull. These two surfaces, the horizontal foil and the stern section reduce the wetted area of the hull and reduce the attendant induced drag forces due to wave or friction forces of the water on the hull.

The present invention makes a major improvement over prior art of the second prototype with respect to hull wave and drag forces. The hulls on the second prototype were basically surf boards in shape and even with the vertical side plates, did not work as well as desired at low speeds in the elimination of the bow wave. The hulls on the present invention have been optimized and not only do they have the capability to weathervane into a minimum drag orientation relative to the direction of motion, but they also completely eliminate both the bow and stern waves that would be expected to be generated in a typical boat hull below normal planing speed for a displacement hull.

The present invention is a major improvement over prior art with respect to resistance to broaching. The combination of the triangular arrangement of the hulls at the vertices of a triangle, combined with the weathervane operating mode of the hulls makes the present invention resistant to broaching, while under way or at anchor. In a broaching situation with the present invention not under sail, and with waves coming from any direction, the flow of the wave against the hulls will make then weathervane into the direction from which the waves are coming, and ride over the wave as opposed to digging into the wave, as would be the case in prior art mono and multihull sailboat's. In addition, the triangular footprint of the sailboat of the present invention on the water will assure stability independent of the direction of motion of the waves relative to the space frame orientation of the sailboat of the present invention.

Each of the three hulls of the present invention incorporates a hull vertical shaft rotation mechanism; this device mounted on the top of the hull vertical shaft and couples it to the adjacent space frame vertical shaft bearing component, when this mechanism is activated. Once coupled this rotation mechanism, which incorporates an electric motor and a magnetic clutch, (but can also incorporate other means to accomplish the described function), can be used to rotate the hull mechanically, and hold the hull in a desired orientation to the space frame. This capability, under the control of the helmsperson, is used in two circumstances. The first circumstance is when the present invention is being folded so as to fit into a slip at a dock, or when it is being folded so that it may be drawn onto a trailer for transportation. In this first circumstance the hulls have to be rotated so that they align parallel to the central structural element axis 252 to minimize the effective beam of the sailboat of the present invention—see FIG. 33A, The second circumstance occurs when the sailboat of the present invention is at sea and the helmsperson desires to configure the hulls in a star formation to limit drifting while not under sail—see FIG. 31. When these hulls are constrained in the star formation, those hulls which happen to be oriented with their stern facing the direction of potential drift (when the sails are furled) dig into the water because of the hulls stern angle 60 in FIG. 19B with the surface of the water 174 in FIG. 19B, and this in turn causes the hull to raise its bow and lower its stern, thus providing a substantial resistance to leeward drifting. In this second circumstance the helmsperson can use the hull hinge angle range control mechanism to adjust the hull angle range exactly from the normal full span of 30 degrees to a zero degree span—about the hull hinge axis 43 in FIG. 6A. This zero degree range of angular rotation is achieved when the helmsperson desires to have the deck of each hull make an angle of 30 degrees with the water line of the hull, thus allowing the hull flukes 171A, 171B and hulls stern angle 60 to create the drag in the water, when these hulls are in the star formation. The ability to change the configuration of the hulls relative to the space frame is a capability of the present invention and does not exist in any other sailing craft to the inventors knowledge at this time). Alternately intermediate hull angle ranges can be used to facilitate the passage of the hulls over waves of different heights, while under sail—see FIGS. 7A and 7B.

There are two additional improvements of the present invention over the prior art of the second prototype with respect to hull rotation and drag forces. The present invention has no hull rotation bars between hulls to assure all hull remain parallel, as was the case with the second prototype, these hull rotation bars can buckle in compression or fail in tension when individual hulls experience different high wave loadings coming from different directions. Individual hulls on the present invention can respond independently and align with the direction of motion, independent of the rudder/dagger board assembly horizontal center line orientation. This capability minimizes loads on the space frame at each hull connection point, since these loads are primarily vertical in direction, and the major load on the space frame from the hulls is just the buoyancy force provided by the hulls to support the space frame. This was not the case for the second prototype whose hulls were rigidly affixed to the dagger boards on the two bow hulls. Other mono and multi-hulled sailing sailboats typically do not have the ability to have the hulls move through the water completely independent of orientation of the rudder or dagger board assembly horizontal center line 271 orientation. An additional advantage of the three independent hulls is the ability to use the three hull in a coordinated fashion to minimize drift while the sailboat of the present invention is not under sail power, or when the masts and the fore spar are placed in the pre-deployed configuration. As mentioned earlier, if drifting is to be avoided, the helmsperson can activate the hull vertical shaft rotation mechanism 42 at the top of each hull vertical shaft—see FIG. 7A and rotates the hulls into the star configuration, as shown in FIG. 31.

Another advantage of the present invention relative to the first and second prototypes as well as conventional mono or multi-hulled sailboats is the location of the anchor attachment point on the sailboat of the present invention. In a typical sailboat the primary anchor is usually located at the bow of the sailboat or the bow of one of the hulls of a multi-hulled sailboat. In the sailboat of the present invention, the anchor attachment point 184 (the anchor winch) to the space frame is accomplished at the bow of the rudder hull 3C. The advantage of this anchor location point over the prior art is that when the sailboat of the present invention is anchored in a heavy sea, with the rudder foil 186 rotated upward in the folded configuration, the bow hull 3A is able to ride over the waves while the rudder hull 3C is holding the sailboat of the present invention in place, relative to the sea bottom (without impeding the riding of the sailboat of the present invention over these waves-see 183 in FIG. 20D). In the prior art discussed herein the anchor attachment point at the bow of the hull will hold the bow of the hull down when it is being hit by waves, increasing the possibility of swamping the sailboat.

The following deployment sequence is for the sailboat of the present invention whose size is suitable for being carried and launched from a trailer, via a launching ramp. It is assumed here that the initial configuration of the sailboat of the present invention on the trailer is in the pre-deployed (folded) configuration on a trailer.

Step #1: The trailer is backed up and moved down the launching ramp so that the starboard and port hulls of the present invention have entered the water.

Step #2: The helmsperson then sits in the helmsperson's chair 231 and controls the further steps required for control of the deployment process.

Step #3: The rudder and dagger board articulation arms 196A, 196B, 197A, and 197B, are lowered by their respective electric winches, until the associated rudder and dagger board hulls (3C and 3D), fully support their individual rudder and dagger board assembly weights due to their hulls buoyancy.

Step #4: the sailboat of the present invention is further lowered into the water until the bow hull is in the water and the sailboat of the present invention is now free of the trailer.

Step #4A: The rudder and dagger boards foils are then released and position themselves due to gravity into the nominal vertical orientation with the rudder foil against rudder rotation stop component 182, and dagger board foil against the dagger board rotation stop component 182, in the normal configuration for these foils 36—see FIG. 20E, and FIG. 21A.

Step #4B: The sailboat of the present invention is then propelled out from the launching ramp by the auxiliary electric motor propulsion system driving a foldable propeller in the rudder hull 3C.

Note: if the sailboat of the present invention is located in a slip at a pier, the starting point for leaving the slip is using the auxiliary electric motor propulsion system 187 to move out from (and clear of) the slip.

Step #5: The aft car 71 (affixed to the two hull support arms 5A and 5B) is moved sternward via the electrically driven aft car screw mechanism servo 19B, and the rearward motion of the aft car 71 is continued until the starboard and port hull arms 5A and 5B are fully deployed and this aft car 71 is at the end of its travel and locked in this location on the central structural support 1—see FIG. 11A.

Step #6: The sailboat of the present invention is then moved out to a sufficient distance from shore, or from the slip for erection of the mast assemblies 4B and 4C and fore spar 4A. The deployment of the masts and the fore spar is only permitted mechanically once the starboard and port hull support arms 5A and 5B are fully extended and locked in position.

Step #7: By means of the electrically driven screw mechanism 26B, which comprised of a servo which rotates the screw shaft 25, and an internally threaded component 27 which is attached to the component to be moved, in this case the fore spar 4A, the fore spar 4A is moved downward through the horn pivot mechanism 22 by the electrically driven screw mechanism 26B. Because the head of each mast assembly head 134 is connected by 255A and 255B to the head of the fore spar 4A, this action causes the top mast assemblies 261 to pivot around their boom base hinge shaft (s) 136 and lift up from the folded configuration—see FIG. 18B. When the fore spar 4A has been moved down to the lower limit of its travel, it rests against the fore spar lower stop 250A. At this point the fore spar 4A and the two top mast assembly 261 are almost vertical relative to the deck base plane 63—see FIGS. 20A, and 20B, and the top mast assembly 261 is locked into the boom base assembly 113 by top mast assembly pin lock mechanism 116 see FIG. 17B.

Step #8: By means of an electrically driven fore car screw mechanism servo the push rods 70 and 69 controlling the deployment of the mast support arms 6A and 6B are moved along the central structural element rails 76 in the aft direction. When the fore car 59 reaches the full deployment position, each mast support arm 6A and 6B is locked into the respective starboard and port hull support arm sockets, 92 via the aforementioned mast support arm pin 102 see FIGS. 14B and 14C.

Step #9: By means of the electrically driven fore spar screw 25 on the fore spar 4A, the fore spar 4A is moved upward a short distance through the horn pivot mechanism 22, until the mast assembly head 134 of the top mast assembly 261 is at the maximum height above the base deck plane 63. This is the nominal position of the masts and the fore spar in the deployed configuration.

Note: If while under sail, and while the sailboat of the present invention is in the Atlantic Proa configuration (FIG. 28B), the helmsperson can elect to move the fore spar 4A further up in horn pivot mechanism 22, the mast assembly axis of rotation 260 will tilt backward 272A toward the cabin 8 (see FIG. 27B) and this will change the direction of the thrust produced by the sails, when sailing downwind on a run, and this will generate a lifting force on the bow hull 2A. If while under sail and the sailboat of the present invention is in the Pacific Proa configuration as shown in FIG. 29, the helmsperson can elect to lower the fore spar through the horn pivot mechanism 22 and the mast assemblies 4C and 4D, will tilt toward the horn 10, in this configuration the sails will change the direction of the sail thrust so as to lift the bow hull 2A when the mast assembly head 134 is in the location 272B as shown FIG. 27B. The lift provided by the changing the angle of the mast assemblies axes of rotation 260 to the base plane 63 can also be used to offset part of the wind imposed load on the specific starboard or port hull which is acting as the outrigger. This capability to change the mast assembly axis of rotation angle 260 relative to the base deck plane 63 while the sailboat of the present invention is under way, allows the helmsperson to control sail lift as well as thrust in the in the allowable sailing configurations.

Returning now to the deployment sequence the following sequential steps would be implemented.

Step #10: By means of the electrically driven screw mechanism 281, the winglet support shaft 141 is moved to the full deployed configuration, which extends the sail support arms 143A and 143B on each top mast assembly 261—see FIG. 16C.

Step #11: By means of the electrically controlled sail unfurl mechanism 127, on each boom base assembly 113, the two sails are deployed on each mast assembly and held under the required, and helmsperson controlled, adjustable tension load by the servo 127—see FIG. 27B.

Step #12: The mast deployment mechanism 61 is released by the helmsperson and the mast assemblies 4B and 4C are now free to weathervane until the helmsperson decides to rotate the winglets 159A and 159B and/or the twin sail shaft 139 in order to generate thrust from the wind loads on the sails-see FIG. 16E or 16F, and 26D or 26E.

The sailing and maneuvering sequence and features of the current invention while under sail, or not under sail, are now presented. When the sailboat of the present invention is under sail there are a number of maneuvers that may be carried out. Each of the following maneuvers will be discussed in detail with respect to sequence of actions by the helmsperson.

When sailing downwind, there are a number of options for the space frame configuration and the orientation of the mast assemblies 4C and 4D. In the nominal configuration the rudder/dagger board assembly horizontal center line 271 lines up parallel to the central structural element axis 252 see FIG. 3A. If the wind is coming from directly behind the sailboat of the present invention, and the helmsperson wants to sail directly down wind, he can adjust the winglets 159A and 159B on each mast assembly so that the sails have a dihedral angle 267 as viewed down from the top of the sailboat of the present invention, as shown in FIG. 28A. Once this configuration of the mast assemblies is achieved the helmsperson can engage the boom base shaft rotation damping mechanism 273 in FIG. 14B, which constrains the boom base shafts 115 to the mast support arms 6A and 6B, but which can be overcome if the wind load induced torque on the boom base shaft is excessive. Under this constraint the sails maintain this set orientation relative to the space frame. This configuration will insure that the sailboat of the present invention follows the wind, since if the wind changes direction slightly, say coming from more from the starboard side, the starboard twin sail will generate more thrust than the port twin sail set and the sailboat of the present invention will move to balance the two sail set thrusts so that the sailboat of the present invention lines up with the wind direction exactly—see FIG. 28A. The helmsperson can also elect to have the boom base shaft rotation damping mechanism 273 disengaged and hence, by just controlling the winglets 159A and 159B, steer the sailboat of the present invention. Another use of the boom base shaft rotation damping mechanism 273 is to change the rotation orientation of either or both the mast assemblies, 4B and 4C, about their axis of rotation 260. The helmsperson can activate the boom base rotation damping mechanism 273 on the boom base shaft 115 of the mast assembly, 4B and/or 4C, and in combination with the wind and winglets (159A and 159B) rotation, have the wind rotate the twin sail pivot shaft 139 and thus change the configuration of the sails on each mast assembly 4B and/or 4C—without electrical input to the twin sail pivot shaft rotation servo 138 A.

If the sailboat of the present invention is in the nominal configuration and is sailing down wind, driven by a north wind, and the wind changes direction and is now coming from the starboard side (west wind), the nominal configuration would not be appropriate to take ad vantage of the wind, since the starboard mast assembly 4C sails would block the port mast assembly sails 4B. The helmsperson can then decide to change the space frame orientation so that the bow hull now becomes the effective downwind outrigger in the Atlantic Proa configuration as shown in FIG. 28B.

This is accomplished by rotating the rudder assembly 3A toward the port side, releasing the boom base shaft rotation damping (if it had been previous activated), and thus allowing the mast assemblies 4B and 4C to weather vane into the direction of the wind and again having the sailboat of the present invention's space frame moving downwind (moving in the easterly direction). Once the sailboat of the present invention space frame is pointing down wind, the rudder assembly 3A would then be rotated to the starboard side and the central shaft rotation constraint mechanism 210 should be released thus allowing the rudder/dagger board assembly 7 to rotate a full 90 degrees until it is oriented in a southerly direction, and the stop pin 300 has contacted the rotation stop ring 301—see FIG. 22C, so that the bow hull 2A has now become the effective outrigger hull of the sailboat of the present invention, sailing in the Atlantic Proa configuration. At this point the central shaft 34 should be relocked in position shown in FIG. 28B. In this Atlantic Proa configuration both mast assemblies "see" clean apparent west wind 240 in FIG. 22C coming from the nominal starboard side of the sailboat of the present invention. The twin sail shaft 139 is rotated and the winglet cylinder 160 is rotated to fine tune the sails for a broad reach. Again the helmsperson has the option of controlling the angle of the winglets 159A and 159B, and therefore adjusting and controlling the thrust of each twin sail set, or engaging the boom base shaft rotation damping mechanism 212, and just controlling the rudder hull 3A for directional control. In this Atlantic Proa configuration, the helmsperson can elect to move the fore spar 4A up through horn pivot mechanism 22, and this will cause the mast assemblies 4B and 4C to generate lift on the hull 2A which is acting as the downwind outrigger with the sails acting in a "kite like" manner. This in turn will lower the water drag force associated with the hull 2A and increase the speed of the sailboat of the present invention in FIG. 1.

The helmsperson can also elect to configure the space frame so that the sailboat of the present invention assumes the Pacific Proa configuration wherein the bow hull 2A becomes the effective upwind outrigger. Again the helmsperson can elect to increase the load on the bow hull 2A by adjusting the position, reducing the effective length of fore spar 4A in the horn pivot mechanism 22 and having the sails generate lift on the starboard stern hull 2C and the port hull 2B in a "kite like" manner. In this configuration the loads on all three hulls 2A, 2B, and 2C, would be more evenly distributed among them, thus reducing the hydrodynamic drag forces.

When the sailboat of the present invention is on a close reach moving in the direction 276 with the wind 275 coming from the port side see FIG. 30C, this configuration can be changed by the helmsperson so that the two mast assemblies see the clean air apparent wind as shown in FIG. 30E. This can be accomplished by releasing the central shaft 34 rotation constraint mechanism 210, and increasing the thrust from the port mast assembly (via the counterclockwise rotation of the twin sail shaft 139 and the winglet cylinder 160 relative to the starboard mast assembly). This will cause the space frame to rotate counterclockwise 277 as shown in FIG. 30D, until the bow hull 2A is facing directly into the wind 275. At this point the central shaft rotation constraint mechanism 210 is relocked, and the port and starboard side mast assemblies are reconfigured to be identical with respect to the twin sail shaft 139 and winglet cylinder 160, orientations. This configuration of the sailboat of the present invention is a Pacific Proa configuration resulting in both mast assemblies seeing the clean air apparent wind and therefore generating the most forward thrust for the sailboat of the present invention in the direction 276. The exact angle chosen by the helmsperson for the rudder/dagger board assembly 7 relative to the central structural element 1 is a function of the direction of the wind and speed objective for the sailboat of the present invention.

Assume the sailboat of the present invention is on a starboard tack and close hauled in the Pacific Proa Configuration, and the mast assemblies are oriented as shown in FIG. 30A. The helmsperson desires to change the tack to a port tack. This tacking maneuver would require the following sequence of actions. First the helmsperson rotates the rudder assembly 3A in the counter clockwise direction (toward the port side), and then the central shaft 34 would be unlocked. The torque of the rudder assembly 3A on the rudder/dagger board assembly 7 would rotate this assembly in the counter clockwise direction. The relative inertia of the space frame as compared to that of the rudder and dagger board assembly 7, would only make the rudder/dagger board assembly rotate counter clockwise. When the helmsperson sees that the rudder/dagger board assembly horizontal center line 271 is aligned with the desired port tack orientation, the central shaft 34 would be again re-locked and the rudder assembly 3A rotated in the clockwise direction until it was once again aligned with the rudder/dagger board assembly horizontal center line 271 as shown in FIG. 30B. The three hulls would then automatically weathervane in the new direction of the port tack. The helmsperson would then rotate the winglet cylinder 160 in the counter clockwise direction and the twin sail shaft 139 on each twin sail set in the clockwise direction until the sails generated thrust in the port tack direction. The sailboat of the present invention would now be fully converted from the port tack to the starboard tack see FIGS. 30A and 30B. Note that in this maneuver the mast assemblies see the same amount of clean apparent wind on their sails on each tack. The Atlantic Proa configuration cannot be used in tacking maneuvers because of the rotation limits on the rudder/dagger board assembly 7.

The Atlantic Proa configuration is appropriate for a sailing on a broad reach or a downwind run—see FIG. 1, where the bow hull 2A acts as the effective outrigger. This is the case because of the limitations on the +/−90 degree rotation of the rudder/dagger board assembly 7, about the nominal configuration, which in turn is dictated by the visibility requirements for the helmsperson—see FIGS. 23B, and 30H.

The sailboat of the present invention can also perform maneuvers that would be impossible for mono hull sailboats. It can reverse direction without rotating the sailboat of the present invention's space frame. This can be done on a beam reach where for example there is a north wind 275 in FIG. 30F, and the sailboat of the present invention is in the Pacific Proa Configuration and sailing due west 276. If the helmsperson decides to reverse direction and sail due east, the following sequence of action would be required. The rudder assembly 3A would be rotated clockwise, and the central shaft 34 rotation constraint mechanism 210 released. The rudder and dagger board assembly 7 would then rotate clockwise until the rudder and dagger board assembly was facing due east as shown in FIG. 30G. At this point the rudder foil 36 and the dagger board rudder foil 37 would rotate upward because of the momentum of the sailboat of the present invention in the westward direction, and the thrust of the sails in the westward direction. Once this orientation of the rudder/dagger board assembly 7 was achieved, the helmsperson would re-lock the central shaft 34 rotation constraint mechanism 210 and rotate the winglets 159A and 159B and twin sail shaft 139 on each mast assembly so that their thrust would now be in the eastward direction 276 in FIG. 30G. The sailboat of the present invention would come to a complete stop and then begin moving due east 276, while the rudder foil 36 and the dagger board foil 37 are rotated backward into their nominal vertical orientation, due to water drag forces. The maneuver would be now be complete and the direction of sailboat of the present invention motion reversed into a beam reach going eastward as shown in FIG. 30G.

If the sailboat of the present invention is under sail, and it is desired by the helmsperson to stop sailing, the following sequence of actions would be taken. The sailboat of the present invention would be sailed directly into the wind, with the rudder and dagger board assembly 7 parallel to the central structural element axis 252, and the twin sail shaft 139 and the winglet shafts 157 would be returned to the nominal configuration, and the mast assemblies 4B and 4C would just weather vane in the wind. The sailboat of the present invention would then begin to drift backwards due to the wind drag. The backward motion of the sailboat of the present invention drifting down wind would now be countered by automatic rising of the rudder and dagger board foils 36 and 37 in the forward direction (toward the bow hull 2A). These foils would provide a "sea anchor like drag" to slow down the backward drifting of the sailboat of the present invention while keeping the bow hull 2A and the central structural element pointing into the wind as shown in FIG. 32. The drifting backward could be further reduced by furling the sails, which would result the drag on the winglets 159A and 159B rotating the mast assembles so that the winglets 159A and 159B would be facing sternward, thus lowering the net drag from the wind on the mast assemblies. This capability is an advantage over prior art with respect to both mono and multi hulled sailboat of the present invention s which would have to put out a sea anchor to limit drifting at sea while not under sail, since the sailboat of the present invention, automatically points into the wind when the sails are furled. If further reduction in drifting is desired by the helmsperson the star formation of the hulls could be implemented as described below.

Under some conditions, when the sailboat of the present invention is not under sail, it may be desirable to minimize drifting to the extent possible. Under these circumstances the sailboat of the present invention in FIG. 1 can be configured in the nominal configuration while still under sail, the sails can then be furled, and the steps identified above implemented to have the sailboat pointing into the wind. At this point the helmsperson would disable the free rotation of the hulls in the normal sailing weather vane mode, and would then activate the hull vertical shaft rotation mechanism 42, which controls the rotation of the hull vertical shaft 41. This activation would involve the lock up of the magnetic clutch so that the electric motor and the associated gears would be directly coupled to the hull vertical shaft 41. The electric motor could then be energized and the used to rotate the bow hull 2A, so that the stern of this hull 2A would be closest to the central shaft 34. Once this orientation is achieved the helmsperson would stop activation of the servo and the motor and the bow hull 2A would be locked in this orientation. Similarly the helmsperson could then rotate the port and starboard hulls 2B and 2C through their respective hull vertical shaft rotation mechanisms 42 so that the starboard and port hulls sterns were also closest to the central shaft, with each hulls axis 280 exactly 120 degrees apart 246—see FIG. 31. The helmsperson would then use the motor/generator in the electric shock absorbers in each hull through the hull hinge angle range control mechanism 40, to rotate each hull about its horizontal hinge axis 43 so that each hull would be at a 30 degree angle to the deck base plane 63, with the bow of each hull in the upward orientation. In this configuration (the star formation) the flukes of the hulls would inhibit drifting in any direction for the sailboat of the present invention. The flukes on any hull, or hulls, whose fixed orientation happens to oppose any directional drifting, would dig into the water like a scoop, and would provide a very high water drag force to oppose this drifting. If required, the mast assemblies 4B and 4C and the fore spar 4A could also be lowered (as described in the following section on folding) to minimize wind drag loads on the sailboat of the present invention mast assemblies 4B and 4C and fore spar 4A. The large triangular foot print of the sailboat of the present invention hulls, in the star formation on the water should insure a large resistance against drift, no matter from which quarter the wind is coming, relative to the space frame orientation of the sailboat of the present invention. In addition the fact that each hull has its bow raised would insure that the sailboat of the present invention of FIG. 1 would ride over oncoming waves from any quarter, and not dig that section of the space frame into the water.

The anchoring process for the sailboat of the present invention involves the following sequence of actions. When approaching the anchoring location, the sails are furled and the auxiliary electric motor propulsion system 187 is activated, then rudder foil 36 is raised into the folded configuration, by its foil retraction servo 182, so that this foil will not interfere with the anchor chain (or line) 183 while the sailboat of the present invention in FIG. 1 is in the process of anchoring. Once the anchor is set the dagger board foil 37 foil is raised by the retraction servo 182. The rudder and dagger board foils 36 and 37 respectively are always kept in the folded configuration while the sailboat of the present invention is at anchor, or having the anchor raised.

When the sailboat of the present invention is going to move into its slip at a dock, or moved onto a trailer from the fully deployed configuration on the water, the following steps are required.

Step #1: The mast assemblies and the winglets are set to the nominal configuration, and mast deployment mechanism 61 is locked so that the boom base assembly is forced to remain parallel to the central structural element axis 252. The sailboat of the present invention will then drift backwards in the wind with the rudder foil 36 rotating upward into the drag configuration to align the drift of the sailboat of the present invention with the bow pointing into the wind. If required, the winglet cylinder 160 can be rotated slightly back and forth until the boom base shaft rotation lock 112 in the mast deployment mechanism 61 is set, or if there is little wind, the electrically driven boom base shaft rotation damping mechanism 212, on each mast support arm 6A and 6B can be used to rotate each corresponding mast assembly 4B and 4C so that the mast deployment mechanism 61 coupling to the boom base shaft 34 is accomplished.

Step #2: The sails on the twin sail set are furled about their sail shafts 145A and 145B and the winglet support shafts 141 are slid back toward their respective mast assembly axis of rotation 260, see FIG. 18B: Note: the winglet support shafts can be slid back into the pre-deployed configuration, when the mast assemblies are down as shown in FIG. 18B, or while the mast assemblies are in the deployed configuration FIG. 17A.

Step #3: The fore car 59 connected to the mast support arms 6A and 6B is unlocked and moved along the central structural element rails 76 toward the horn 10 until these arms are close to the fully folded configuration, see FIG. 33A.

Step #4: The fore spar 4A is moved down through the horn pivot mechanism 22, at the top of the horn 10, until the boom base hinge shaft 136 is aligned with the sockets 14A and 14B on the horn 10. Once aligned, the fore car 59 is moved into the final folded position and the boom base hinge shaft ends 136A and 136B fit into the horn sockets 14A and 14B. Simultaneously the mast pin 119 at the rear of each boom base assembly 113 fits into the associated strut shaft pin socket 85 and 86 on top of each strut shaft 87 and 88 respectively on the central structural element 1; see FIG. 11B. The boom base assembly 113 and the attached top mast assembly 261 (in FIG. 16A) are now locked on to the central structural element 1 and the horn 10 in FIG. 27A.

Step #5: The top mast assembly pin lock mechanism 116 that joins the top mast assembly 261—and the boom base assembly 113 is now unlocked and the fore spar 4A is slowly driven upward through the horn pivot mechanism 22. As it moves, the top mast assemblies 261 and the fore spar 4A move down toward the cabin 8, while the top mast assemblies rotate around their respective boom base hinge shafts 136, until the fore spar 4A rests in the fore spar support cradle 89 at the top of the top cabin support shaft 90—see FIG. 12.

Step #6: The aft car 71, which is connected to the starboard and port hull support arms 5A and 5B, is now unlocked and moved along the central structural element rails 76, toward the horn 10, until the starboard and port hull support arms 5A and 5B and the associated hulls are in the fully folded configuration—see FIG. 33A.

Step #7: The sailboat of the present invention can now be moved into the slip or onto the trailer. In the case where the sailboat of the present invention is being pulled up onto a trailer the rudder and the dagger board foils (36 and 37 respectively) must be pre-rotated into the folded configuration, with the rudder and dagger board assembly horizontal center line 271 is parallel to the central structural element axis 252, and the rudder and dagger board assemblies 3A and 3B are pulled up against the central structural element 1 by means of the electric winch associated with each—see FIG. 21E.

Once the sailboat of the present invention s space frame and sails are fully deployed, all control functions can be carried out by the helmsperson, while seated in the helmsperson's chair 231. Below is a list of functions and the associated electric control devices and locations for this specific realization. It should be noted that these controls are independent of the size of the sailboat of the present invention, and can be effectively utilized on any size realization of this design concept sailboat of the present invention. One of the key capabilities of both the sail and the rudder/dagger board assembly 7 is the minimum force requirements for sail control and course changes, both starboard mast assembly and port mast assembly as well as the rudder/dagger board assembly are all configured to provide balanced reaction forces under all conditions (when deployed), such that incremental movements, require very little energy input for the winglets 159A and 159B or the rudder assembly 3A, but engender major changes in space frame and sail orientation. The use of electric controls, eliminates the problems associated with mechanical couplings, block and tackles, and frees the design from inherent limitations on rotation of components and mechanical advantage issues existing in prior art, multi and mono hull sailing craft.

The helmsperson's chair 231 has an attached control console 230 from which all the electrical control functions can be executed. In order to provide an alternative to complete control by the helmsperson's under standard maneuvers, the logic required to change the mast assembly configurations to nominal (in the weather vane configuration, to sailing in a downwind run, or to port or starboard tacks are programmed into the control console, and can be activated, or deactivated, by the toggling of a single switch. Furling and unfurling the sails can also be controlled by a switch on the control console 230, of controlled by the helmsperson directly.

Further modifications of the invention herein disclosed will occur to persons skilled in the art and all such modifications are deemed to be within the scope of the invention as defined by the appended claims.

What is claimed is:

1. A sailboat adapted to sail on water in a sailing direction, comprising:

a central structural element;

a bow hull attached to said central structural element, said bow hull pivotably attached to said central structural element by a first vertical shaft and independently pivotable about a first vertical axis;

a port side hull support arm extending from said central structural element;

a port side hull attached to said port side hull support arm, said port side hull pivotably attached to said port side hull support arm by a second vertical shaft and independently pivotable about a second vertical axis;

a starboard side hull support arm extending from said central structural element;

a starboard side hull attached to said starboard side hull support arm, said starboard side hull pivotably attached to said starboard side hull support arm by a third vertical shaft and independently pivotable about a third vertical axis;

a port side mast support arm;

a port side mast assembly attached at a first end to said port side mast support arm;

a starboard side mast support arm;

a starboard side mast assembly attached at a first end to said starboard side mast support arm; and a fore spar attached at a first end to said central structural element;

wherein a second end of said fore spar, a second end of said port side mast assembly and a second end of said starboard side mast assembly are pivotably attached together, such that said port side mast assembly and said starboard side mast assembly rotate independently; and wherein said bow hull, said port side hull and said starboard side hull form vertices of a triangle, and each of said bow hull, said port side hull and said starboard side hull can rotate about its respective vertical axis independently of the other hulls; and a rudder and dagger board assembly, having a horizontal axis, pivotably attached to an underside of said central structural element by a central shaft, such that said horizontal axis of said rudder and dagger board assembly defines a direction in which said sailboat travels, wherein said rudder and dagger board assembly can rotate independently of said hulls.

2. The sailboat of claim 1, further comprising a helmspersons chair mounted to said central shaft, such that said chair always faces said direction of travel.

3. The sailboat of claim 1, wherein said rudder and dagger board assembly can rotate +/−90 degrees.

4. The sailboat of claim 1, wherein said port side mast assembly and said starboard side mast assembly each comprise a twin sail set, having a first configuration wherein a first of said twin sails can be moved forward relative to a second twin sail, such that said first twin sail acts as a jib and said second twin sail acts as a main sail; and a second configuration where said second of said twin sails can also be moved forward relative to said first twin sail, such that said first twin sail acts as a main sail and said second twin sail acts as a jib.

5. A sailboat adapted to sail on water in a sailing direction comprising:

a central structural element;

a bow hull attached to said central structural element;

a fore spar attached at a first end to said central structural element;

a port side hull support arm extending from said central structural element;

a port side hull attached to said port side hull support arm;

a port side mast support arm;

a port side mast assembly attached at a first end to said port side mast support arm;

a starboard side hull support arm extending from said central structural element;

a starboard side hull attached to said starboard side hull support arm;

a starboard side mast support arm;

a starboard side mast assembly attached at a first end to said starboard side mast support arm;

a rudder and dagger board assembly, having a horizontal axis, pivotably attached to an underside of said central structural element by a central shaft, such that said horizontal axis of said rudder and dagger board assembly defines a direction in which said sailboat travels, wherein said rudder and dagger board assembly can rotate independently of said hulls wherein a second end of said fore spar, a second end of said port side mast assembly and a second end of said starboard side mast assembly are pivotably attached together; and wherein said port side mast assembly and said starboard side mast assembly each comprise a twin sail set, having a first configuration wherein first of said twin sails is moved forward relative to a second twin sail, such that said first twin sail acts as a jib and said second twin sail acts as a main sail, and a second configuration where said second of said twin sails is moved forward relative to said first twin sail, such that said first twin sail acts as a main sail and said second twin sail acts as a jib; and wherein said bow hull is pivotably attached to said central structural element by a first vertical shaft and is independently pivotable about a first vertical axis;

said port side hull pivotably attached to said port side hull support arm by a second vertical shaft and independently pivotable about a second vertical axis; and said starboard side hull pivotably attached to said starboard side hull support arm by a third vertical shaft and independently pivotable about a third vertical axis, and wherein each of said bow hull, said port side hull and said starboard side hull can rotate about a respective vertical axis independently of the other hulls.

6. The sailboat of claim 5, wherein said rudder and dagger board assembly can rotate +/−90 degrees.

7. The sailboat of claim 5, further comprising a helmspersons chair mount to said central shaft, such that said chair always faces said direction of travel.

8. A sailboat adapted to sail on water in a sailing direction, comprising:

a central structural element;

a bow hull attached to said central structural element, said bow hull pivotably attached to said central structural element by a first vertical shaft and independently pivotable about a first vertical axis;

a port side hull support arm extending from said central structural element;

a port side hull attached to said port side hull support arm, said port side hull pivotably attached to said port side hull support arm by a second vertical shaft and independently pivotable about a second vertical axis;

a starboard side hull support arm extending from said central structural element;

a starboard side hull attached to said starboard side hull support arm, said starboard side hull pivotably attached to said starboard side hull support arm by a third vertical shaft and independently pivotable about a third vertical axis;

wherein said bow hull, said port side hull and said starboard side hull form vertices of a triangle, and each of said bow hull, said port side hull and said starboard side hull can rotate about its respective vertical axis independently of the other hulls;

a rudder and dagger board assembly, having a horizontal axis, pivotably attached to an underside of said central structural element by a central shaft, such that said horizontal axis of said rudder and dagger board assembly defines a direction in which said sailboat travels, wherein said rudder and dagger board assembly can rotate independently of said hulls; and a helmspersons chair mounted to said central shaft, such that said chair always faces said direction of travel.

9. The sailboat of claim 8, wherein said rudder and dagger board assembly can rotate +/−90 degrees.

10. The sailboat of claim 8, wherein said port side mast assembly and said starboard side mast assembly each comprise a twin sail set, having a first configuration wherein a first of said twin sails can be moved forward relative to a second twin sail, such that said first twin sail acts as a jib and said second twin sail acts as a main sail; and a second configuration where said second of said twin sails can also be moved forward relative to said first twin sail, such that said first twin sail acts as a main sail and said second twin sail acts as a jib.

* * * * *